US006855215B2

(12) United States Patent
Kushida et al.

(10) Patent No.: US 6,855,215 B2
(45) Date of Patent: Feb. 15, 2005

(54) TABLEWARE AND METHOD FOR SURFACE TREATMENT THEREOF, SUBSTRATE HAVING HARD DECORATIVE COATING FILM AND METHOD FOR PRODUCTION THEREOF

(75) Inventors: Hachirou Kushida, Nishitokyo (JP); Yutaka Fukumura, Nishitokyo (JP); Yukio Miya, Nishitokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 293 days.

(21) Appl. No.: 10/018,989

(22) PCT Filed: Jul. 3, 2001

(86) PCT No.: PCT/JP01/01773

§ 371 (c)(1),
(2), (4) Date: Dec. 19, 2001

(87) PCT Pub. No.: WO01/79004

PCT Pub. Date: Oct. 25, 2001

(65) Prior Publication Data

US 2003/0118858 A1 Jun. 26, 2003

(30) Foreign Application Priority Data

Apr. 19, 2000 (JP) ..... 2000-117390
Sep. 4, 2000 (JP) ..... 2000-266607

(51) Int. Cl.[7] ..... C22F 1/18
(52) U.S. Cl. ..... 148/421; 148/671
(58) Field of Search ..... 148/421, 671

(56) References Cited

U.S. PATENT DOCUMENTS 3,765,954 A * 10/1973 Tokuda et al. ..... 148/220
4,512,826 A * 4/1985 Whang ..... 148/407

OTHER PUBLICATIONS

Derwent Jp Abstract, JP 11043760A, Feb. 16, 1999.*
Derwent Jp Abstract, JP 05077085A, Mar. 30, 1993.*

* cited by examiner

*Primary Examiner*—Daniel Jenkins
(74) *Attorney, Agent, or Firm*—Webb Ziesenheim Logsdon Orkin & Hanson, P.C.

(57) ABSTRACT

Tableware of Ti or a Ti alloy having a surface hardened layer comprising a first hardened layer in which nitrogen and oxygen are diffused so as to form a solid solution and a second hardened layer which is formed in a region deeper than the first hardened layer. The substrate may have a hard decorative coating film. A substrate comprising Ti or a Ti alloy has on its surface an internal hardened layer comprising a first hardened layer and a second hardened layer, wherein the hard decorative coating film is formed on the surface of the internal hardened layer. The cutlery comprises a working part and a grip, the grip provided with a floating means such as a hollow part. Titanium tableware having excellent long-term mar resistance and high quality appearance, increasing the decorative value of the tableware. Further, a process for surface treatment to obtain the titanium tableware with high productivity and a substrate having a hard decorative coating film with excellent mar resistance and high surface hardness. The cutlery is lightweight, mar-resistant and can be easily handled.

44 Claims, 28 Drawing Sheets

TABLEWARE AND METHOD FOR SURFACE TREATMENT THEREOF, SUBSTRATE HAVING HARD DECORATIVE COATING FILM AND METHOD FOR PRODUCTION THEREOF

BACKGROUND OF THE INVENTION

Technical Field

The present invention relates to tableware or flatware (cutter, and cutlery such as a knife, fork and spoon, as well as related serving pieces) and a process for surface treatment of the tableware. More particularly, the invention relates to titanium or titanium alloy tableware, the surface of which has been hardened by surface treatment, and a process for surface treatment of the tableware.

The present invention further relates to a substrate having a hard decorative coating film and a process for producing the substrate. Particularly, the invention relates to a substrate, such as a camera body, a cellular telephone body, a portable radio body, a video camera body, a lighter body, a personal computer main body or the like, more particularly a substrate having a hard decorative coating film, specifically, a substrate having an internal hardened layer formed on its surface and a hard decorative coating film formed on a surface of the internal hardened layer, and a process for producing the substrate.

The present invention furthermore relates to cutlery, such as spoon, fork and knife (metallic Western-style tableware), and more particularly to cutlery having a floating function by which the cutlery floats up in water.

BACKGROUND ART

Nowadays, stainless steel knives, forks and spoons are widely used as tableware. The stainless steel tableware, however, is heavy, so that it is somewhat hard to eat meals with the tableware. Particularly for the infants and elderly people, the tableware made of heavy stainless steel is extremely difficult to handle.

When the stainless steel tableware is used to eat food using vinegar or mayonnaise, a slight amount of iron ion or the like is liberated from the stainless steel, and the odor of iron is mingled with the flavor of the food to sometimes spoil the taste of the food.

On this account, tableware made of titanium or a titanium alloy came to be used recently. Such tableware has advantages that it is lightweight and is hardly ionized. The titanium or titanium alloy tableware, however, is liable to be marred because its surface hardness is low, and when the tableware is used for a long period of time, its mirror surface becomes cloudy because of the marring, resulting in deterioration of the appearance quality.

In order to improve low surface hardness of titanium or a titanium alloy, various surface hardening treatments have been attempted. As the technique to harden the titanium or titanium alloy tableware, treatments such as ion implantation, ion nitridation and carburizing are known.

In such surface hardening technique, however, there are problems that the treating is time-consuming and the productivity is bad. In addition, because of the high treating temperature, the crystal grains on the surface become large, and an element to be diffused so as to form a solid solution, such as nitrogen or oxygen, and titanium together form a compound layer to roughen the surface. Therefore, the beautiful mirror surface of the tableware cannot be maintained. Moreover, it is difficult to obtain a hardened layer that reaches the deep region from the surface, so that when the tableware is used for a long period of time, marring is brought about and the appearance quality of the tableware is lowered.

By the way, to satisfy corrosion resistance and lightweight properties, substrates made of titanium or a titanium alloy are now widely used for camera body, cellular telephone body, watch case, portable radio body, video camera body, lighter body, personal computer main body and the like.

These materials, however, are liable to be marred because of low hardness, and besides, they have gray color tone and are poor in decorative quality. In order to solve these problems, some articles have substrates the surfaces of which are coated with hard coating films of titanium nitride or the like by dry plating.

The substrates having such hard coating films have gold color tone and are not marred easily. The hard coating film, however, is a thin film of usually about 1 $\mu$m, so that if a strong force is applied to the coating film surface, the material may be deformed to produce irregularities on the substrate surface despite intactness of the coating film. If the irregularities are extreme, the coating film may separate off because of the internal stress.

As cutlery generally used at present, there are, for example, spoons, forks and knives made of SUS (stainless steel), and besides, there are expensive ones made of silver. Such cutlery, however, is heavy and is not easy to handle for the infants and elderly people.

Further, if the SUS cutlery is used to eat food using vinegar, mayonnaise or the like, a slight amount of iron ion is liberated from the SUS material, and the odor of iron is mingled with the flavor of the food to deteriorate the taste of the food. On the other hand, the silver cutlery has a problem that if the cutlery surface is brought into contact with water or air, an oxidation coating film is formed to reduce the gloss and thereby deteriorate the appearance quality.

In such circumstances, cutlery using titanium or a titanium alloy as a material has recently come on the market and has been used. Such cutlery has advantages that it is more lightweight and is hardly ionized as compared with the SUS or silver cutlery, but there are problems that the cutlery is liable to be marred because of low surface hardness and that when the cutlery is used for a long period of time, its mirror surface becomes cloudy because of the marring, resulting in deterioration of the appearance quality. To solve the problems, titanium or titanium alloy cutlery with a hardened layer formed in a given depth from the surface has been manufactured.

FIGS. 39 to 41 are each a plan view showing conventional cutlery. FIG. 39 is a plan view of a spoon, FIG. 40 is a plan view of a fork, and FIG. 41 is a plan view of a knife. Referring to FIG. 39 to FIG. 41, a metal such as SUS, silver, titanium or a titanium alloy is used as a cutlery material and is subjected to press molding to form a working part (cutlery body) 51*a*, 51*b* or 51*c* in a shape of spoon, fork or knife and a grip 52*a*, 52*b* or 52*c* in a stick shape in one united body, whereby a spoon 53, a fork 54 or a knife 55 is produced.

The cutlery mentioned above is made of a metal such as SUS, silver, titanium or a titanium alloy, so that the specific gravity of the member is higher than that of water, and hence the cutlery sinks in water when washed. Therefore, it is troublesome to wash the cutlery together with other tableware, or the surface of the tableware may be marred by the contact with one another.

Especially in the places where a great number of cutlery are used, such as a kitchen for school meals and a dining room of a company, or a restaurant, working efficiency of the cutlery washing is bad.

Moreover, the cutlery sinks to the bottom of the washing tub, being brought into contact with dirty things deposited on the bottom, which is very unsanitary.

In addition, there are other various problems, for example, the likelihood of losing the cutlery when used at the waterside outdoors and carelessly dropped under water.

The present invention solves the problems associated with the prior art as described above and provides titanium or titanium alloy tableware having excellent appearance quality, which is capable of maintaining its beautiful mirror surface even if it is used for a long period of time, by the formation of a hardened layer which extends into a deep region beneath the surface.

The invention further provides a process for surface treatment with high productivity, which is applied on titanium or titanium alloy tableware to impart the above-mentioned excellent appearance quality to the tableware.

Still further, the invention solves the problems associated with the prior art as described above by providing a substrate having a hard decorative coating film, which is free from the occurrence of marring on the decorative coating film and formation of irregularities on the substrate surface even if a strong force is applied to the coating film surface, wherein the coating film resists separation. The invention also provides a process for producing the substrate.

The invention further provides a titanium or titanium alloy substrate coated with a hard decorative coating film having a durable, beautiful surface even after long periods of use which retains its excellent quality and appearance.

In view of the problems associated with the prior art as described above, it is a further object of the invention to provide cutlery which is lightweight, likely to float on water, has an easy grip and a good touch, and is decorative and inexpensive.

It is a further object of the invention to make it possible to wash the present cutlery easily by providing buoyancy to the cutlery so as to permit it to float on water.

SUMMARY OF THE INVENTION

The tableware according to the invention is titanium or titanium alloy tableware having a surface hardened layer formed in an arbitrary depth from the surface, wherein the surface hardened layer comprises a first hardened layer which is formed in the region of an arbitrary depth from the surface and in which nitrogen and oxygen are diffused so as to form a solid solution, and a second hardened layer which is formed in an arbitrary region deeper than the first hardened layer.

In the tableware of the invention, it is preferable that 0.6 to 8.0% by weight of nitrogen and 1.0 to 14.0% by weight of oxygen are diffused so as to form a solid solution in the first hardened layer and 0.5 to 14.0% by weight of oxygen is diffused so as to forma solid solution in the second hardened layer.

In the tableware of the invention, it is preferable that the first hardened layer is formed in the region of a given depth, usually a depth of about 1 $\mu$m, from the surface and the second hardened layer is formed in the region deeper than the first hardened layer and of a given depth from the surface, usually a depth of about 20 $\mu$m.

The process for surface treatment of tableware according to the invention comprises:

a heating step wherein titanium or titanium alloy tableware is placed in a vacuum chamber and heated to anneal the tableware, a hardening treatment step wherein a mixed gas containing nitrogen as a main component and an oxygen component is introduced into the vacuum chamber after the heating step, and the vacuum chamber is heated at a temperature of 700 to 800° C. for a given period of time under given reduced pressure to diffuse nitrogen and oxygen inside the titanium or titanium alloy tableware from the surface so as to form a solid solution, a cooling step wherein the titanium or titanium alloy tableware is cooled to room temperature after the hardening treatment step, and a polishing step wherein the tableware is polished after the cooling step.

In the heating step, it is possible that the vacuum chamber is evacuated and heating is carried out under reduced pressure.

In the heating step, it is also possible that the vacuum chamber is evacuated, then an inert gas is introduced into the vacuum chamber, and heating is carried out under reduced pressure.

In the cooling step, it is possible that the vacuum chamber is highly evacuated to remove the mixed gas containing nitrogen as a main component and a slight amount of an oxygen component, and cooling is carried out under vacuum.

In the cooling step, it is also possible that the vacuum chamber is highly evacuated to remove the mixed gas containing nitrogen as a main component and a slight amount of an oxygen component, then an inert gas is introduced into the vacuum chamber, and cooling is carried out under reduced pressure.

As the mixed gas containing nitrogen as a main component and a slight amount of an oxygen component, a mixed gas comprising a nitrogen gas containing a slight amount of an oxygen gas is employable.

Also employable is a mixed gas comprising a nitrogen gas containing a slight amount of a hydrogen gas or a mixed gas comprising a nitrogen gas containing a slight amount of water vapor.

As the mixed gas containing nitrogen as a main component and a slight amount of an oxygen component, a mixed gas comprising a nitrogen gas containing a slight amount of a carbon dioxide gas or a carbon monoxide gas is also employable.

As the mixed gas containing nitrogen as a main component and a slight amount of an oxygen component, moreover, a mixed gas comprising a nitrogen gas containing a slight amount of an alcohol gas is also employable.

The other process for surface treatment of tableware according to the invention comprises:

a heating step wherein titanium or titanium alloy tableware is placed in a vacuum chamber, the vacuum chamber is evacuated, then an inert gas is introduced into the vacuum chamber, and the tableware is heated under reduced pressure to anneal the tableware, a hardening treatment step wherein the vacuum chamber is evacuated to remove the inert gas after the heating step, then a mixed gas containing nitrogen as a main component and a slight amount of an oxygen gas is introduced into the vacuum chamber, the pressure in the vacuum chamber is adjusted to atmospheric pressure, and the vacuum chamber is heated at a temperature of 700 to 800° C. for a given period of time to diffuse nitrogen and oxygen inside the titanium or titanium alloy tableware from the surface so as to form a solid solution, a cooling step wherein the titanium or titanium alloy tableware is cooled to room temperature after the hardening treatment step, and a polishing step wherein the tableware is polished after the cooling step.

In the heating step, it is possible that the vacuum chamber is evacuated and heating is carried out under reduced pressure.

In the heating step, it is also possible that the vacuum chamber is evacuated, then an inert gas is introduced into the vacuum chamber to adjust the pressure to atmospheric pressure, and heating is carried out at atmospheric pressure.

In the cooling step, it is possible that the vacuum chamber is highly evacuated to remove the mixed gas containing nitrogen as a main component and a slight amount of an oxygen component, and cooling is carried out under vacuum.

In the cooling step, it is also possible that the vacuum chamber is highly evacuated to remove the mixed gas containing nitrogen as a main component and a slight amount of an oxygen component, then an inert gas is introduced into the vacuum chamber to adjust the pressure to atmospheric pressure, and cooling is carried out at atmospheric pressure.

As the mixed gas containing nitrogen as a main component and a slight amount of an oxygen component, a mixed gas comprising a nitrogen gas containing a slight amount of an oxygen gas or a mixed gas comprising a nitrogen gas containing a slight amount of water vapor is also employable.

In the aforesaid tableware of the invention, the first hardened layer is desirably coated with a hard coating film.

The hard coating film is preferably a nitride, a carbide, an oxide, a nitrido-carbide or a nitrido-carbido-oxide of a 4a, 5a or 6a Group element of the periodic table.

The hard coating film may show a gold color tone.

The hard coating film showing a gold color tone is preferably further coated with a gold alloy coating film.

The gold alloy coating film is preferably made of an alloy of gold and at least one metal selected from Al, Si, V, Cr, Ti, Fe, Co, Ni, Cu, Zn, Ge, Y, Zr, Nb, Mo, Ru, Rh, Pd, Ag, Cd, In, Sn, Hf, Ta, W, Ir and Pt.

In the aforesaid tableware of the invention, the surface of the first hardened layer has been preferably polished.

The substrate having a hard decorative coating film according to the invention is a substrate having a hard decorative coating film on the surface, which comprises titanium or a titanium alloy and has an internal hardened layer comprising a first hardened layer that is formed in an arbitrary depth toward the inside from the surface, in said first hardened layer nitrogen and oxygen being diffused so as to form a solid solution, and a second hardened layer that is formed in an arbitrary depth toward the inside from the first hardened layer, wherein the hard decorative coating film is formed on the surface of the internal hardened layer.

In the internal hardened layer, it is preferable that 0.6 to 8.0% by weight of nitrogen and 1.0 to 14.0% by weight of oxygen are diffused so as to form a solid solution in the first hardened layer and 0.5 to 14.0% by weight of oxygen is diffused so as to form a solid solution in the second hardened layer.

In the internal hardened layer formed in the substrate, it is also preferable that the first hardened layer is formed in the region of about 1 $\mu$m (maximum: 1.4 $\mu$m) toward the inside from the surface and the second hardened layer is formed in the region deeper than the first hardened layer and of about 20 $\mu$m (maximum: 20.4 $\mu$m) toward the inside from the surface.

The hard decorative coating film is preferably made of a nitride, a carbide, an oxide, a nitrido-carbide or a nitrido-carbido-oxide of a 4a, 5a or 6a Group element of the periodic table, and is particularly preferably a hard carbon coating film.

The substrate having a hard decorative coating film according to the invention may have, between the internal hardened layer and the hard decorative coating film, an intermediate layer of a two-layer structure consisting of a lower layer mainly made of chromium or titanium and an upper layer mainly made of silicon or-germanium, or may have therebetween an intermediate layer of a two-layer structure consisting of a lower layer mainly made of titanium and an upper layer mainly made of anyone of tungsten, tungsten carbide, silicon carbide and titanium carbide.

The thickness of the hard decorative coating film is in the range of usually 0.1 to 3.0 $\mu$m.

The surface of the hard decorative coating film may show a gold color tone.

On the surface of the hard decorative coating film showing a gold color tone, a coating film comprising gold or a gold alloy is preferably formed.

The substrate having a hard decorative coating film according to the invention is, for example, a camera body, a cellular telephone body, a portable radio body, a video camera body, a lighter body or a personal computer main body.

The process for producing a substrate having a hard decorative coating film according to the invention comprises:

a heating step wherein a substrate comprising titanium or a titanium alloy is placed in a vacuum chamber and annealed, a hardening treatment step wherein a mixed gas containing nitrogen as a main component and a slight amount of an oxygen component is introduced into the vacuum chamber, and the vacuum chamber is heated at a temperature of 700 to 800° C. for a given period of time under given reduced pressure to diffuse nitrogen and oxygen inside the titanium or titanium alloy substrate from the surface so as to form a solid solution, a cooling step wherein the titanium or titanium alloy substrate is cooled to room temperature, a polishing step wherein the substrate surface is polished, a washing step wherein the substrate is washed, an evacuation step wherein the substrate is set in a vacuum chamber and the vacuum chamber is evacuated, an ion bombardment step wherein argon is introduced into the vacuum chamber and ionized to ion bombard the substrate surface, a step wherein an intermediate layer comprising a metal or a metallic carbide is formed on the substrate surface by sputtering, a step wherein argon is exhausted from the vacuum chamber and a gas containing carbon is introduced into the vacuum chamber, and a step wherein plasma is generated in the vacuum chamber and a diamond-like carbon coating film is formed on the surface of the intermediate layer by plasma CVD treatment.

In the step of forming an intermediate layer, it is preferable that argon is introduced into the vacuum chamber and ionized, and anyone of silicon, tungsten, titanium carbide, silicon carbide and chromium carbide is targeted to form an intermediate layer mainly made of any one of silicon, tungsten, titanium carbide, silicon carbide and chromium carbide.

The step of forming an intermediate layer may consist of:

a first intermediate layer forming step wherein argon is introduced into the vacuum chamber and ionized, and chromium or titanium is targeted to form a lower layer mainly made of chromium or titanium, and a second intermediate layer forming step wherein silicon or germanium is targeted to form an upper layer mainly made of silicon or germanium.

The step of forming an intermediate layer may consist of:

a first intermediate layer forming step wherein argon is introduced into the vacuum chamber and ionized, and titanium is targeted to form a lower layer mainly made of titanium, and a second intermediate layer forming step wherein tungsten is targeted to form an upper layer mainly made of tungsten.

The step of forming an intermediate layer may consist of:

a first intermediate layer forming step wherein argon is introduced into the vacuum chamber and ionized, and titanium is targeted to form a lower layer mainly made of titanium, and a second intermediate layer forming step wherein a gas containing carbon is introduced into the vacuum chamber and tungsten or silicon is targeted to form an upper layer mainly made of tungsten carbide or silicon carbide.

The other process for producing a substrate having a hard decorative coating film according to the invention comprises:

a heating step wherein a substrate comprising titanium or a titanium alloy is placed in a vacuum chamber and annealed, a hardening treatment step wherein a mixed gas containing nitrogen as a main component and a slight amount of an oxygen component is introduced into the vacuum chamber, and the vacuum chamber is heated at a temperature of 700 to 800° C. for a given period of time under given reduced pressure to diffuse nitrogen and oxygen inside the titanium or titanium alloy substrate from the surface so as to form a solid solution, a cooling step wherein the titanium or titanium alloy substrate is cooled to room temperature, a polishing step wherein the substrate surface is polished, a washing step wherein the substrate is washed, an evacuation step wherein the substrate is set in a vacuum chamber and the vacuum chamber is evacuated, an ion bombardment step wherein argon is introduced into the vacuum chamber and ionized to ion bombard the substrate surface, and a step wherein a hard decorative coating film comprising a nitride, a carbide, an oxide, a nitrido-carbide or a nitrido-carbido-oxide of a 4a, 5a or 6a Group element of the periodic table is formed on the substrate surface by ion plating or sputtering.

In this process, the step of forming a hard decorative coating film is preferably followed by a step wherein a gold or gold alloy coating film is formed on the surface of the hard decorative coating film by ion plating or sputtering.

The cutlery according to the invention is cutlery (metallic Western-style tableware), such as a spoon, a fork or a knife, which comprises a working part (cutlery body) and a grip and in which the grip is provided with a floating means.

As the floating means, formation of a hollow part in the grip is adoptable.

The hollow part formed in the grip may be filled with a member having a specific gravity of less than 1. As the member filled in the hollow part formed in the grip, a foamed product is employable.

The other cutlery according to the invention is cutlery (metallic Western-style tableware), such as a spoon, a fork or a knife, which comprises a working part (cutlery body) and a grip, wherein the cutlery body comprises a titanium material, the grip comprises a thermoplastic resin having a hollow part, and the working part is an integrally constituted part formed by insert molding using the thermoplastic resin.

DETAILED DESCRIPTION OF THE INVENTION

Tableware and Process for Surface Treatment Thereof

The tableware according to the invention and the process for surface treatment thereof are described with reference to the following embodiments.

First Embodiment

The first embodiment of the invention is described with reference to FIG. 1, FIG. 2, FIG. 3 and FIG. 4.

Figure 2:
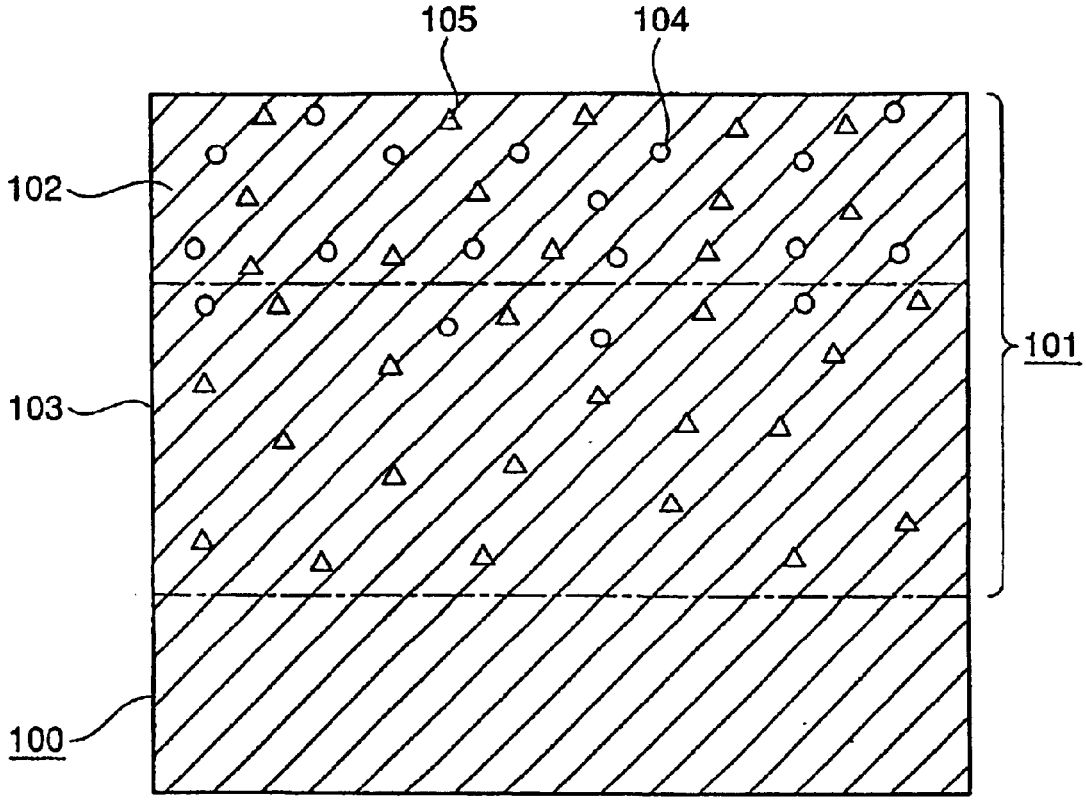
FIG. 2 is a schematic view showing a structure of titanium or titanium alloy tableware in the first and the second embodiments of the tableware according to the invention and the process for surface treatment thereof.

As shown in FIG. 2, on a surface of titanium or titanium alloy tableware (referred to as "titanium tableware" hereinafter) 100, a surface hardened layer 101 is formed. The surface hardened layer 101 is spread to a depth of about 20 $\mu$m from the surface. The surface hardened layer 101 is divided into a first hardened layer 102 in which nitrogen 104 and oxygen 105 are diffused so as to form a solid solution and a second hardened layer 103 in which oxygen 105 is diffused so as to form a solid solution. The first hardened layer 102 is observed to extend to the region of a depth of about 1 μm from the surface, and in the region deeper than this, the second hardened layer 103 is present. The first hardened layer 102 in which nitrogen 104 and oxygen 105 are diffused so as to form a solid solution has a particularly high hardness and has a function of preventing marring of the member surface. The second hardened layer 103 spreads its hardened range to the deep portion of the member and has a function of enhancing impact resistance.

By forming the surface hardened layer consisting of the first hardened layer in which nitrogen and oxygen are diffused so as to form a solid solution and the second hardened layer in which oxygen is diffused so as to form a solid solution on the surface of titanium tableware as described above, it becomes feasible that the titanium tableware is free from surface roughening and has excellent appearance quality and sufficient hardness.

In the first hardened layer, the amount of nitrogen capable of being diffused so as to form a solid solution was in the range of 0.6 to 8.0% by weight, and the amount of oxygen capable of being diffused so as to form a solid solution was in the range of 1.0 to 14.0 by weight. In the second hardened layer, the amount of oxygen capable of being diffused so as to form a solid solution was in the range of 0.5 to 14.0% by weight. Consequently, the amount of nitrogen and oxygen diffused so as to form a solid solution is preferably as large as possible within the above-mentioned range. From the viewpoint of retention of excellent appearance quality of the tableware, however, the concentration of nitrogen or oxygen diffused so as to form a solid solution should be selected from such a range that no surface roughening is brought about.

The first hardened layer diffusing nitrogen and oxygen so as to form a solid solution is preferably formed from the member surface to a depth of about 1.0 μm. By forming the first hardened layer in this depth, surface roughening due to growing of crystal grains can be inhibited and sufficient hardness can be obtained.

On the other hand, the second hardened layer diffusing oxygen so as to form a solid solution is preferably formed in the region deeper than the first hardened layer and to a depth of about 20 μm. By forming the second hardened layer in this depth, the surface hardness can be further increased.

Next, a scheme of a surface treatment device used in this embodiment is described.

Figure 3:
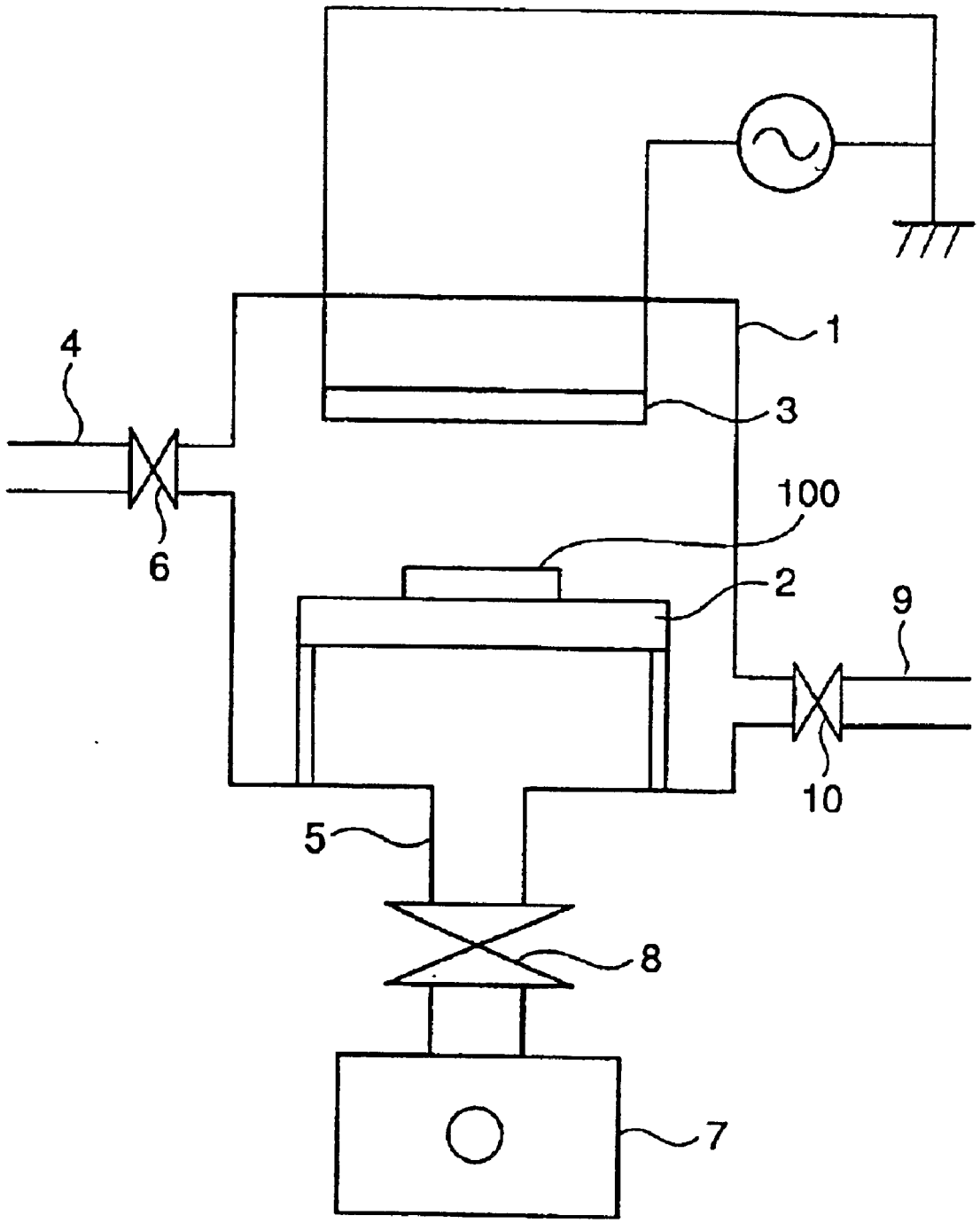
FIG. 3 is a schematic view showing a scheme of a surface treatment device used in the embodiments of the tableware according to the invention and the process for surface treatment thereof.

The surface treatment device shown in FIG. 3 includes a vacuum chamber 1 at the center. In the vacuum chamber 1, a tray 2 for placing thereon titanium tableware 100 and a heater 3 as a heating means are arranged To the vacuum chamber 1, a gas feed pipe 4 and a gas exhaust pipe 5 are connected. The gas feed pipe 4 is connected to a gas supply source (not shown). At the midpoint of the gas feed pipe 4, a gas feed valve 6 is provided, and by the open-close operation of the gas feed valve 6, a necessary gas can be fed to the vacuum chamber 1. On the other hand, the gas exhaust pipe 5 is connected to a vacuum pump 7, and by the suction force of the vacuum pump 7, the gas in the vacuum chamber 1 can be sucked and exhausted. At the midpoint of the gas exhaust pipe 5, an electromagnetic valve 8 to control execution/stopping of the vacuum suction is provided. To the vacuum chamber 1, an atmosphere release pipe 9 is further connected, and by opening a vent valve 10 provided at the midpoint of the atmosphere release pipe 9, the pressure in the vacuum chamber 1 can be adjusted to an atmospheric pressure.

Next, the process for surface treatment of tableware according to the invention is described.

The process for surface treatment of tableware in this embodiment comprises the following steps:

(1) a heating step wherein titanium tableware 100 is placed in a vacuum chamber and heated to anneal the tableware, (2) a hardening treatment step wherein a mixed gas containing nitrogen as a main component and a slight amount of an oxygen component is introduced into the vacuum chamber after the heating step, and the vacuum chamber 1 is heated at a temperature of 700 to 800° C. for a given period of time under given reduced pressure to diffuse nitrogen and oxygen inside the titanium tableware 100 from the surface so as to form a solid solution, and (3) a cooling step wherein the titanium tableware 100 is cooled down to room temperature after the hardening treatment step.

The heating step is a step wherein the tableware 100 is heated and annealed for the purpose of relaxing a working strain layer formed on the titanium tableware 100 by hot forging working or the subsequent polishing working.

The working strain layer formed by the polishing working is a layer in which stress due to the polishing working remains as lattice strain, and this layer is in an amorphous phase or in a low-crystalline state. If the titanium tableware 100 after the polishing working is subjected to the hardening treatment step without conducting the heating for annealing, diffusion of nitrogen and oxygen so as to form a solid solution are promoted in the hardening step with relaxing the working strain layer.

As a result, the reaction of nitrogen and oxygen on the surface of the titanium tableware 100 is enhanced to decrease the amount of nitrogen and oxygen diffused so as to form a solid solution inside the tableware, and besides a nitride and an oxide which are colored substances are formed in the vicinity of the surface.

Formation of the colored substances is unfavorable because the appearance quality is lowered. In this embodiment, therefore, the heating step is operated prior to the hardening treatment step to previously remove the working strain and to promote diffusion of nitrogen and oxygen so as to form a solid solution thereof in the hardening treatment step. In the heating step, it is preferable that the vacuum chamber is evacuated and heating is carried out under reduced pressure, or it is preferable that the vacuum chamber is evacuated, then an inert gas is introduced into the vacuum chamber, and heating is conducted under reduced pressure. When the heating step performed in such an atmosphere, reaction of the titanium tableware with impurities other than nitrogen and the oxygen component (introduced in the hardening treatment step) can be prevented.

In the subsequent hardening treatment step, a mixed gas containing nitrogen as a main component and a slight amount of an oxygen component is introduced into the vacuum chamber to diffuse nitrogen and oxygen inside the titanium tableware 100 from the surface so as to form a solid solution. By the hardening treatment step, not only the first hardened layer in which nitrogen and oxygen are diffused so as to form a solid solution is formed in the vicinity of the surface of the titanium tableware but also the second hardened layer in which oxygen is diffused so as to form a solid solution is formed in the depthwise direction of the tableware 100.

As the oxygen component contained in a slight amount in the mixed gas, various gases containing oxygen are employable Examples of the oxygen components include an oxygen gas, a hydrogen gas, water vapor, ethyl alcohol and methyl alcohol. Further, a carbon dioxide gas or a carbon monoxide gas may be contained together with water vapor.

In the hardening treatment step, nitrogen and a slight amount of the oxygen component must be diffused inside the titanium tableware 100 so as to form a solid solution, without forming a compound by the reaction of nitrogen and the oxygen component with the titanium tableware 100. For this purpose, the treating temperature in this step is important.

To determine the optimum treating temperature, a surface treatment based on the process for surface treatment of tableware according to the invention was carried out. In this surface treatment, titanium of the second kind defined by JIS, with a mirror surface appearance was used as a member to be treated, and the treating temperature was changed in the range of 630 to 830° C.

As the mixed gas containing nitrogen as a main component and a slight amount of an oxygen component, a mixed gas obtained by adding 2000 ppm (0.2%) of oxygen and 4000 ppm (0.4%) of hydrogen to 99.4% of nitrogen was used The interior of the vacuum chamber was set under reduced pressure, and heating was carried out for 5 hours.

The member having been subjected to hardening was measured on the Vickers hardness (load of 100 g). The results are shown in FIG. 1.

Figure 1:
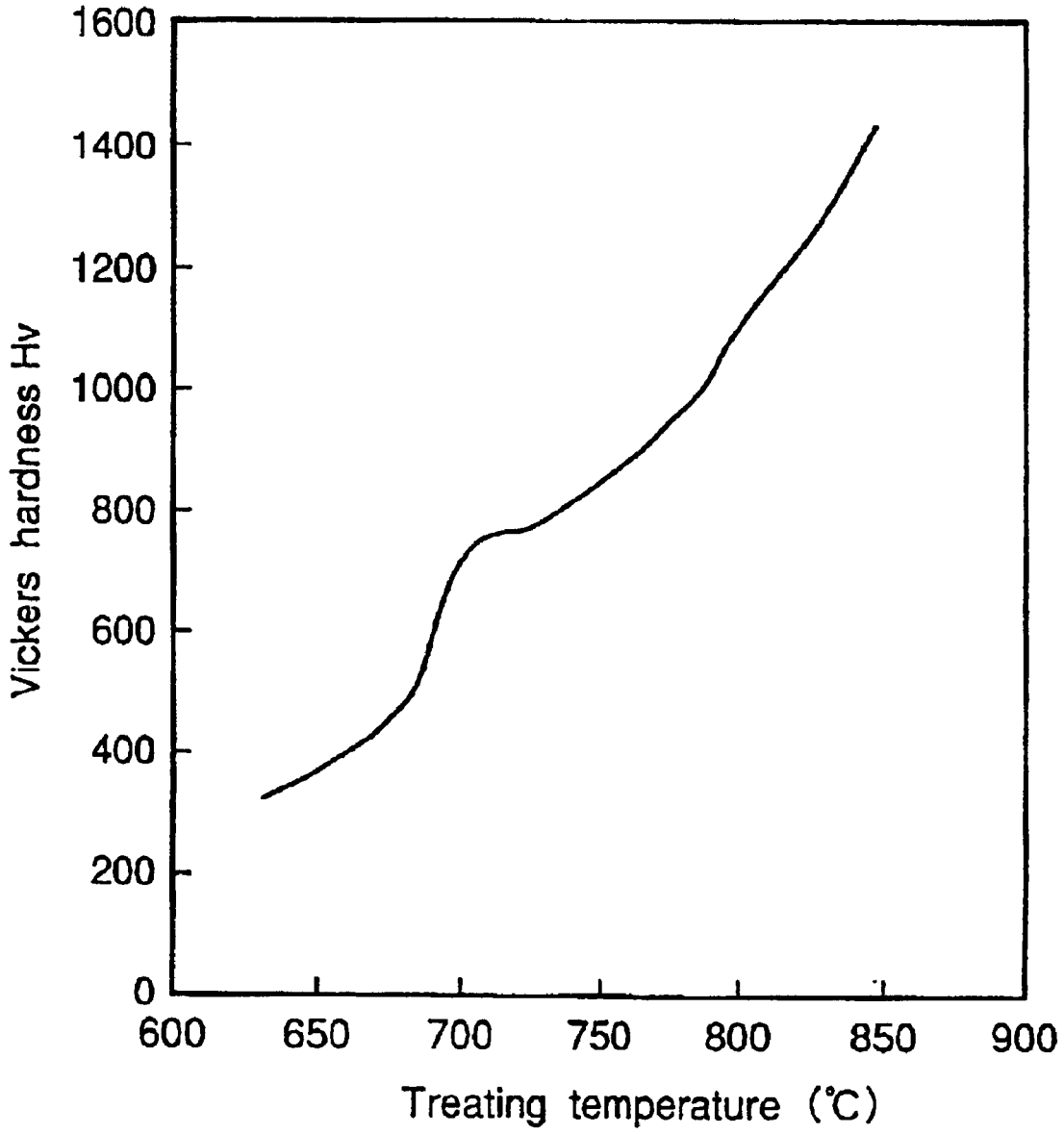
FIG. 1 is a graph showing results of the measurements of Vickers hardness versus treating temperature of a member having been surface hardened by the process for surface treatment of tableware according to the invention.

As is apparent from FIG. 1, when the treating temperature was lower than 700° C., the Vickers hardness Hv became not more than 750, and sufficient hardening treatment was not attained. This results from the observation that nitrogen and oxygen are not sufficiently diffused so as to form a solid solution at a treating temperature of lower than 700° C., the first and the second hardened layers being not properly formed. When the treating temperature is higher than 800° C., the rates of diffusion of nitrogen and oxygen so as to form a solid solution are high and a hardened layer reaching the deeper region is obtained. Consequently, the Vickers hardness Hv became not less than 1100.

However, it has been found that if the treating temperature exceeds 800° C., the crystal grains of the member become large and surface roughening takes place. Therefore, in case of the treating temperature above 800° C., the appearance quality of the tableware cannot be kept good. In this case, because of surface roughening occurrence, surface polishing is required in the later step.

In view of the above results, the hardening treatment step was carried out within the temperature range of 700 to 800° C. Although the concentration of the oxygen component in the mixed gas containing nitrogen as a main component is arbitrary, it is adjusted to be in the range of preferably 100 to 30000 ppm. If the concentration of the oxygen component is lower than 100 ppm (0.01%), oxygen is not diffused so as to form a solid solution sufficiently. If the concentration of the oxygen component exceeds 30000 ppm (3%), an oxide layer is liable to be formed on the surface of the titanium tableware to cause surface roughening.

Although the degree of reduced pressure in the hardening treatment step is arbitrary, the pressure in the vacuum chamber is adjusted to be in the range of preferably 0.01 to 10 Torr. As the oxygen component contained in a slight amount in the mixed gas for use in the hardening treatment step, various gases containing oxygen are employable. Examples of the oxygen components include an oxygen gas, a hydrogen gas, water vapor, and alcohol gases such as ethyl alcohol and methyl alcohol. Further, a carbon dioxide gas or a carbon monoxide gas may be contained together with water vapor.

Next, the cooling step is described.

The purpose of the cooling step is to rapidly cool the titanium tableware 100, which has been completely hardening-treated, to room temperature. It is preferable that the cooling step is not performed in the same gas atmosphere as in the hardening treatment step. Otherwise a nitride or an oxide is liable to be formed on the surface of the titanium tableware 100 to deteriorate the appearance quality.

Accordingly, the cooling step is preferably conducted in an atmosphere of an inert gas such as argon or helium. That is, in the cooling step, it is preferable that the vacuum chamber is highly evacuated to remove the mixed gas containing nitrogen as a main component and a slight amount of an oxygen component, then an inert gas is introduced into the vacuum chamber, and the tableware is cooled to room temperature under reduced pressure. The cooling step may be carried out under vacuum.

Specific treating conditions of the process for surface treatment in this embodiment are described below.

First, titanium of the second kind defined by JIS was subjected to hot forging, cold forging or a combination thereof to prepare titanium tableware of desired shape as the titanium tableware (member to be treated). When it is difficult to obtain the titanium tableware 100 of desired shape by forging, the tableware may be subjected to cutting.

Subsequently, the tableware 100 was polished with a buff to mirror finish the surface of the tableware.

Then, the tableware 100 was subjected to surface hardening treatment using the surface treatment device shown in FIG. 3.

First, the interior of the vacuum chamber 1 of the surface treatment device is highly evacuated through the gas exhaust pipe 5 to a pressure of not more than $1\times10^{-5}$ Torr at which the influence of the residual gas atmosphere is eliminated, and then the titanium tableware 100 is heated at a temperature of 650 to 830° C. by the heater 3. This heating is kept for 30 minutes to anneal the tableware 100 (heating step).

Then, a mixed gas obtained by adding 5000 ppm (0.5%) of oxygen to 99.5% of nitrogen is fed as a reaction gas through the gas feed pipe 4. The internal pressure of the vacuum chamber 1 is adjusted to 0.2 Torr, and the tableware is heated for 5 hours with maintaining almost the same temperature (650 to 830° C.) as in the annealing.

Through the hardening treatment step, nitrogen 104 and oxygen 105 are adsorbed onto the surface of the titanium tableware 100, diffused inside the tableware 100 from the surface so as to form a solid solution, whereby a surface hardened layer 101 consisting of the first hardened layer 102 and the second hardened layer 103 is formed (see FIG. 2) (hardening treatment step).

Thereafter, feeding of the mixed gas was stopped, and the tableware was cooled to room temperature with performing the evacuation (cooling step).

Figure 13:
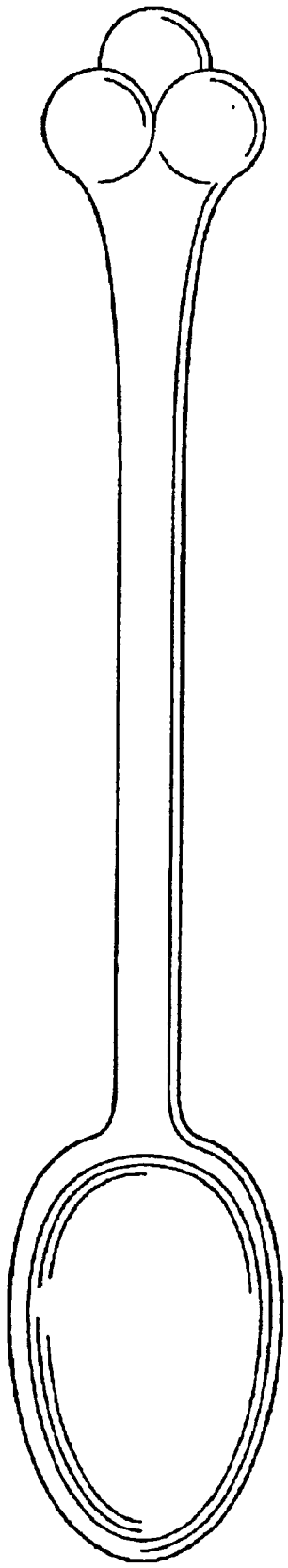
FIG. 13 is an example of titanium or titanium alloy tableware in the first embodiment of the tableware according to the invention and the process for surface treatment thereof.

In this embodiment, a spoon having a mirror surface appearance and made of titanium of the second kind defined by JIS, that is shown in FIG. 13, was used as the titanium tableware (member to be treated). The heating step and the hardening treatment step were carried out with variously changing the treating temperature within the temperature range of 650 to 830° C. Thereafter, hardness, diffusion depth and concentration of nitrogen and oxygen, surface roughening, and size of crystal grain in the surface structure were measured and evaluated.

The hardness was measured by a Vickers hardness meter (load of 100 g), and tableware having a Vickers hardness Hv of not less than 750 at a depth of 1.0 $\mu$m from the surface was taken as pass.

The diffusion depth and concentration of nitrogen and oxygen were measured by a secondary ion mass spectrometer (SIMS).

The surface roughening was evaluated by measuring an average surface roughness Ra by a surface roughness meter, and tableware having an average surface roughness Ra of not more than 0.4 μm was taken as pass.

The size Rc of a crystal grain was measured by observing crystal structure of the surface with an electron microscope, and tableware having a crystal grain size of 20 to 65 μm was taken as pass.

The results are set forth in Table 1.

TABLE 1

| No. | Treating temperature (° C.) | Hardness at a depth of 1.0 μm from the surface (Hv) | Nitrogen concentration at a depth of 1.0 μm from the surface (wt %) | Oxygen concentration at a depth of 1.0 μm from the surface (wt %) | Oxygen concentration at a depth of 20 μm from the surface (wt %) | Average surface Roughness Ra after treatment (μm) | Crystal Grain size Rc after treatment (μm) | Evaluation result |
|---|---|---|---|---|---|---|---|---|
| S 1 | 650 | 380 | 0.05 | 2.0 | 0.01 | 0.2 | 20~50 | fall |
| S 2 | 730 | 820 | 0.8 | 2.6 | 0.7 | 0.25 | 30~60 | pass |
| S 3 | 780 | 935 | 1.6 | 1.7 | 1.0 | 0.3 | 30~60 | pass |
| S 4 | 830 | 1320 | 2.1 | 2.2 | 1.5 | 1.0 | 80~200 | fall |
| S c | untreated | 180 | — | — | — | 0.2 | 20~50 | — |

In Table 1, the sample numbers S1 to S4 are spoons (titanium tableware) obtained by changing the treating temperature in the heating step and the hardening treatment step. The sample number Sc is untreated pure titanium tableware (spoon).

As shown in Table 1, after the surface treatment, the sample number S1 (treating temperature: 650° C.) had an average surface roughness Ra and a crystal grain size Rc equivalent to those of the untreated pure titanium tableware (sample number Sc) and retained good appearance quality. However, it showed a low Vickers hardness Hv of 380 at a depth of 1.0 μm from the surface. The nitrogen content in the same depth portion of this sample was measured and found to be 0.05% by weight, which indicated that nitrogen was rarely contained. That is, it can be seen that the first hardened layer 102 shown in FIG. 2 was not formed. The oxygen content in the 20 μm depth portion from the surface was 0.01% by weight, showing that the second hardened layer 103 was not formed either.

Although the sample number S4 (treating temperature: 830° C.) had a high Vickers hardness Hv of 1320 at a depth of 1.0 μm from the surface, it had a large average surface roughness Ra of 1.0 μm and a large grain size Rc of 80 to 200 μm, and marked surface roughening was observed. This surface roughening deviates from the tolerance in the use of titanium tableware.

In contrast, the sample numbers S2 and S3 had a sufficiently high Vickers hardness Hv of 820 to 935 at a depth of 1.0 μm from the surface, an average surface roughness Ra of 0.25 to 0.3 μm and a crystal grain size Rc of 30 to 60 μm, retaining good appearance quality equivalent to that of the untreated pure titanium tableware (sample number Sc).

Figure 4:
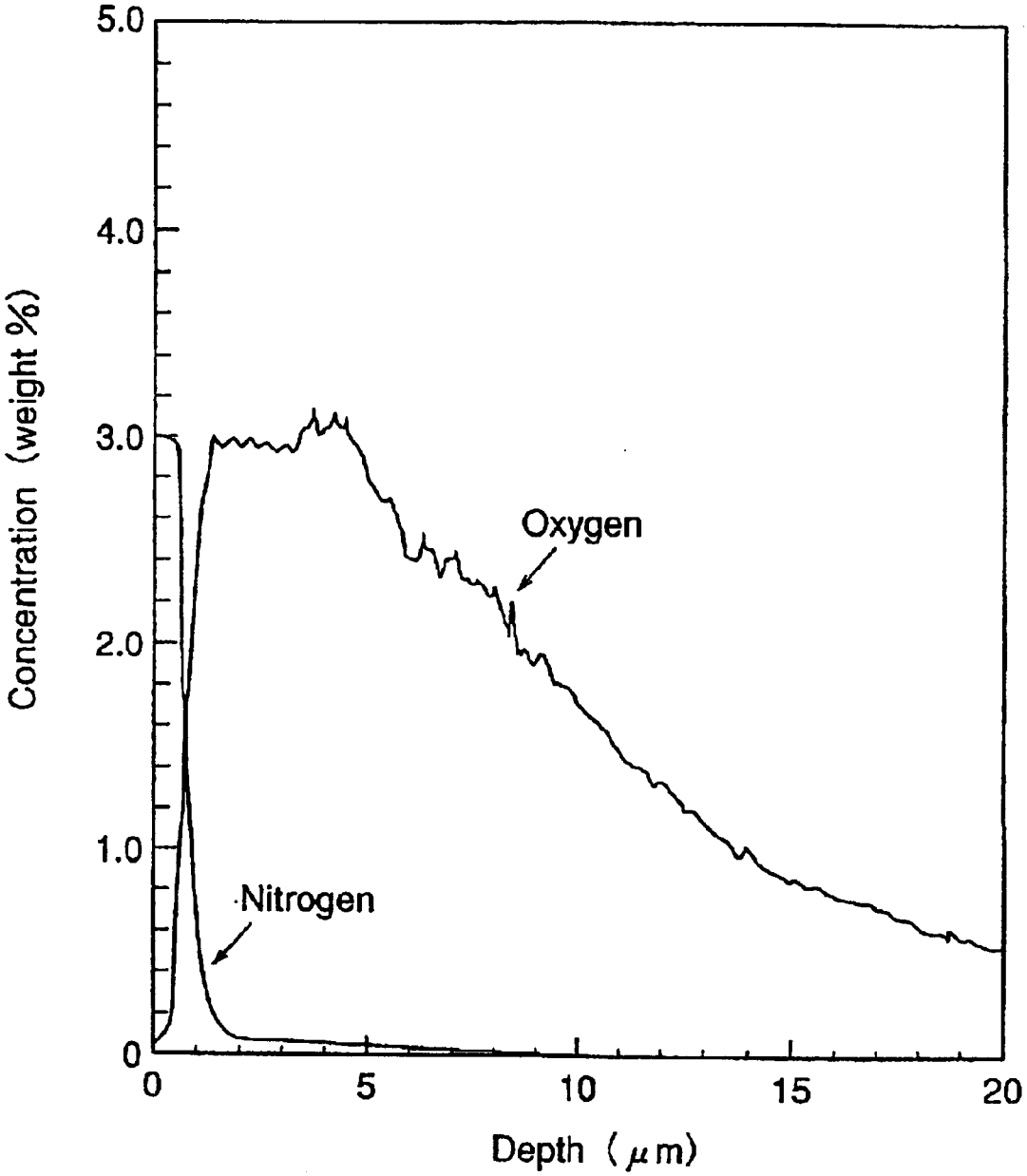
FIG. 4 is a graph showing results of the measurements of a nitrogen content and an oxygen content to a depth from the surface of titanium or titanium alloy tableware in the first embodiment of the tableware according to the invention and the process for surface treatment thereof.

In the sample numbers S2 and S3, the nitrogen content and the oxygen content in the 1.0 μm depth portion from the surface were 0.6 to 8.0% by weight (specifically 0.8 to 1.6% by weight) and 1.0 to 14.0% by weight (specifically 1.7 to 2.6% by weight), respectively, indicating that the first hardened layer 102 shown in FIG. 2 was formed. Further, the oxygen content in the 20 μm depth portion from the surface was 0.5 to 14.0% by weight (specifically 0.7 to 1.0% by weight), indicating that the second hardened layer 103 shown in FIG. 2 was also formed. FIG. 4 is a view showing results of measurements of the nitrogen content and the oxygen content to the depth from the surface. As the measuring object, the titanium tableware of the sample number S2 was used.

As is apparent from this figure, in the titanium tableware of the sample number S2 having been subjected to the surface hardening shown in Table 1, large amounts of nitrogen and oxygen were diffused so as to form a solid solution in the region of a depth up to 1 μm from the surface. In the deeper region, larger amounts of oxygen were diffused so as to form a solid solution. Thus, titanium tableware having a surface hardened layer could be obtained. The titanium tableware of the sample numbers S2 and S3 retained mirror surface quality equivalent to that of the titanium tableware prior to the surface hardening treatment.

Then, the titanium tableware having the surface hardened layer was polished by barrel polishing. The polishing method is described below.

First, the tableware is placed in a barrel of a centrifugal barrel polishing machine.

Then, in the barrel are placed walnut chips and an alumina-based abrasive as abrasive media, and barrel polishing is carried out over a period of about 10 hours to remove a part of the hard layer formed on the surface of the titanium tableware, said part ranging from the surface to a depth of 0.7 μm.

By the above operation, fine irregularities on the surface of the tableware were removed to make the surface of the tableware more even. Thus, titanium tableware with a mirror surface emitting uniform silver gloss was obtained. Since the mirror surface appearance of the tableware is improved and the decorative value thereof is enhanced as described above, the barrel polishing is important.

Although the barrel polishing was used in the above embodiment, other mechanical polishing means publicly known such as buff polishing and a combination of barrel polishing and buff polishing are also employable.

If the surface of the first hardened layer is polished too much, the region having low contents of nitrogen and oxygen, particularly the region having a low content of nitrogen, comes to expose outside. That is, as the polishing is conducted more deeply, the region having lower hardness is exposed, and hence the surface hardness of the tableware is lowered. On the contrary, if the depth to be polished is too small, a beautiful mirror surface cannot be obtained. Accordingly, the depth to be polished is in the range of 0.1 to 3.0 μm, preferably 0.2 to 2.0 μm, more preferably 0.5 to 1.0 μm, from the surface of the first hardened layer. When the depth to be polished is set in the above range, the surface hardness of the tableware can be kept high enough for the practical use and a smooth mirror surface can be obtained. Specifically, the tableware after the polishing needs only have a Vickers hardness of 500 to 800 Hv under a load of 100 g.

In the above-mentioned surface hardening treatment, the treating time is shorter and the productivity is higher than those in the conventional hardening such as ion implantation, ion nitridation or carburizing. Moreover, since the titanium tableware having been subjected to the surface hardening has a hardened layer reaching a depth of 20 μm from the surface, the tableware is not marred even if it is used for a long period of time. Especially in the application to a knife shown in FIG. 15, the knife edge hardly becomes dull, and hence the cutting quality is not deteriorated. Also about the tip of a fork shown in FIG. 14, the same effects are exerted. As described above, a mirror surface of uniform gloss can be obtained by the barrel polishing, so that the decorative value can be further increased.

Then, as the reaction gas containing nitrogen as the main component and a slight amount of an oxygen component to be introduced into the vacuum chamber 1 in the hardening treatment step, the following mixed gases were each used, and equivalent results were obtained. The results are described below.

First, a mixed gas obtained by adding 3000 ppm (0.3%) of water vapor to 99.7% of nitrogen was used as the mixed gas. The results are set forth in Table 2.

TABLE 2

| No. | Treating temperature (° C.) | Hardness at a depth of 1.0 μm (Hv) | Nitrogen concentration at a depth of 1.0 μm from the surface (wt %) | Oxygen concentration at a depth of 1.0 μm from the surface (wt %) | Oxygen concentration at a depth of 20 μm from the surface (wt %) | Average surface roughness Ra after treatment (μm) | Crystal grain size Rc after treatment (μm) | Evaluation result |
|---|---|---|---|---|---|---|---|---|
| S 5 | 650 | 405 | 0.06 | 1.9 | 0.01 | 0.2 | 20~50 | fall |
| S 6 | 730 | 840 | 0.9 | 2.5 | 0.8 | 0.25 | 30~60 | pass |
| S 7 | 780 | 940 | 1.6 | 2.0 | 1.2 | 0.3 | 30~60 | pass |
| S 8 | 830 | 1400 | 2.4 | 2.0 | 1.4 | 1.2 | 80~250 | fall |
| S c | untreated | 180 | — | — | — | 0.2 | 20~50 | — |

In Table 2, the sample numbers S5 to S8 are titanium tableware obtained by changing the treating temperature in the heating step and the hardening treatment step.

As shown in Table 2, after the surface treatment, the sample number S5 (treating temperature: 650° C.) had an average surface roughness Ra and a crystal grain size Rc equivalent to those of the untreated pure titanium tableware (sample number Sc) and retained good appearance quality. However, it showed a low Vickers hardness Hv of 405 at a depth of 1.0 μm from the surface. The nitrogen content in the same depth portion of this sample was measured, and found to be 0.06% by weight, which indicated that nitrogen was rarely contained. That is, it can be seen that the first hardened layer 102 shown in FIG. 2 was not formed. The oxygen content in the 20 μm depth portion from the surface was 0.01% by weight, showing that the second hardened layer 103 was not formed either.

Although the sample number S8 (treating temperature: 830° C.) had a high Vickers hardness Hv of 1400 at a depth of 1.0 μm from the surf ace, it had a large average surface roughness Ra of 1.2 μm and a large grain size Rc of 80 to 250 μm, and marked surface roughening was observed. This surface roughening deviates from the tolerance in the use of the titanium tableware as a decorative article.

In contrast, the sample numbers S6 and S7 had a sufficiently high Vickers hardness Hv of 820 to 940 at a depth of 1.0 μm from the surface, an average surface roughness Ra of 0.25 to 0.3 μm and a crystal grain size Rc of 30 to 60 μm, retaining good appearance quality equivalent to that of the untreated pure titanium tableware (sample number Sc).

Figure 5:
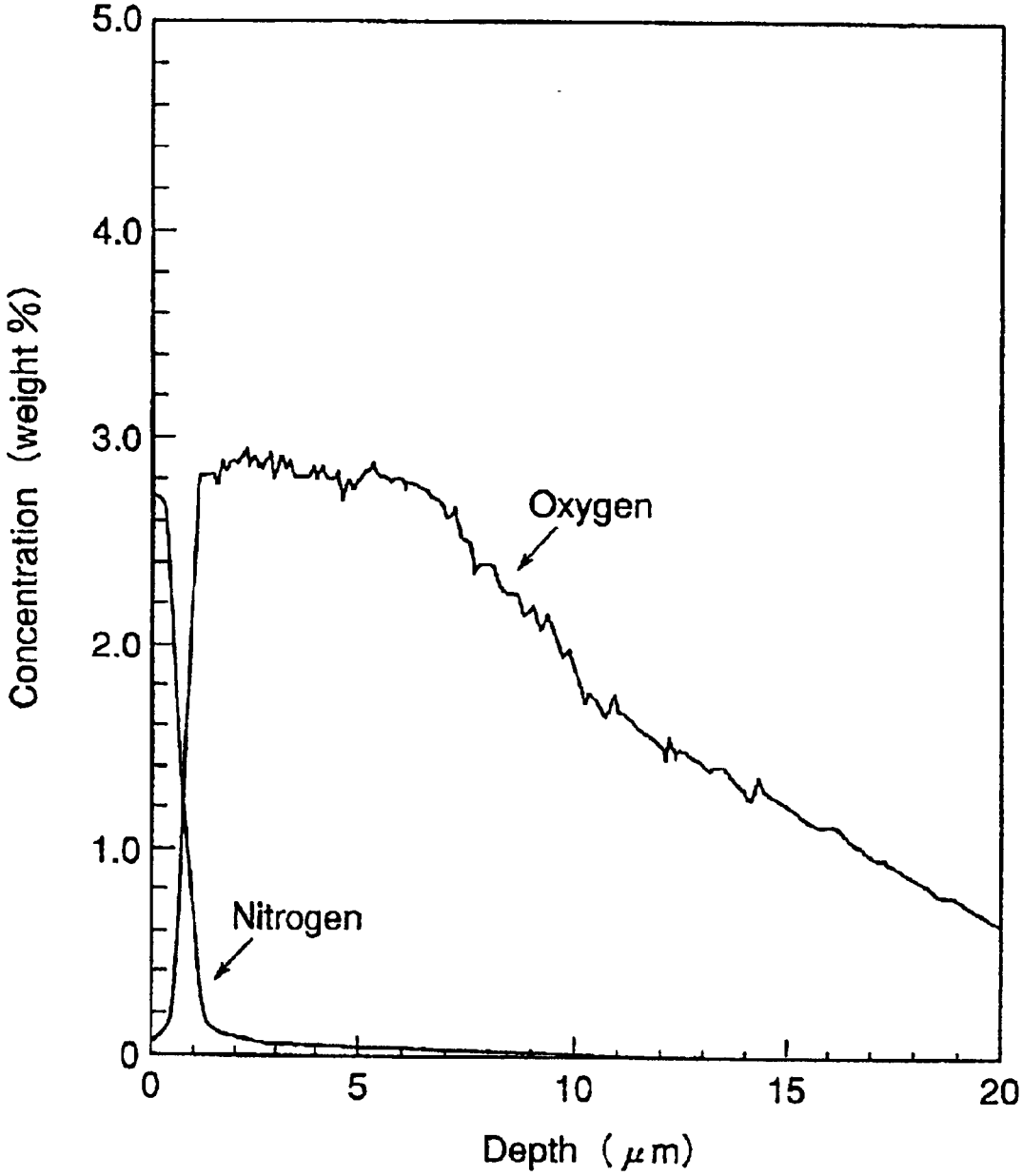
FIG. 5 is a graph showing results of the measurements of a nitrogen content and an oxygen content to a depth from the surface of titanium or titanium alloy tableware in the second embodiment of the tableware according to the invention and the process for surface treatment thereof.

In the sample numbers S6 and S7, the nitrogen content and the oxygen content in the 1.0 μm depth portion from the surface were 0.6 to 8.0% by weight (specifically 0.9 to 1.6% by weight) and 1.0 to 14.0% by weight (specifically 2.0 to 2.5% by weight), respectively, indicating that the first hardened layer 102 shown in FIG. 2 was formed. Further, the oxygen content in the 20 μm depth portion from the surface was 0.5 to 14.0% by weight (specifically 0.8 to 1.2% by weight), indicating that the second hardened layer 103 shown in FIG. 2 was also formed. FIG. 5 is a view showing results of measurements of the nitrogen content and the oxygen content to the depth from the surface. As the measuring object, the titanium tableware of a sample number S6 was used. As is apparent from this figure, in the titanium tableware of the sample number S6 having been subjected to the surface hardening shown in Table 2, large amounts of nitrogen and oxygen were diffused so as to form a solid solution in the region of a depth up to 1 μm from the surface. In the deeper region, larger amounts of oxygen were diffused so as to form a solid solution.

Then, a mixed gas obtained by adding 2000 ppm (0.2%) of oxygen and 4000 ppm (0.4%) of hydrogen to 99.4%of nitrogen was used as the mixed gas. The results are set forth in Table 3.

TABLE 3

| No. | Treating temperature (° C.) | Hardness at a depth of 1.0 μm from the surface (Hv) | Average surface roughness Ra after treatment (μm) | Crystal grain size Rc after treatment (μm) | Evaluation result |
|---|---|---|---|---|---|
| S 9 | 650 | 370 | 0.2 | 20~50 | fall |
| S 10 | 730 | 810 | 0.25 | 30~60 | pass |
| S 11 | 780 | 920 | 0.3 | 30~60 | pass |
| S 12 | 830 | 1300 | 1.1 | 80~200 | pass |
| S c | untreated | 180 | 0.2 | 20~50 | — |

In Table 3, the sample numbers S9 to S12 are titanium tableware obtained by changing the treating temperature in the heating step and the hardening treatment step.

As shown in Table 3, after the surface treatment, the sample number S9 (treating temperature: 650° C.) had an average surface roughness Ra and a crystal grain size Rc equivalent to those of the untreated pure titanium tableware (sample number Sc) and retained good appearance quality. However, it showed a low Vickers hardness Hv of 370 at a depth of 1.0 μm from the surface. Although the sample number S12 (treating temperature: 830° C.) had a high Vickers hardness Hv of 1300 at a depth of 1.0 μm from the surface, it had a large average surface roughness Ra of 1.1 μm and a large grain size Rc of 80 to 200 μm, and marked surface roughening was observed. This surface roughening deviates from the tolerance in the use of the titanium tableware as a decorative article.

In contrast, the sample numbers S10 and S11 had a sufficiently high Vickers hardness Hv of 810 to 920 at a depth of 1.0 μm from the surface, an average surface roughness Ra of 0.25 to 0.3 μm and a crystal grain size Rc of 30 to 60 μm, retaining good appearance quality equivalent to that of the untreated pure titanium tableware (sample number Sc).

In the sample numbers S11 and S12, the nitrogen content and the oxygen content in the 1.0 μm depth portion from the surface were 0.6 to 8.0% by weight and 1.0 to 14.0% by weight, respectively, similarly to the titanium tableware of the sample numbers S2 and S3 in Table 1. Presumably, the first hardened layer 102 shown in FIG. 2 has been formed. Since the oxygen content in the 20 μm depth portion from the surface was 0.5 to 14.0% by weight, presumably the second hardened layer 103 shown in FIG. 2 has been also formed Then, a mixed gas obtained by adding 2500 ppm (0.25%) of water vapor and 500 ppm (0.05%) of carbon dioxide to 99.7% of nitrogen was used as the mixed gas. The results are set forth in Table 4.

TABLE 4

| No. | Treating temperature (° C.) | Hardness at a depth of 1.0 μm from the surface (Hv) | Average surface roughness Ra after treatment (μm) | Crystal grain size Rc after treatment (μm) | Evaluation result |
|---|---|---|---|---|---|
| S 13 | 650 | 340 | 0.2 | 20~50 | fall |
| S 14 | 730 | 800 | 0.25 | 30~60 | pass |
| S 15 | 780 | 850 | 0.3 | 30~60 | pass |
| S 16 | 830 | 1240 | 1.0 | 80~200 | fall |
| S c | untreated | 180 | 0.2 | 20~50 | — |

In Table 4, the sample numbers S13 to S16 are titanium tableware obtained by changing the treating temperature in the heating step and the hardening treatment step.

As shown in Table 4, after the surface treatment, the sample number S13 (treating temperature: 650° C.) had an average surface roughness Ra and a crystal grain size Rc equivalent to those of the untreated pure titanium tableware (sample number Sc) and retained good appearance quality. However, it showed a low Vickers hardness Hv of 340 at a depth of 1.0 μm from the surface. Although the sample number S16 (treating temperature: 830° C.) had a high Vickers hardness Hv of 1240 at a depth of 1.0 μm from the surface, it had a large average surface roughness Ra of 1.0 μm and a large grain size Rc of 80 to 200 μm, and marked surface roughening was observed. This surface roughening deviates from the tolerance in the use of the titanium tableware as a decorative article.

In contrast, the sample numbers S14 and S15 had a sufficiently high Vickers hardness Hv of 800 to 850 at a depth of 1.0 μm from the surface, an average surface roughness Ra of 0.25 to 0.3 μm and a crystal grain size Rc of 30 to 60 μm, retaining good appearance quality equivalent to that of the untreated pure titanium tableware (sample number Sc).

In the sample numbers S14 and S15, the nitrogen content and the oxygen content in the 1.0 μm depth portion from the surface were 0.6 to 8.0% by weight and 1.0 to 14.0% by weight, respectively, similarly to the titanium tableware of the sample numbers S2 and S3 in Table 1. Presumably the first hardened layer 102 shown in FIG. 2 has been formed. Since the oxygen content in the 20 μm depth portion from the surface was 0.5 to 14.0% by weight, presumably the second hardened layer 103 shown in FIG. 2 has been also formed.

Then, a mixed gas obtained by adding 7000 ppm (0.3%) of an ethyl alcohol gas to 99.3% of nitrogen was used as the mixed gas. The results are set forth in Table 5.

TABLE 5

| No. | Treating temperature (° C.) | Hardness at a depth of 1.0 μm from the surface (Hv) | Average surface roughness Ra after treatment (μm) | Crystal grain size Rc after treatment (μm) | Evaluation result |
|---|---|---|---|---|---|
| S 17 | 650 | 330 | 0.2 | 20~50 | fall |
| S 18 | 730 | 780 | 0.25 | 30~55 | pass |
| S 19 | 780 | 830 | 0.3 | 30~60 | pass |
| S 20 | 830 | 1200 | 1.0 | 80~180 | fall |
| S c | untreated | 180 | 0.2 | 20~50 | — |

In Table 5, the sample numbers S17 to S20 are titanium tableware obtained by changing the treating temperature in the heating step and the hardening treatment step.

As shown in Table 5, after the surface treatment, the sample number S17 (treating temperature: 650° C.) had an average surface roughness Ra and a crystal grain size Rc equivalent to those of the untreated pure titanium tableware (sample number Sc) and retained good appearance quality. However, it showed a low Vickers hardness Hv of 330 at a depth of 1.0 μm from the surface.

Although the sample number S20 (treating temperature: 830° C.) had a high Vickers hardness Hv of 1200 at a depth of 1.0 μm from the surface, it had a large average surface roughness Ra of 1.0 μm and a large grain size Rc of 80 to 180 μm, and marked surface roughening was observed. This surface roughening deviates from the tolerance in the use of the titanium tableware as a decorative article.

In contrast, the sample numbers S18 and S19 had a sufficiently high Vickers hardness Hv of 780 to 830 at a depth of 1.0 μm from the surface, an average surface roughness Ra of 0.25 to 0.3 μm and a crystal grain size Rc of 30 to 55 μm, retaining good appearance quality equivalent to that of the untreated pure titanium tableware (sample number Sc).

In the sample numbers S18 and S19, the nitrogen content and the oxygen content in the 1.0 μm depth portion from the surface were 0.6 to 8.0% by weight and 1.0 to 14.0% by weight, respectively, similarly to the titanium tableware of the sample numbers S2 and S3 in Table 1. Presumably the first hardened layer 102 shown in FIG. 2 has been formed. Since the oxygen content in the 20 μm depth portion from the surface was 0.5 to 14.0% by weight, presumably the second hardened layer 103 shown in FIG. 2 has been also formed.

In the heating step of the above embodiment, after the high evacuation, the tableware is heated under vacuum to perform annealing. Since the atmosphere is not necessarily restricted to vacuum, the heating step may be done in an atmosphere of an inert gas such as helium or argon to which titanium or titanium alloy tableware is unreactive. Also in this case, however, the interior of the vacuum chamber is preferably under reduced pressure.

In the above embodiment, the cooling step is carried out with evacuating. Since the atmosphere is not necessarily restricted to vacuum, the cooling may be effected in an atmosphere of an inert gas such as helium or argon to which titanium tableware is unreactive. Also in this case, however, the interior of the vacuum chamber 1 is preferably under reduced pressure.

Second Embodiment

The second embodiment of the invention is described below.

The purpose and the basic action of each step in the second embodiment are the same as those in the first embodiment previously described. The second embodiment is different from the first embodiment in that the heating step and the hardening treatment step are carried out at atmospheric pressure. The second embodiment is further different from the first embodiment in that when the heating step is conducted at atmospheric pressure, an inert gas is introduced into the vacuum chamber to prevent reaction of the titanium tableware with impurity components other than nitrogen and the oxygen component, because the tableware is made of an active metal.

In the heating step of the second embodiment, it is preferable that the vacuum chamber is evacuated, then an inert gas is introduced into the vacuum chamber to adjust the pressure to atmospheric pressure, and heating is carried out at atmospheric pressure. However, it is also possible that the vacuum chamber is evacuated and heating is conducted under reduced pressure. When the heating step is performed in such an atmosphere, reaction of the titanium tableware with impurities other than nitrogen and the oxygen component (introduced in the hardening treatment step) can be prevented.

In the hardening treatment step after the heating step, the vacuum chamber is highly evacuated to remove the inert gas, subsequently a mixed gas containing nitrogen as a main component and a slight amount of an oxygen component is introduced into the vacuum chamber, the pressure in the vacuum chamber is adjusted to atmospheric pressure, and the interior of the vacuum chamber 1 is heated at a temperature of 700 to 800° C., whereby nitrogen and oxygen are diffused inside the titanium tableware from the surface so as to form a solid solution.

As the oxygen component contained in a slight amount in the mixed gas for use in the hardening treatment step, various gases containing oxygen are employable. Examples of the oxygen components include an oxygen gas, a hydrogen gas, water vapor, and alcohol gases such as ethyl alcohol and methyl alcohol. Further, a carbon dioxide gas or a carbon monoxide gas may be contained together with water vapor.

After the hardening treatment step, a cooling step to cool the titanium tableware to room temperature is carried out, and it is preferable that the cooling step is not conducted in the same gas atmosphere as in the hardening treatment step, similarly to the first embodiment. That is, in the cooling step, it is preferable that the vacuum chamber is highly evacuated to remove the mixed gas containing nitrogen as a main component and a slight amount of an oxygen component, then an inert gas is introduced into the vacuum chamber to adjust the pressure to atmospheric pressure, and the tableware is cooled to room temperature. The cooling step may be carried out under vacuum.

Specific treating conditions of the process for surface treatment in this embodiment are described below.

First, titanium of the second kind defined by JIS was subjected to hot forging, cold forging or a combination thereof to prepare titanium tableware of desired shape as the titanium tableware (member to be treated), similarly to the first embodiment.

Subsequently, the tableware 100 was polished with a buff to mirror finish the surface of the tableware.

Then, the tableware 100 was subjected to surface hardening treatment using the surface treatment device shown in FIG. 3.

First, a gas in the vacuum chamber 1 is sucked by a vacuum pump 7 through a gas exhaust pipe 5 to evacuate the vacuum chamber to a pressure of not more than $1\times10^{-2}$ Torr at which the influence of the residual gas atmosphere is eliminated, and then an electromagnetic valve 8 is closed. Subsequently, a gas feed valve 6 is opened to feed an argon gas (inert gas) to the vacuum chamber 1 through a gas feed pipe 4, and a vent valve 10 of an atmosphere release pipe 9 is opened to adjust the pressure in the vacuum chamber 1 to atmospheric pressure. In this atmosphere, the titanium tableware 100 is heated by a heater 3 at a temperature of 650 to 830° C. for 30 minutes to perform annealing (heating step).

Then, the vent valve 10 of the atmosphere release pipe 9 and the gas feed valve 6 of the gas feed pipe 4 are closed, and the electromagnetic valve 8 of the gas exhaust pipe 5 is opened to execute evacuation by the vacuum pump 7. The evacuation is continued until the pressure in the vacuum chamber 1 becomes not more than $1\times10^{-2}$ Torr.

Thereafter, the electromagnetic valve 8 of the gas exhaust pipe 5 is closed, and the gas feed valve 6 of the gas feed pipe 4 is opened to feed a mixed gas obtained by adding 3000 ppm (0.3%) of water vapor to 99.7% of nitrogen to the vacuum chamber 1. At the same time, the vent valve 10 of the atmosphere release pipe 9 is opened to adjust the internal pressure of the vacuum chamber 1 to atmospheric pressure, and the tableware is heated for 5 hours with maintaining almost the same temperature (650 to 830° C.) as in the annealing (hardening treatment step). Through the hardening treatment step, nitrogen 104 and oxygen 105 are adsorbed onto the surface of the titanium tableware 100, diffused inside the tableware 100 from the surface so as to form a solid solution, whereby a surface hardened layer 101 consisting of the first hardened layer 102 and the second hardened layer 103 is formed (see FIG. 2).

After the hardening treatment step, the vent valve 10 of the atmosphere release pipe 9 and the gas feed valve 6 of the gas feed pipe 4 are closed, and the electromagnetic valve 8 of the gas exhaust pipe 5 is opened to evacuate the interior of the vacuum chamber 1 by the vacuum pump 7 to a pressure of not more than $1\times10^{-2}$ Torr and to remove the mixed gas. Then, the electromagnetic valve 8 of the gas exhaust pipe 5 is closed, and the gas feed valve 6 of the gas feed pipe 4 is opened to feed an argon gas. At the same time, the vent valve 10 of the atmospheric release pipe 9 is opened to adjust the internal pressure of the vacuum chamber 1 to atmospheric pressure. In this atmosphere, the titanium tableware is cooled to room temperature (cooling step).

Figure 14:
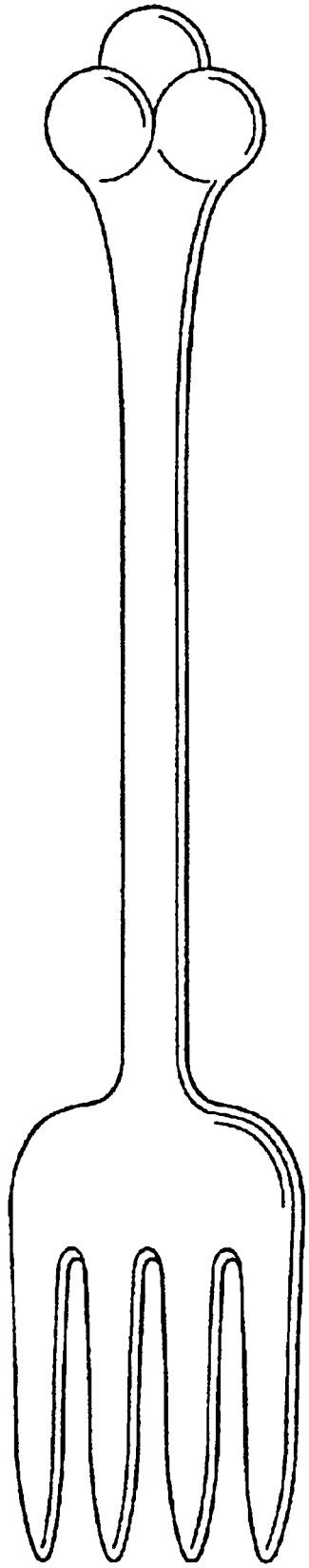
FIG. 14 is an example of titanium or titanium alloy tableware in the first embodiment of the tableware according to the invention and the process for surface treatment thereof.
Figure 15:
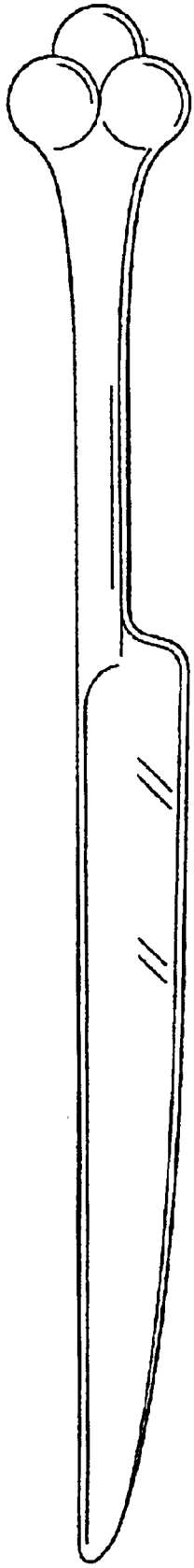
FIG. 15 is an example of titanium or titanium alloy tableware in the first embodiment of the tableware according to the invention and the process for surface treatment thereof.
Figure 16:
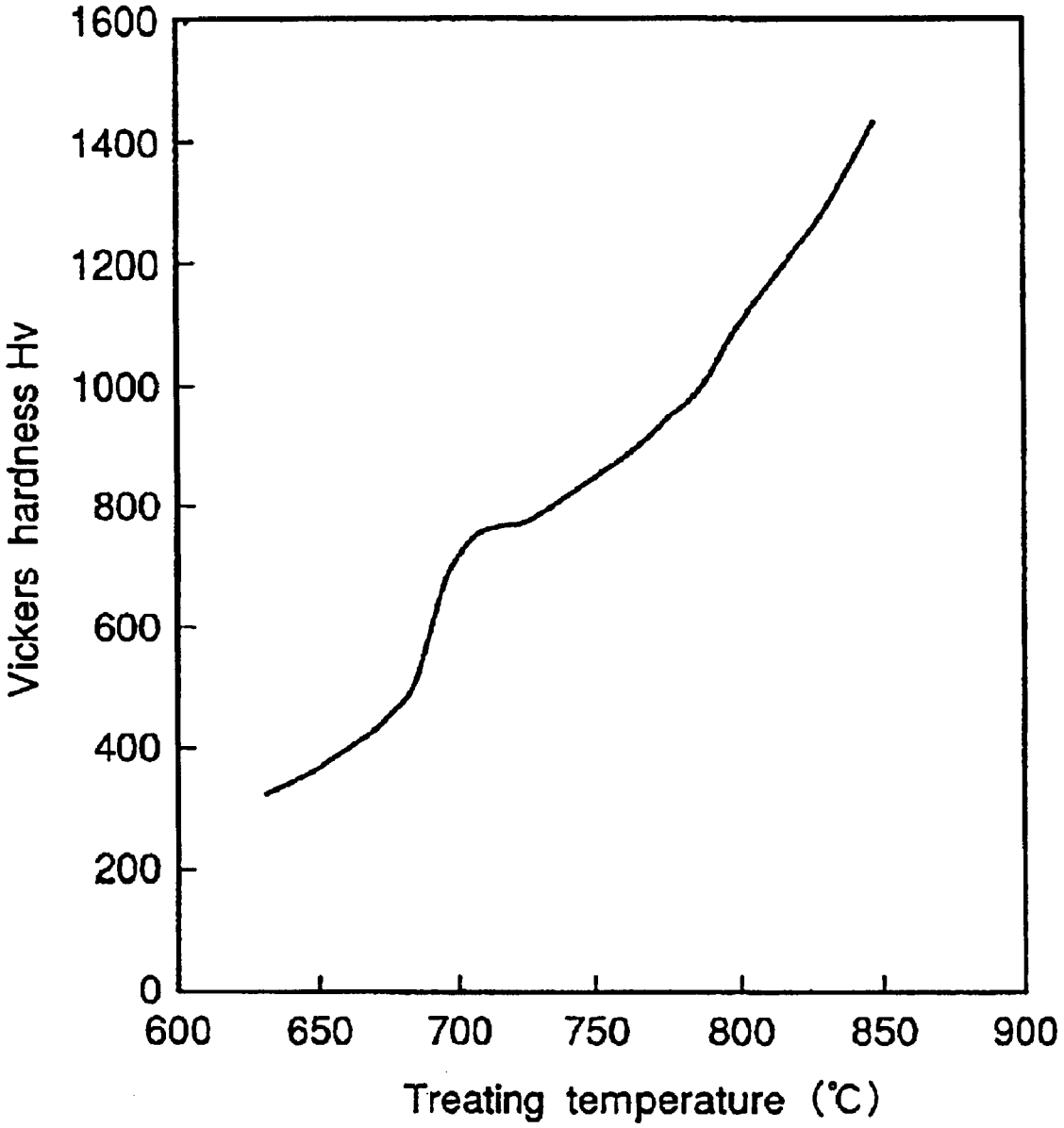
FIG. 16 is a graph showing results of the measurement of Vickers hardness versus treating temperature of a member having been surface hardened, in the substrate having a hard decorative coating film according to the invention and the process for producing the same.

In the second embodiment, a fork having mirror surface appearance and made of titanium of the second kind defined by JIS, that is shown in FIG. 14, was used as the titanium tableware (member to be treated). The heating step and the hardening treatment step were performed with variously changing the treating temperature within the temperature range of 650 to 830° C. Thereafter, hardness, surface roughening, and size of crystal grain in the surface structure were measured and evaluated.

The hardness was measured by a Vickers hardness meter (load of 100 g), and tableware having a Vickers hardness Hv of not less than 750 at a depth of 1.0 $\mu$m from the surface was taken as pass.

The surface roughening was evaluated by measuring an average surface roughness Ra by a surface roughness meter, and tableware having an average surface roughness Ra of not more than 0.4 μm was taken as pass.

The size Rc of a crystal grain was measured by observing crystal structure on the surface, and tableware having a crystal grain size of 20 to 65 μm was taken as pass.

The results are set forth in Table 6.

TABLE 6

| No. | Treating temperature (°C) | Hardness at a depth of 1.0 μm from the surface (Hv) | Average surface roughness Ra after treatment (μm) | Crystal grain size Rc after treatment (μm) | Evaluation result |
|---|---|---|---|---|---|
| S 21 | 650 | 360 | 0.2 | 20~50 | fall |
| S 22 | 730 | 840 | 0.25 | 30~60 | pass |
| S 23 | 780 | 1050 | 0.35 | 30~60 | pass |
| S 24 | 830 | 1410 | 1.3 | 80~250 | fall |
| S c | untreated | 180 | 0.2 | 20~50 | — |

In Table 6, the sample numbers S21 to S24 are titanium tableware obtained by changing the treating temperature in the heating step and the hardening treatment step.

As shown in Table 6, after the surface treatment, the sample number S21 (treating temperature: 650° C.) had an average surface roughness Ra and a crystal grain size Rc equivalent to those of the untreated pure titanium tableware (sample number Sc) and retained good appearance quality. However, it showed a low Vickers hardness Hv of 360 at a depth of 1.0 μm from the surface. Although the sample number S24 (treating temperature: 830° C.) had a high Vickers hardness Hv of 1410 at a depth of 1.0 μm from the surface, it had a large average surface roughness Ra of 1.3 μm and a large grain size Rc of 80 to 250 μm, and marked surface roughening was observed. This surface roughening deviates from the tolerance in the use of the titanium tableware as a decorative article.

In contrast, the sample numbers S22 and S23 had a sufficiently high Vickers hardness Hv of 840 to 1050 at a depth of 1.0 μm from the surface, an average surface roughness Ra of 0.25 to 0.35 μm and a crystal grain size Rc of 30 to 60 μm, retaining good appearance quality equivalent to that of the untreated pure titanium tableware (sample number Sc). In the sample numbers S22 and S23, the nitrogen content and the oxygen content in the 1.0 μm depth portion from the surface were 0.6 to 8.0% by weight and 1.0 to 14.0% by weight, respectively, similarly to the titanium tableware of the sample numbers S2 and S3 in Table 1. Presumably the first hardened layer 102 shown in FIG. 2 has been formed.

Since the oxygen content in the 20 μm depth portion from the surface was 0.5 to 14.0% by weight, presumably the second hardened layer 103 shown in FIG. 2 has been also formed. Thus, titanium tableware having a surface hardened layer was obtained. The titanium tableware of the sample numbers S22 and S23 retained mirror surface quality equivalent to that of the titanium tableware prior to the surface hardening treatment.

Then, as the inert gas to be introduced into the vacuum chamber 1 in the hardening treatment step, a helium gas was used, and equivalent results were obtained. The heating step and the hardening treatment step were carried out with variously changing the treating temperature within the temperature range of 650 to 830° C., similarly to the second embodiment. Thereafter, hardness, surface roughening, and size of crystal grain in the surface structure were measured and evaluated. The results obtained when a helium gas was used as the inert gas are set forth in Table 7.

TABLE 7

| No. | Treating Temperature (° C.) | Hardness at a depth of 1.0 μm from the surface (Hv) | Average surface roughness Ra after treatment (μm) | Crystal grain size Rc after treatment (μm) | Evaluation result |
|---|---|---|---|---|---|
| S 25 | 650 | 330 | 0.2 | 20~50 | fall |
| S 26 | 730 | 780 | 0.25 | 30~60 | pass |
| S 27 | 780 | 840 | 0.3 | 30~60 | pass |
| S 28 | 830 | 1220 | 1.0 | 80~200 | fall |
| S c | untreated | 180 | 0.2 | 20~50 | — |

In Table 7, the sample numbers S25 to S28 are titanium tableware obtained by changing the treating temperature in the heating step and the hardening treatment step.

As shown in Table 7, after the surface treatment, the sample number S25 (treating temperature: 650° C.) had an average surface roughness Ra and a crystal grain size Rc equivalent to those of the untreated pure titanium tableware (sample number Sc) and retained good appearance quality. However, it showed a low Vickers hardness Hv of 330 at a depth of 1.0 μm from the surface. Although the sample number S28 (treating temperature: 830° C.) had a high Vickers hardness Hv of 1220 at a depth of 1.0 μm from the surface, it had a large average surface roughness Ra of 1.0 μm and a large grain size Rc of 80 to 200 μm, and marked surface roughening was observed. This surface roughening deviates from the tolerance in the use of the titanium tableware as a decorative article.

In contrast, the sample numbers S26 and S27 had a sufficiently high Vickers hardness Hv of 780 to 840 at a depth of 1.0 μm from the surface, an average surface roughness Ra of 0.25 to 0.3 μm and a crystal grain size Rc of 30 to 60 μm. retaining good appearance quality equivalent to that of the untreated pure titanium tableware (sample number Sc). In the sample numbers S26 and S27, the nitrogen content and the oxygen content in the 1.0 μm depth portion from the surface were 0.6 to 8.0% by weight and 1.0 to 14.0% by weight, respectively, similarly to the titanium tableware of the sample numbers S2 and S3 in Table 1. Presumably the first hardened layer 102 shown in FIG. 2 has been formed.

Since the oxygen content in the 20 μm depth portion from the surface was 0.5 to 14.0% by weight, presumably the second hardened layer 103 shown in FIG. 2 has been also formed.

In this embodiment, the heating step was achieved in an argon atmosphere at atmospheric pressure or in a helium atmosphere at atmospheric pressure, but the atmosphere is not necessarily restricted to these ones, and the heating step may be carried out under vacuum.

In this embodiment, the cooling step was achieved in an argon atmosphere at atmospheric pressure or in a helium atmosphere at atmospheric pressure, but the atmosphere is not necessarily restricted to these ones, and the cooling step may be carried out under vacuum.

The present invention is not restricted to the embodiments described above. In each of the above embodiments, the titanium tableware was heated using the heater 3 to diffuse nitrogen and oxygen so as to form a solid solution. However, plasma may be used to diffuse nitrogen and oxygen so as to form a solid solution in the titanium tableware.

The mixed gas containing nitrogen as a main component and a slight amount of an oxygen component, that is fed to the vacuum chamber 1 in the hardening treatment step, is not restricted to the mixed gas used in the above-mentioned each embodiment. A mixed gas obtained by adding various gases containing an oxygen component such as nitrogen monoxide, nitrogen dioxide, carbon monoxide or carbon dioxide to a nitrogen gas is also employable. To the mixed gas, a slight amount of an inert gas such as helium, neon or argon or a gas containing a hydrogen component, a boron component or a carbon component may be further added.

In the above-mentioned each embodiment, the treating time of the heating step was 30 minutes, but the treating time is not restricted thereto, and it may be arbitrarily determined in the range of 30 minutes to 2 hours.

In the above-mentioned each embodiment, further, the treating time of the hardening treatment step was 5 hours, but the treating time is not restricted thereto, and it may be arbitrarily determined. However, if the treating time of the hardening treatment step is shorten than 1 hour, diffusion of nitrogen and oxygen so as to form a solid solution does not proceed sufficiently, and there is a fear that necessary hardness is not obtained. On the other hand, if the treating time of the hardening treatment step is longer than 10 hours, surface roughening is liable to occur on the titanium tableware. Therefore, the treating time of the hardening treatment step is preferably in the range of 1 to 10 hours.

Third Embodiment

Next, the third embodiment of the invention is described with reference to FIG. 6.

Figure 6:
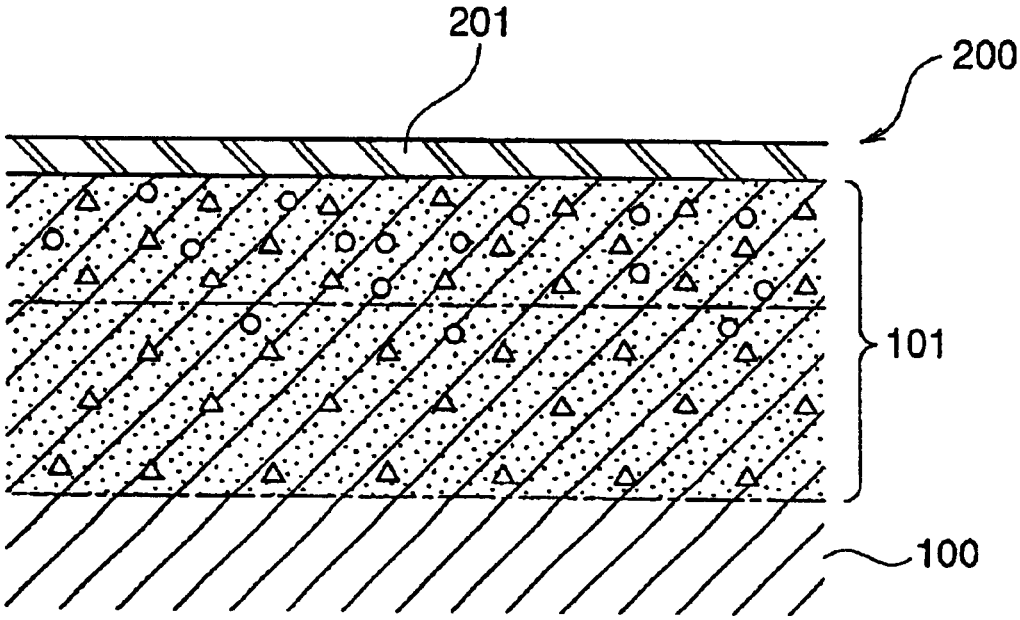
FIG. 6 is a schematic view showing a structure of titanium or titanium alloy tableware in the third embodiment of the tableware according to the invention and the process for surface treatment thereof.

FIG. 6 is a schematic view showing a structure of titanium tableware obtained by the present embodiment. In this embodiment, a TiN coating film 201 comprising titanium nitride, that is a hard coating film of a gold color, is formed on a surface hardened layer 101 of the titanium tableware 100 obtained by the first or the second embodiment by ion plating that is a dry plating method to obtain titanium tableware 200.

The process to form the TiN coating film 201 of titanium nitride as the hard coating film of a gold color in this embodiment is described below.

First, the titanium tableware 100 obtained by the first or the second embodiment was washed with an organic solvent such as isopropyl alcohol and placed in an ion plating device (not shown). The ion plating device is a device generally used, so that description of the device is omitted herein.

Subsequently, the device was evacuated to a pressure of $1.0\times10^{-5}$ Torr, and an argon gas was introduced into the device until the pressure became $3.0\times10^{-3}$ Torr.

Then, a thermionic filament and a plasma electrode equipped in the device were driven to generate plasma of argon. At the same time, an electric potential of −50 V was applied to the titanium tableware 100 to perform bombard cleaning for 10 minutes.

Then, introduction of the argon gas was stopped, and a nitrogen gas was introduced into the device until the pressure became $2.0\times10^{-3}$ Torr. After plasma was generated by a plasma gun equipped in the device, titanium was vaporized for 10 minutes to form a TiN coating film 201 of 0.5 $\mu$m thickness on the whole surface of the titanium tableware 100, namely, on the surface hardened layer 101 of the tableware 100. Thus, titanium tableware 200 was obtained.

The titanium tableware 200 thus obtained showed a uniform gold color tone because the TiN coating film 201 had optical properties similar to those of gold. Owing to this, the decorative value of the titanium tableware could be further enhanced. Since the hard TiN coating film 201 had excellent abrasion resistance, corrosion resistance and mar resistance, the tableware having been subjected to surface treatment could not get marred easily.

The dry plating method is not restricted to the ion plating, and various means publicly known such as sputtering and vacuum deposition are employable.

As the hard coating film of a gold color to be formed by the dry plating method, adoptable is a hard coating film made of a nitride, a carbide, an oxide, a nitrido-carbide or a nitrido-carbido-oxide of a 4a, 5a or 6a Group element (Ti, Zr, Hf, V, Nb, Ta, Cr, Mo, W) of the periodic table. When the 4a, 5a or 6a Group element of the periodic table is represented by M and a nitride of M is represented by MNx, the coating film of the nitride MNx of the element M comes closer to a light yellow color from a gold color as the x value which indicates the degree of nitriding becomes smaller than 1. As the x value indicating the degree of nitriding becomes larger than 1, the gold color of the coating film is more tinted with red. When the x value is in the range of 0.9 to 1.1, a coating film of the nitride MNx showing a gold color close to the color of gold or a gold alloy can be formed. Especially when the x value indicating the degree of nitriding is 1, the coating film of the nitride MNx of the element M is a coating film not only having a sufficient hardness but also showing a gold color closest to the color of gold or a gold alloy.

Similarly to the above, by controlling the degree of carbonization, oxidation or nitriding of the nitride, carbide, oxide, nitrido-carbide or nitrido-carbido-oxide of a 4a, 5a or 6a Group element of the periodic table in the given range, the coating film thereof can be imparted with a gold color closest to the color of gold or a gold alloy. Particularly, a TiN coating film and a ZrN coating film are preferable, because each of them is a hard coating film not only having a sufficient hardness but also showing a gold color closest to the color of gold or a gold alloy. When the thickness of the film of the nitride MNx of the element M is too small, the coating film cannot have effective abrasion resistance, corrosion resistance and mar resistance. On the other hand, when the thickness of the coating film is too large, the time for film formation is long, and the cost of the coating film becomes high. Therefore, the thickness of the coating film of the nitride MNx of the element M is controlled to be in the range of preferably 0.1 to 10 $\mu$m, more preferably 0.2 to 5 $\mu$m.

Fourth Embodiment

Next, the fourth embodiment of the invention is described with reference to FIG. 7, FIG. 8 and FIG. 9.

Figure 7:
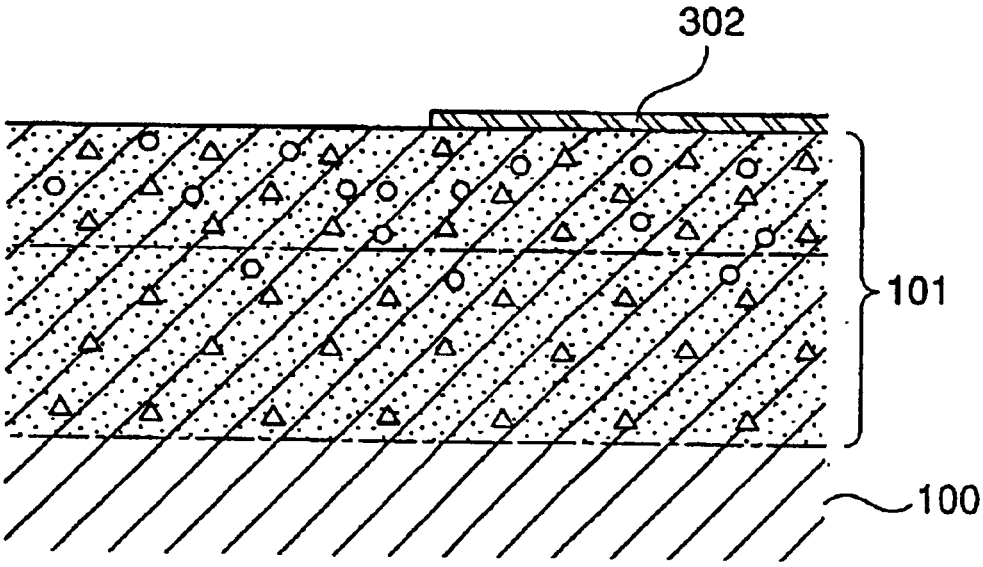
FIG. 7 is a schematic view showing a process for surface treatment of titanium or titanium alloy tableware in the fourth embodiment of the tableware according to the invention and the process for surface treatment thereof.
Figure 8:
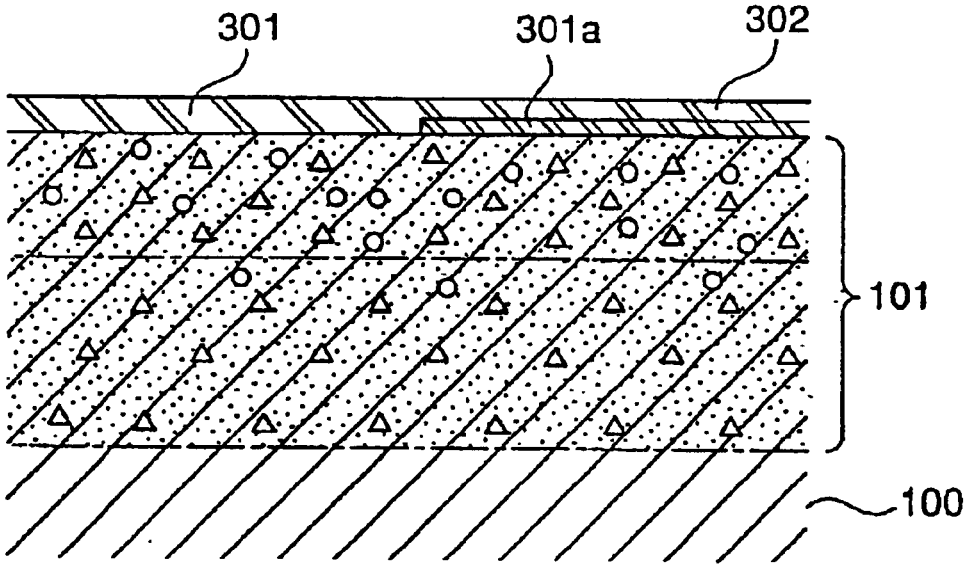
FIG. 8 is a schematic view showing a process for surface treatment of titanium or titanium alloy tableware in the fourth embodiment of the tableware according to the invention and the process for surface treatment thereof.

FIG. 7 and FIG. 8 are each a schematic view showing a process to partially form a hard coating film.

Figure 9:
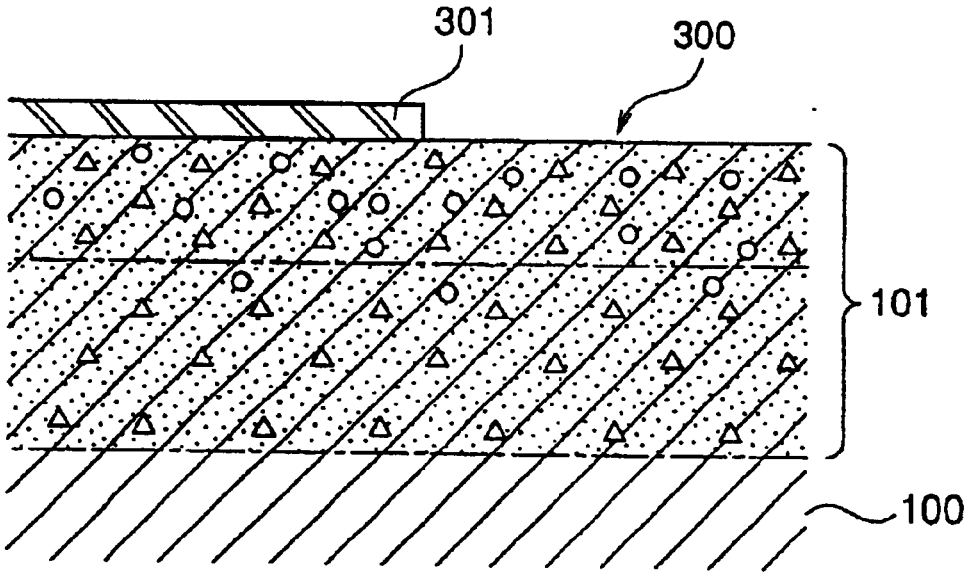
FIG. 9 is a schematic view showing a structure of titanium or titanium alloy tableware in the fourth embodiment of the tableware according to the invention and the process for surface treatment thereof.

FIG. 9 is a schematic structural view showing titanium tableware partially coated with a hard coating film by the present embodiment.

In this embodiment, a hard coating film 301 of a gold color made of titanium nitride is partially formed on the surface hardened layer 101 of the titanium tableware 100 obtained by the first or the second embodiment by ion plating that is a dry plating method to obtain titanium tableware 300.

The process to partially form the hard coating film 301 of a gold color made of titanium nitride in this embodiment is described below.

First, on the surface hardened layer 101 of the titanium tableware 100 obtained by the first or the second embodiment, namely, on the desired area of the surface of the titanium tableware 100, an organic maskant comprising an epoxy resin or a masking ink was printed to form a masking layer 302.

Then, the titanium tableware 100 having a masking layer 302 formed thereon was washed with an organic solvent such as isopropyl alcohol and placed in an ion plating device (not shown). The ion plating device is a device generally used, so that description of the device is omitted herein.

Subsequently, the device was evacuated to a pressure of $1.0\times10^{-5}$ Torr, and an argon gas was introduced into the device until the pressure became $3.0\times10^{-3}$ Torr.

Thereafter, a thermionic filament and a plasma electrode equipped in the device were driven to generate plasma of argon. At the same time, an electric potential of −50 V was applied to the titanium tableware 100 to perform bombard cleaning for 10 minutes.

Then, introduction of the argon gas was stopped, and a nitrogen gas was introduced into the device until the pressure became $2.0\times10^{-3}$ Torr. After plasma was generated by a plasma gun equipped in the device, titanium was vaporized for 10 minutes to form a TiN coating film 301, 301*a* of 0.5 $\mu$m thickness on the surface of the surface hardened layer 101 of the tableware 100 and on the surface of the masking layer 302.

Then, the masking layer 302 was swollen with ethyl methyl ketone (EMK) or a release solution obtained by adding formic acid and hydrogen peroxide to ethyl methyl ketone (EMK), and the masking layer 302 and the TiN coating film laminated thereon were removed by a lift off method. By the removal operation, two-tone titanium tableware 300 having a portion coated with a TiN coating film 301 and showing a gold color tone and a portion coated with no TiN coating film and showing a silver color tone was obtained. Owing to this, the appearance of the titanium tableware could be improved and the decorative value thereof could be increased.

As the masking means, not only the chemical masking layer described in this embodiment but also a mechanical masking means is adoptable. That is, prior to coating of the surface hardened layer with the, titanium nitride coating film, the desired portion of the titanium tableware is covered with a cap. Then, the surface hardened layer is coated with the titanium nitride coating film, followed by removing the cap. As a result, the portion of the titanium tableware having been covered with the cap is not coated with a titanium nitride coating film, while the portion having been covered with no cap is coated with a titanium nitride coating film.

In this embodiment, a titanium nitride coating film was used as the hard coating film. As described in the third embodiment, however, adoptable is a coating film made of a nitride, a carbide, an oxide, a nitrido-carbide or a nitrido-carbido-oxide of a 4a, 5a or 6a Group element of the periodic table as the hard coating film of a gold color to be formed on the surface hardened layer by the dry plating method.

Fifth Embodiment

Next, the fifth embodiment of the invention is described with reference to FIG. 10.

Figure 10:
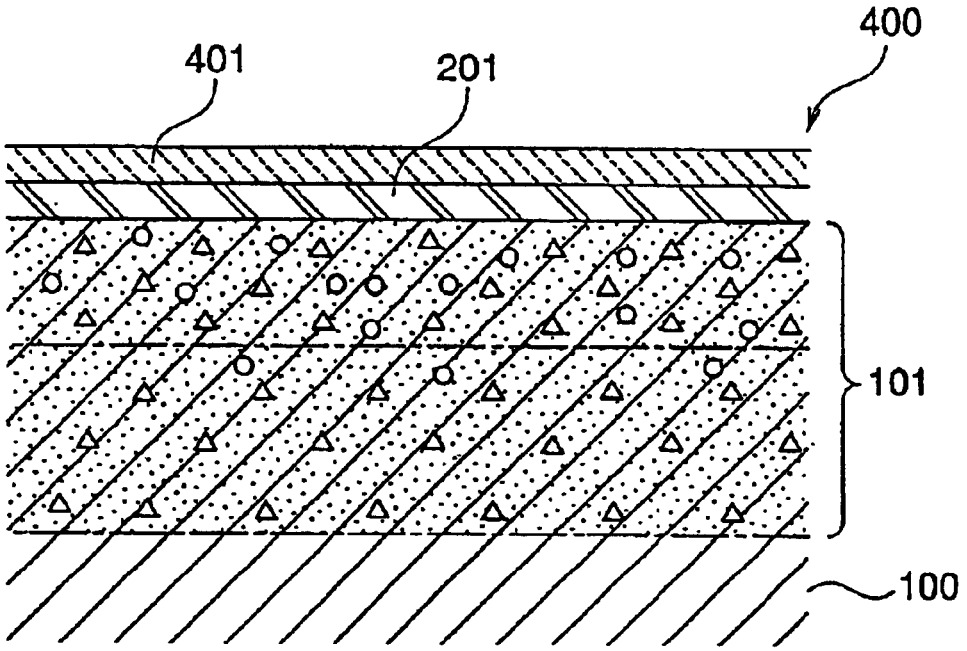
FIG. 10 is a schematic view showing a structure of titanium or titanium alloy tableware in the fifth embodiment of the tableware according to the invention and the process for surface treatment thereof.

FIG. 10 is a schematic view showing a structure of titanium tableware obtained by the present embodiment.

In this embodiment, a hard coating film 201 of a gold color made of titanium nitride is formed on the surface hardened layer 101 of the titanium tableware 100 obtained by the first or the second embodiment through ion plating that is a dry plating method, and on the hard coating film 201, a gold-titanium alloy coating film 401 is formed as the gold alloy coating film, whereby titanium tableware 400 is obtained.

The process to form the hard coating film 201 of a gold color made of titanium nitride and the gold alloy coating film 401 in this embodiment is described below.

First, the titanium tableware 100 obtained by the first or the second embodiment was washed with an organic solvent such as isopropyl alcohol and placed in an ion plating device (not shown). The ion plating device is a device generally used, so that description of the device is omitted herein. Then, the device was evacuated to a pressure of $1.0\times10^{-5}$ Torr, and an argon gas was introduced into the device until the pressure became $3.0\times10^{-3}$ Torr.

Thereafter, a thermionic filament and a plasma electrode equipped in the device were driven to generate plasma of argon. At the same time, an electric potential of −50 V was applied to the titanium tableware 100 to perform bombard cleaning for 10 minutes.

Then, introduction of the argon gas was stopped, and a nitrogen gas was introduced into the device until the pressure became $2.0\times10^{-3}$ Torr.

After plasma was generated by a plasma gun equipped in the device, titanium was vaporized for 10 minutes to form a TiN coating film 102 of 0.5 $\mu$m thickness on the whole surface of the tableware 100.

Then, vaporization of titanium and introduction of the argon gas were stopped, and the device was evacuated to a pressure of $1.0\times10^{-5}$ Torr.

Then, an argon gas was introduced into the device until the pressure became $1.0\times10^{-3}$ Torr to generate plasma, and a gold-titanium mixture composed of gold of 50% by atom and titanium of 50% by atom was vaporized to form a gold-titanium alloy coating film 401 as the gold alloy coating film. When the thickness of the gold-titanium alloy coating film 401 became 0.3 $\mu$m, vaporization of the gold-titanium mixture was stopped, whereby titanium tableware 400 on which the hard coating film 201 and the gold-titanium alloy coating film 401 were formed was obtained.

The titanium tableware 400 thus obtained showed a uniform gold color tone. Owing to this, the decorative value of the titanium tableware could be further increased. By formation of the gold-titanium alloy coating film 401 as the outermost layer, titanium tableware showing a gold color tone, that is a warmer gold color than that of the titanium nitride coating film 201 was obtained. Owing to this, the appearance of the titanium tableware could be further improved and the decorative value thereof could be enhanced.

In general, the gold alloy coating film itself cannot have effective abrasion resistance, corrosion resistance and mar resistance, unless the thickness thereof is a large one exceeding 10 $\mu$m. Gold is an extremely expensive metal. Therefore, formation of a gold alloy coating film having a large thickness greatly increases the cost of the coating film. In this embodiment, however, a hard TiN coating film was formed under the gold alloy coating film that is an outermost layer. Since the TiN coating film has excellent abrasion resistance, corrosion resistance and mar resistance, the gold alloy coating film as the outermost layer may be thin. Owing to this, the amount of expensive gold used can be decreased, and thereby the cost of the coating film can be cut down.

There is a possibility that the outermost layer of the thin gold alloy coating film is partially abraded to expose the TiN coating film outside. However any abrasion locally made on the outermost layer is not conspicuous because the TiN coating film has optical properties similar to those of gold and shows a gold color tone Beneath the abraded portion of the outermost layer of the gold alloy coating film showing a gold color tone, the TiN coating film showing the same gold color tone appears. Accordingly, even if the outermost layer of the gold alloy coating film is made thin, its abrasion is not visually observed, and the beautiful appearance and the decorative value of the titanium tableware can be maintained.

In this embodiment, a titanium nitride coating film was used as the hard coating film. However, a coating film made of a nitride, a carbide, an oxide, a nitrido-carbide or a nitrido-carbido-oxide of a 4a, 5a or 6a Group element of the periodic table is employable as the hard coating film of a gold color formed by the dry plating method.

Other than the gold-titanium alloy coating film, a coating film made of an alloy of gold and at least one metal selected from the group consisting of Al, Si, V, Cr, Fe, Co, Ni, Cu, Zn, Ge, Y, Zr, Nb, Mo, Ru, Rh, Pd, Ag, Cd, In, Sn, Hf, Ta, W, Ir and Pt can be formed as the gold alloy coating film.

As described in the fourth embodiment, the gold alloy coating film may be formed on the titanium nitride coating film partially formed on the surface of the titanium tableware 100.

Figure 11:
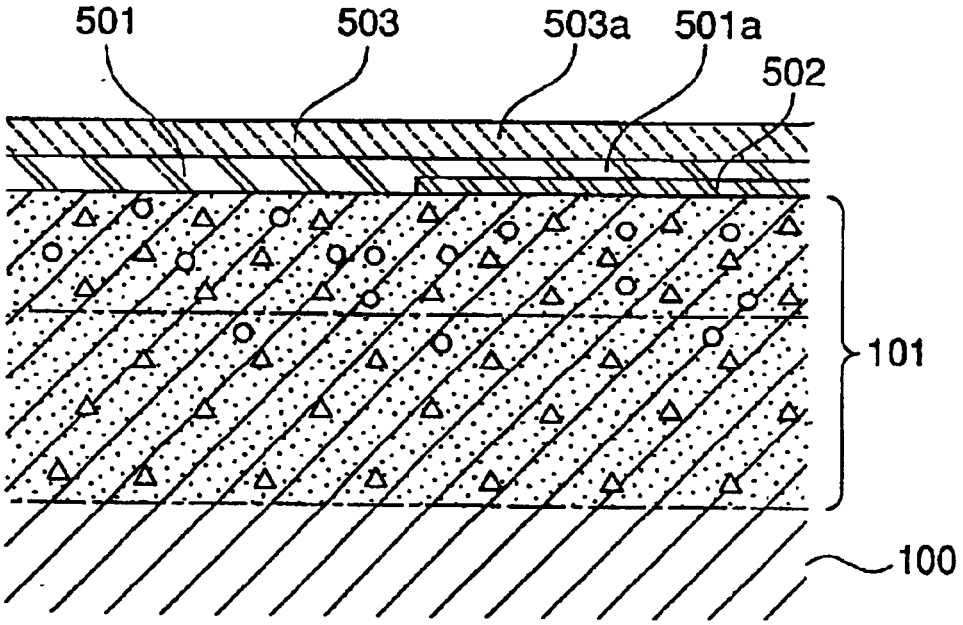
FIG. 11 is a schematic view showing a step of partially forming a hard coating film on titanium or titanium alloy tableware in the fifth embodiment of the tableware according to the invention and the process for surface treatment thereof
Figure 12:
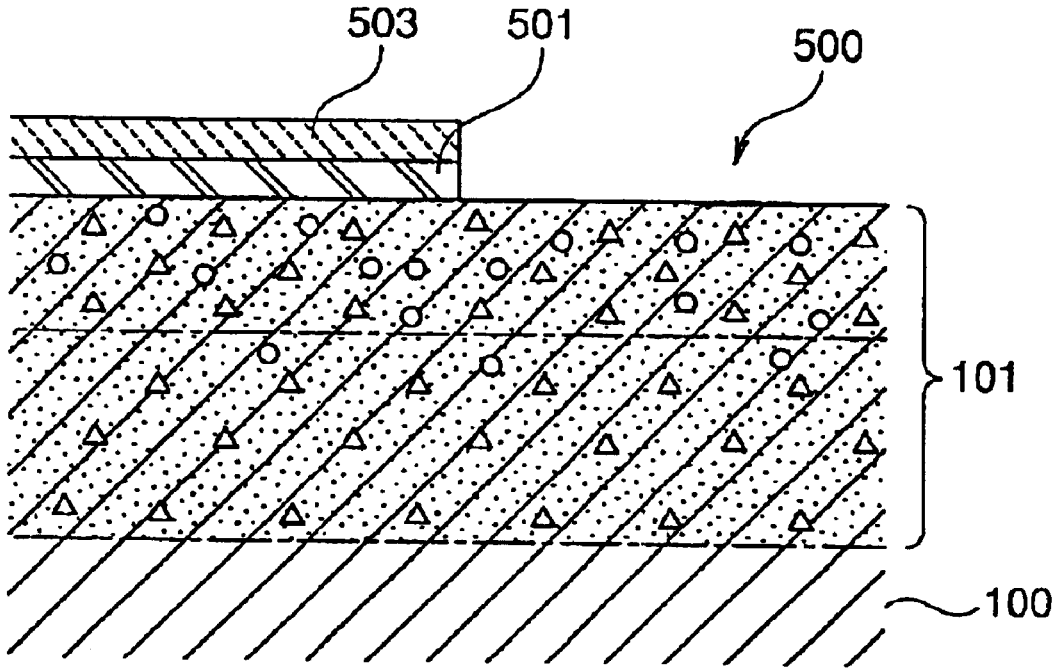
FIG. 12 is a schematic view showing a structure of titanium or titanium alloy tableware having a hard coating film partially formed thereon in the fifth embodiment of the tableware according to the invention and the process for surface treatment thereof.

The examples are shown in FIG. 11 and FIG. 12. FIG. 11 is a view showing a process to partially form a hard coating film on the surface of the titanium tableware 100 and to coat the surface of the partially formed hard coating film with a gold alloy coating film. FIG. 12 is a schematic structural view showing a hard coating film and a gold alloy coating film which are partially formed on the surface of the titanium tableware 100.

Next, the process to partially form the hard coating film and the gold alloy coating film is briefly described.

First, on the surface hardened layer 101 of the titanium tableware 100 obtained by the first or the second embodiment, namely, on the desired area of the surface of the titanium tableware 100, an organic maskant comprising an epoxy resin or a masking ink was printed to form a masking layer 502.

Then, the titanium tableware 100 having a masking layer 502 formed thereon was washed with an organic solvent such as isopropyl alcohol and placed in an ion plating device.

Subsequently, on the surface of the surface hardened layer 101 of the titanium tableware 100 and on the surface of the masking layer 502, a TiN coating film 501, 501*a* of 0.5 μm thickness made of titanium nitride was formed as the hard coating film of a gold color through ion plating under the same operation conditions as in the present embodiment, and on the TiN coating film 501, 501*a*, a gold-titanium alloy coating film 503, 503*a* of 0.3 μm thickness was formed as the gold alloy coating film.

Then, the masking layer 502 was swollen with ethyl methyl ketone (EMK) or a release solution obtained by adding formic acid and hydrogen peroxide to ethyl methyl ketone (EMK), and the masking layer 502, the TiN coating film 501*a* laminated thereon and the gold-titanium alloy coating film 503*a* were removed by a lift off method. By the removal operation, two-tone titanium tableware 500 having a portion coated with the gold-titanium alloy coating film 503 and showing a gold color tone and a portion coated with no gold-titanium alloy coating film 503 and no TiN coating film 501 and showing a silver color tone was obtained.

In the third, the fourth and the fifth embodiments mentioned above, a hard coating film of a gold color tone was used. However, the color tone of the hard coating film can be made close to a silver color by decreasing the degree of carbonization, oxidation or nitriding of a nitride, a carbide, an oxide, a nitrido-carbide or a nitrido-carbido-oxide of a 4a, 5a or 6a Group element of the periodic table. As a result, a hard coating film showing a color tone identical with the metallic color of titanium or titanium alloy tableware coated with no hard coating film can be formed. On the hard coating film of a silver color, a gold alloy coating film having a lessened gold content and showing the same silver color can be further formed.

In the present invention, the term "titanium" means a metallic material containing pure titanium as a main component and is, for example, titanium of the first kind, titanium of the second kind or titanium of the third kind defined by JIS. The term "titanium alloy" means a metallic material containing titanium as a main component and containing aluminum, vanadium, iron or the like, and is, for example, titanium of the 60 kind or titanium of the 60E kind defined by JIS. Other various titanium alloys and intermetallic compounds of titanium groups are also included in the titanium alloy materials.

Although the present embodiment is described above taking a spoon, a knife or a fork as an example of the titanium tableware, the embodiment is not restricted thereto and can be applied to many tableware such as chopsticks, plates and cups.

Substrate Having Hard Decorative Coating Film and Process for Producing the Same The substrate having a hard decorative coating film and the process for producing the substrate according to the invention are described below with reference to the following embodiments.

First Embodiment to Form an Internal Hardened Layer

First, the internal hardened layer formed on the substrate made of titanium or a titanium alloy (referred to as "titanium substrate" hereinafter) and the process to form the layer are described.

The internal hardened layer consists of a first hardened layer, which is formed in an arbitrary depth toward the inside from the surface of the titanium substrate and in which nitrogen and oxygen are diffused so as to form a solid solution, and a second hardened layer, which is formed in an arbitrary depth toward the inside from the first hardened layer. This is described with reference to FIG. 16 to FIG. 20.

Figure 17:
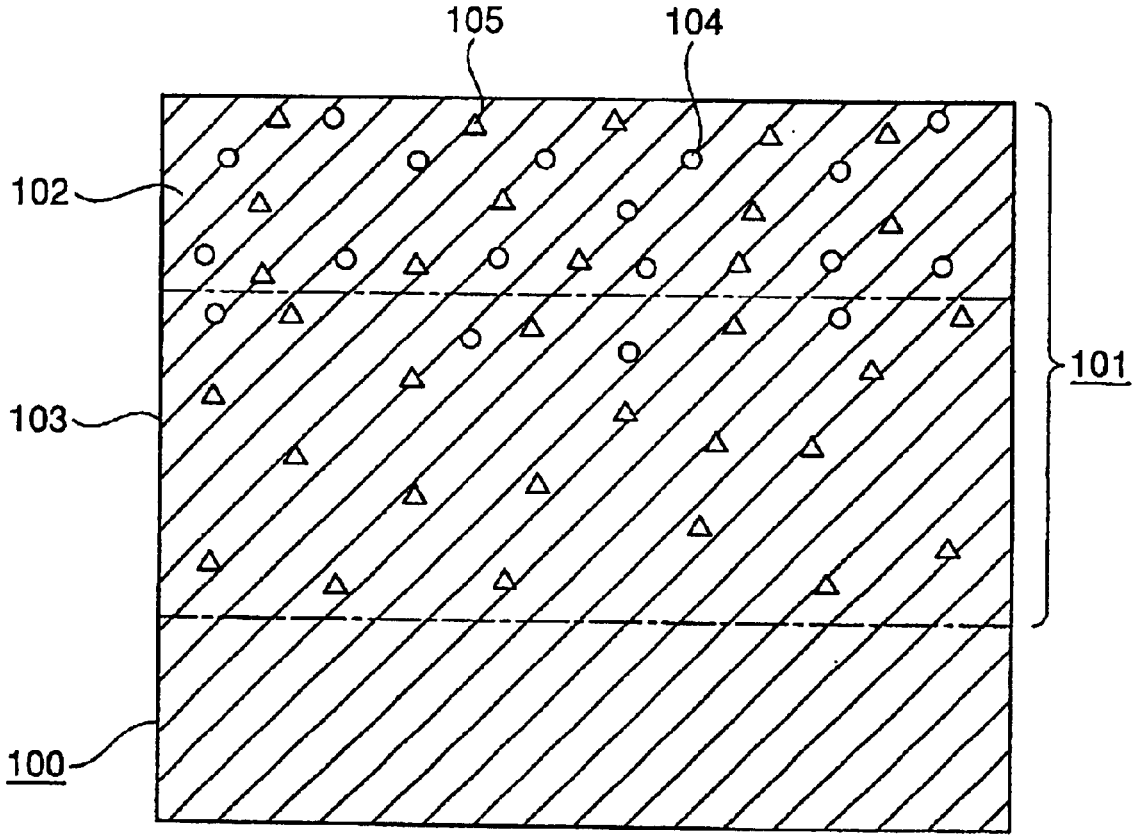
FIG. 17 is a schematic view showing a structure of titanium or titanium alloy substrate in the first and the second embodiments of the substrate having a hard decorative coating film according to the invention and the process for producing the same.

As shown in FIG. 17, on the surface of the titanium substrate 100, an internal hardened layer 101 is formed. The internal hardened layer 101 is spread to a depth of about 20 μm from the surface. The internal hardened layer 101 is divided into a first hardened layer 102 in which nitrogen 104 and oxygen 105 are diffused so as to form a solid solution and a second hardened layer 103 in which oxygen 105 is diffused so as to form a solid solution. The first hardened layer 102 is observed to be present in the region of a depth of about 1 μm from the surface, and in the region deeper than this, the second hardened layer 103 is present. The first hardened layer 102 in which nitrogen 104 and oxygen 105 are diffused so as to form a solid solution has a particularly high hardness and has a function of preventing marring of the member surface. The second hardened layer 103 spreads its hardened range to the deeper portion of the member and has a function of enhancing impact resistance.

By formation of the internal hardened layer consisting of the first hardened layer in which nitrogen and oxygen are diffused so as to form a solid solution and the second hardened layer in which oxygen is diffused so as to form a solid solution on the surface of the titanium substrate as described above, it becomes feasible that the substrate is free from surface roughening and has excellent appearance quality and sufficient hardness.

In the first hardened layer, the amount of nitrogen capable of being diffused so as to form a solid solution was in the range of 0.6 to 8.0% by weight, and the amount of oxygen capable of being diffused so as to form a solid solution was in the range of 1.0 to 14.0% by weight. In the second hardened layer, the amount of oxygen capable of being diffused so as to form a solid solution was in the range of 0.5 to 14.0% by weight. Consequently, the amount of nitrogen and oxygen to be diffused so as to form a solid solution is preferably as large as possible within the above-mentioned range. From the viewpoint of retention of excellent appearance quality of the titanium substrate, however, the concentration of nitrogen or oxygen diffused so as to form a solid solution should be selected from such a range that no surface roughening is brought about.

The first hardened layer diffusing nitrogen and oxygen so as to form a solid solution is preferably formed from the member surface to a depth of about 1.0 $\mu$m. By formation of the first hardened layer in this depth, surface roughening due to growth of large crystal grains can be inhibited and sufficient hardness can be obtained.

On the other hand, the second hardened layer diffusing oxygen so as to form a solid solution is preferably formed in the region deeper than the first hardened layer and to a depth of about 20 $\mu$m. By forming the second hardened layer in this depth, the surface hardness can be further increased.

Next, a scheme of a surface treatment device used in this embodiment is described.

Figure 18:
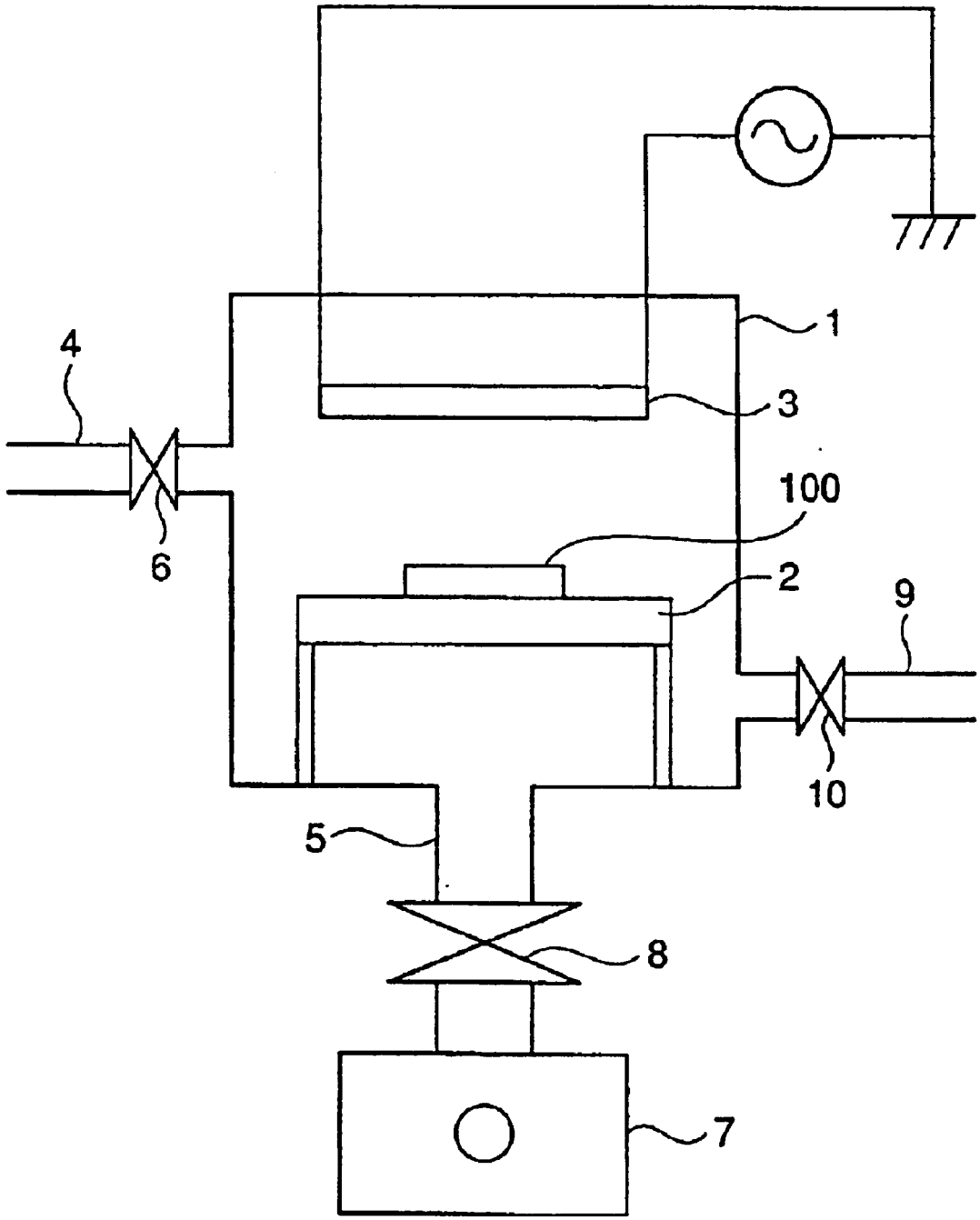
FIG. 18 is a schematic view showing a scheme of a surface treatment device used in the embodiments of the substrate having a hard decorative coating film according to the invention and the process for producing the same.

The surface treatment device shown in FIG. 18 includes a vacuum chamber 1 at the center. In the vacuum chamber 1, a tray 2 for placing thereon titanium substrate 100 and a heater 3 as a heating means are arranged. To the vacuum chamber 1, a gas feed pipe 4 and a gas exhaust pipe 5 are connected. The gas feed pipe 4 is connected to a gas supply source (not shown). At the midpoint of the gas feed pipe 4, a gas feed valve 6 is provided, and by the open-close operation of the gas feed valve 6, a necessary gas can be fed to the vacuum chamber 1. On the other hand, the gas exhaust pipe 5 is connected to a vacuum pump 7, and by the suction force of the vacuum pump 7, the gas in the vacuum chamber 1 can be sucked and exhausted. At the midpoint of the gas exhaust pipe 5, an electromagnetic valve 8 to control execution/stopping of the vacuum suction is provided. To the vacuum chamber 1, an atmosphere release pipe 9 is further connected, and by opening a vent valve 10 provided at the midpoint of the atmosphere release pipe 9, the pressure in the vacuum chamber 1 can be adjusted to an atmospheric pressure.

Next, the process for surface treatment of the titanium substrate is described.

The process for surface treatment of the titanium substrate in this embodiment comprises the following steps:

(1) a heating step wherein a titanium substrate 100 is placed in a vacuum chamber and heated to anneal the substrate, (2) a hardening treatment step wherein a mixed gas containing nitrogen as a main component and a slight amount of an oxygen component is introduced into the vacuum chamber after the heating step, and the vacuum chamber 1 is heated at a temperature of 700 to 800° C. for a given period of time under given reduced pressure to diffuse nitrogen and oxygen inside the titanium substrate 100 from the surface so as to form a solid solution, and (3) a cooling step wherein the titanium substrate 100 is cooled down to room temperature after the hardening treatment step.

The heating step is a step wherein the titanium substrate 100 is heated and annealed for the purpose of relaxing a working strain layer formed on the substrate 100 by hot forging working or the subsequent polishing working. The working strain layer formed by the polishing working is a layer in which stress due to the polishing working remains as lattice strain, and this layer is in an amorphous phase or in a low-crystalline state. If the substrate 100 after the polishing working is subjected to the hardening treatment step without conducting the heating for annealing, diffusion of nitrogen and oxygen so as to form a solid solution are promoted in the hardening treatment step with relaxing the working strain layer.

As a result, the reaction of nitrogen and oxygen on the surface of the titanium substrate 100 is enhanced to decrease the amount of nitrogen and oxygen diffused inside the substrate so as to form a solid solution, and besides a nitride and an oxide which are colored substances, are formed in the vicinity of the surface. Formation of the colored substances is unfavorable because the appearance quality is lowered. In this embodiment, therefore, the heating step is operated prior to the hardening treatment step to previously remove the working strain and to promote diffusion of nitrogen and oxygen so as to form a solid solution in the hardening treatment step.

In the heating step, it is preferable that the vacuum chamber is evacuated and heating is carried out under reduced pressure, or it is preferable that the vacuum chamber is evacuated, then an inert gas is introduced into the vacuum chamber, and heating is conducted under reduced pressure. When the heating step is carried out in such an atmosphere, reaction of the titanium substrate with impurities other than nitrogen and the oxygen component (introduced in the hardening treatment step) can be prevented.

In the subsequent hardening treatment step, a mixed gas containing nitrogen as a main component and a slight amount of an oxygen component is introduced into the vacuum chamber to diffuse nitrogen and oxygen inside the titanium substrate 100 from the surface so as to form a solid solution. By the hardening treatment step, not only the first hardened layer in which nitrogen and oxygen are diffused so as to form a solid solution, is formed in the vicinity of the surface of the substrate, but also the second hardened layer in which oxygen is diffused so as to form a solid solution, is formed in the depth wise direction of the substrate 100.

As the oxygen component contained in a slight amount in the mixed gas, various gases containing oxygen are employable. Examples of the oxygen components include an oxygen gas, a hydrogen gas, water vapor, ethyl alcohol and methyl alcohol. Further, a carbon dioxide gas or a carbon monoxide gas may be contained together with water vapor.

In the hardening treatment step, nitrogen and a slight amount of the oxygen component must be diffused inside the titanium substrate 100 so as to form a solid solution, without forming a compound by the reaction of nitrogen and the oxygen component with the titanium substrate 100. For this purpose, the treating temperature in this step is important.

To determine the optimum treating temperature, a surface treatment based on the process for producing a substrate having a hard decorative coating film according to the invention was carried out. In this surface treatment, titanium of the second kind defined by JIS with a mirror surface appearance was used as a member to be treated, and the treating temperature was changed in the range of 630 to 830° C.

As the mixed gas containing nitrogen as a main component and a slight amount of an oxygen component, a mixed gas obtained by adding 2000 ppm (0.2%) of oxygen and 4000 ppm (0.4%) of hydrogen to 99.4% of nitrogen was used. The interior of the vacuum chamber was set under reduced pressure, and heating was carried out for 5 hours.

The member having been subjected to hardening was measured on the Vickers hardness (load of 100 g) The results are shown in FIG. 1.

As is apparent from the figure, when the treating temperature was lower than 700° C., the Vickers hardness Hv became not more than 750, and sufficient hardening was not attained. This results from the observation that nitrogen and oxygen are not sufficiently diffused so as to form a solid solution at a treating temperature of lower than 700° C., the first and the second hardened layers being not properly formed. When the treating temperature is higher than 800° C., the rates of diffusion of nitrogen and oxygen so as to form a solid solution are high and a hardened layer reaching the deeper region is obtained. Consequently, the Vickers hardness Hv became not less than 1100.

However, it has been found that if the treating temperature exceeds 800° C., the crystal grains of the member become large and surface roughening takes place. Therefore, in case of the treating temperature above 800° C., the appearance quality of the tableware cannot be kept good. In this case, because of surface roughening occurrence, surface polishing is required in the later step.

In view of the above results, the hardening treatment step was carried out within the temperature range of 700 to 800° C. Although the concentration of the oxygen component in the mixed gas containing nitrogen as a main component is arbitrary, it is adjusted to be in the range of preferably 100 to 30000 ppm. If the concentration of the oxygen component is lower than 100 ppm (0.01%), oxygen is not diffused so as to form a solid solution sufficiently. If the concentration of the oxygen component exceeds 30000 ppm (3%), an oxide layer is liable to be formed on the surface of the titanium substrate to cause surface roughening.

Although the degree of reduced pressure in the hardening treatment step is arbitrary, the pressure in the vacuum chamber is adjusted to be in the range of preferably 0.01 to 10 Torr.

As the oxygen component contained in a slight amount in the mixed gas used in the hardening treatment step, various gases containing oxygen are employable. Examples of the oxygen components include an oxygen gas, a hydrogen gas, water vapor, and alcohol gases such as ethyl alcohol and methyl alcohol. Further, a carbon dioxide gas or a carbon monoxide gas may be contained together with water vapor.

Next, the cooling step is described.

The purpose of the cooling step is to rapidly cool the titanium substrate 100, which has been completed in the hardening treatment step, to room temperature. It is preferable that the cooling step is not performed in the same gas atmosphere as in the hardening treatment step. Otherwise, a nitride or an oxide is liable to be formed on the surface of the titanium substrate 100 to deteriorate the appearance quality.

Accordingly, the cooling step is preferably conducted in an atmosphere of an inert gas such as argon or helium. That is, in the cooling step, it is preferable that the vacuum chamber is highly evacuated to remove the mixed gas containing nitrogen as a main component and a slight amount of an oxygen component, then an inert gas is introduced into the vacuum chamber, and the substrate is cooled to room temperature under reduced pressure. The cooling step may be carried out under vacuum.

Specific treating conditions of the process for surface treatment in this embodiment are described below.

First, titanium of the second kind defined by JIS was subjected to hot forging, cold forging or a combination thereof to prepare a titanium substrate of desired shape as the titanium substrate (member to be treated). When it is difficult to obtain the titanium substrate 100 of desired shape by forging, the substrate may be subjected to cutting.

Subsequently, the substrate 100 was polished with a buff to mirror finish the surface of the substrate.

Then, the substrate 100 was subjected to surface hardening treatment using the surface treatment device shown in FIG. 18.

First, the interior of the vacuum chamber 1 of the surface treatment device is highly evacuated through the gas exhaust pipe 5 to a pressure of not more than $1\times10^{-5}$ Torr at which the influence of the residual gas atmosphere is eliminated, and then the titanium substrate 100 is heated at a temperature of 650 to 830° C. by the heater 3. This heating is kept for 30 minutes to anneal the substrate 100 (heating step).

Then, a mixed gas obtained by adding 5000 ppm (0.5%) of oxygen to 99.5% of nitrogen is fed as a reaction gas through the gas feed pipe 4. The internal pressure of the vacuum chamber 1 is adjusted to 0.2 Torr, and the substrate is heated for 5 hours with maintaining almost the same temperature (650 to 830° C.) as in the annealing.

Through the hardening treatment step, nitrogen 104 and oxygen 105 are adsorbed onto the surface of the substrate 100, diffused inside the substrate 100 from the surface so as to form a solid solution, whereby an internal hardened layer 101 consisting of the first hardened layer 102 and the second hardened layer 103 is formed (see FIG. 17) (hardening treatment step).

Thereafter, feeding of the mixed gas was stopped, and the substrate was cooled down to room temperature with performing the evacuation (cooling step).

Next, plural results obtained by changing the treating temperature in the heating step and the hardening treatment step are compared.

As the substrate (member to be treated), a substrate having a mirror surface appearance and made of titanium of the second kind defined by JIS was used. The heating step and the hardening treatment step were carried out with variously changing the treating temperature within the temperature range of 650 to 830° C. Thereafter, hardness, diffusion depth and concentration of nitrogen and oxygen, surface roughening, and size of crystal grain in the surface structure were measured and evaluated.

The hardness was measured by a Vickers hardness meter (load of 100 g), and a substrate having a Vickers hardness Hv of not less than 750 at a depth of 1.0 $\mu$m from the surface was taken as pass.

The diffusion depth and concentration of nitrogen and oxygen were measured by a secondary ion mass spectrometer (SIMS).

The surface roughening was evaluated by measuring an average surface roughness Ra by a surface roughness meter, and a substrate having an average surface roughness Ra of not more than 0.4 $\mu$m was taken as pass.

The size Rc of a crystal grain was measured by observing crystal structure of the surface with an electron microscope, and a substrate having a crystal grain size of 20 to 65 $\mu$m was taken as pass.

The results are set forth in Table 8.

TABLE 8

| No. | Treating temperature (° C.) | Hardness at a depth of 1.0 μm from the surface (Hv) | Nitrogen concentration at a depth of 1.0 μm from the surface (wt %) | Oxygen concentration at a depth of 1.0 μm from the surface (wt %) | Oxygen concentration at a depth of 20 μm from the surface (wt %) | Average surface roughness Ra after treatment (μm) | Crystal grain size Rc after treatment (μm) | Evaluation result |
|---|---|---|---|---|---|---|---|---|
| S 1 | 650 | 380 | 0.05 | 2.0 | 0.01 | 0.2 | 20~50 | fall |
| S 2 | 730 | 820 | 0.8 | 2.6 | 0.7 | 0.25 | 30~60 | pass |
| S 3 | 780 | 935 | 1.6 | 1.7 | 1.0 | 0.3 | 30~60 | pass |
| S 4 | 830 | 1320 | 2.1 | 2.2 | 1.5 | 1.0 | 80~200 | fall |
| S c | untreated | 180 | — | — | — | 0.2 | 20~50 | — |

In Table 8, the sample numbers S1 to S4 are titanium substrates obtained by changing the treating temperature in the heating step and the hardening treatment step. The sample number Sc is an untreated pure titanium substrate. As shown in Table 8, after the surface treatment, the sample number SI (treating temperature: 650° C.) had an average surface roughness Ra and a crystal grain size Rc equivalent to those of the untreated pure titanium substrate (sample number Sc) and retained good appearance quality. However, it showed a low Vickers hardness Hv of 380 at a depth of 1.0 μm from the surface. The nitrogen content in the same depth portion of this sample was measured and found to be 0.05% by weight, which indicated that nitrogen was rarely contained. That is, it can be seen that the first hardened layer 102 shown in FIG. 17 was not formed. The oxygen content in the 20 μm depth portion from the surface was 0.01% by weight, showing that the second hardened layer 103 was not formed either.

Although the sample number S4 (treating temperature: 830° C.) had a high Vickers hardness Hv of 1320 at a depth of 1.0 μm from the surface, it had a large average surface roughness Ra of 1.0 μm and a large grain size Rc of 80 to 200 μm, and marked surface roughening was observed. This surface roughening deviates from the tolerance in the use of a substrate.

In contrast, the sample numbers S2 and S3 had a sufficiently high Vickers hardness Hv of 820 to 935 at a depth of 1.0 μm from the surface, an average surface roughness Ra of 0.25 to 0.3 μm and a crystal grain size Rc of 30 to 60 μm, retaining good appearance quality equivalent to that of the untreated pure titanium substrate (sample number Sc).

Figure 19:
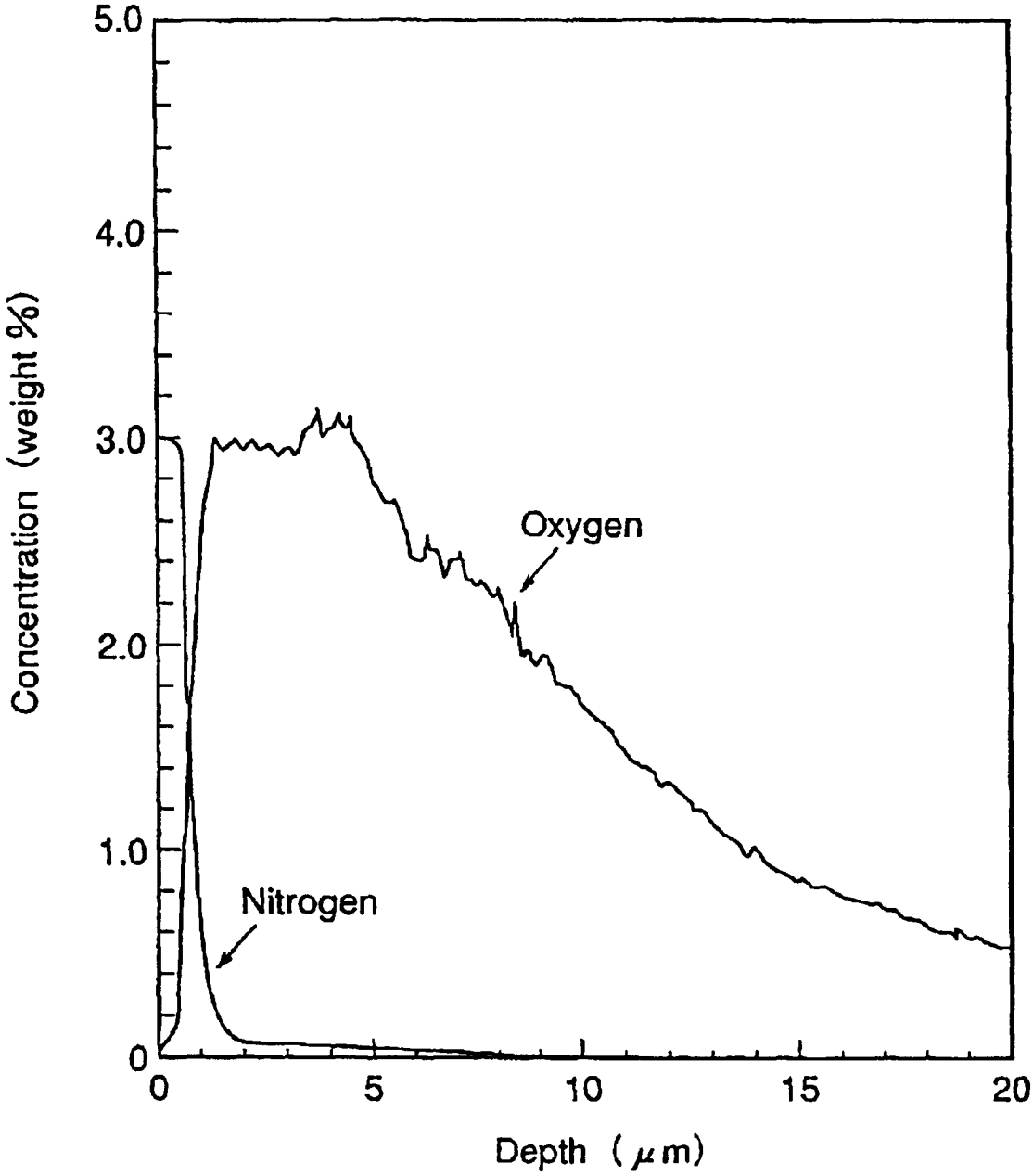
FIG. 19 is a graph showing results of the measurements of a nitrogen content and an oxygen content to a depth from the surface of a substrate in the first embodiment of the substrate having a hard decorative coating film according to the invention and the process for producing the same.

In the sample numbers S2 and S3, the nitrogen content and the oxygen content in the 1.0 μm depth portion from the surface were 0.6 to 8.0% by weight (specifically 0.8 to 1.6% by weight) and 1.0 to 14.0% by weight (specifically 1.7 to 2.6% by weight), respectively, indicating that the first hardened layer 102 shown in FIG. 17 was formed. Further, the oxygen content in the 20 μm depth portion from the surface was 0.5 to 14.0% by weight (specifically 0.7 to 1.0% by weight), indicating that the second hardened layer 103 shown in FIG. 17 was also formed. FIG. 19 is a view showing results of measurements of the nitrogen content and the oxygen content to the depth from the surface. As the measuring object, the substrate of the sample number S2 was used.

As is apparent from this figure, in the substrate of the sample number S2 having been subjected to the surface hardening shown in Table 8, large amounts of nitrogen and oxygen were diffused so as to form a solid solution in the region of a depth up to 1 μm from the surface. In the deeper region, larger amounts of oxygen were diffused so as to form a solid solution. Thus, a substrate having an internal hardened layer could be obtained. The substrates of the sample numbers S2 and S3 retained mirror surface quality equivalent to that of the substrate prior to the surface hardening treatment.

Then, the titanium substrate having the internal hardened layer was polished by barrel polishing. The polishing method is described below.

First, the substrate is placed in a barrel of a centrifugal barrel polishing machine.

Then, in the barrel are placed walnut chips and an alumina-based abrasive as abrasive media, and barrel polishing is carried out over a period of about 10 hours to remove a part of the hard layer formed on the surface of the titanium substrate, said part ranging from the surface to a depth of 0.7 μm. By this operation, fine irregularities on the surface of the substrate were removed to make the surface of the substrate more even. Thus, a titanium substrate with a mirror surface emitting uniform silver gloss was obtained. Since the mirror surface appearance of the substrate is improved and the decorative value thereof is enhanced as described above, the barrel polishing is important.

Although the barrel polishing was used in the above embodiment, other mechanical polishing means publicly known such as buff polishing and a combination of barrel polishing and buff polishing are also employable.

If the surface of the first hardened layer is polished too much, the region having low contents of nitrogen and oxygen, particularly the region having a low content of nitrogen, comes to expose outside. That is, as the polishing is conducted more deeply, the region having lower hardness is exposed, and hence the surface hardness of the substrate is lowered. On the contrary, if the depth to be polished is too small, a beautiful mirror surface cannot be obtained. Accordingly, the depth to be polished is in the range of 0.1 to 3.0 μm, preferably 0.2 to 2.0 μm, more preferably 0.5 to 1.0 μm, from the surface of the first hardened layer. When the depth to be polished is set in the above range, the surface hardness of the substrate can be kept high enough for the practical use and a smooth mirror surface can be obtained. Specifically, the substrate after the polishing needs only have a Vickers hardness of 500 to 800 Hv under a load of 100 g.

In the above-mentioned surface hardening treatment, the treating time is shorter and the productivity is higher than those in the conventional hardening such as ion implantation, ion nitridation or carburizing. Moreover, since the titanium substrate having been subjected to the surface hardening has a hardened layer reaching a depth of 20 μm from the surface, the substrate is not marred even if it is used for a long period of time. Particularly, a mirror surface of uniform gloss can be obtained by the barrel polishing, so that the decorative value can be further increased.

Then, as the reaction gas containing nitrogen as the main component and a slight amount of an oxygen component to be introduced into the vacuum chamber 1 in the hardening treatment step, the following mixed gases were each used, and equivalent results were obtained. The results are described below.

First, a mixed gas obtained by adding 3000 ppm (03%) of water vapor to 99.7% of nitrogen was used as the mixed gas. The results are set forth in Table 9.

TABLE 9

| No. | Treating temperature (° C.) | Hardness at a depth of 1.0 μm from the surface (Hv) | Nitrogen concentration at a depth of 1.0 μm from the surface (wt %) | Oxygen concentration at a depth of 1.0 μm from the surface (wt %) | Oxygen concentration at a depth of 20 μm from the surface (wt %) | Average surface roughness Ra after treatment (μm) | Crystal grain size Rc after treatment (μm) | Evaluation result |
|---|---|---|---|---|---|---|---|---|
| S 5 | 650 | 405 | 0.06 | 1.9 | 0.01 | 0.2 | 20~50 | fall |
| S 6 | 730 | 840 | 0.9 | 2.5 | 0.8 | 0.25 | 30~60 | pass |
| S 7 | 780 | 940 | 1.6 | 2.0 | 1.2 | 0.3 | 30~60 | pass |
| S 8 | 830 | 1400 | 2.4 | 2.0 | 1.4 | 1.2 | 80~250 | fall |
| S c | untreated | 180 | — | — | — | 0.2 | 20~50 | — |

In Table 9, the sample numbers S5 to S8 are substrates obtained by changing the treating temperature in the heating step and the hardening treatment step.

As shown in Table 9, after the surface treatment, the sample number S5 (treating temperature: 650° C.) had an average surface roughness Ra and a crystal grain size Rc equivalent to those of the untreated pure titanium substrate (sample number Sc) and retained good appearance quality. However, it showed a low Vickers hardness Hv of 405 at a depth of 1.0 μm from the surface. The nitrogen content in the same depth portion of this sample was measured, and found to be 0.06% by weight, which indicated that nitrogen was rarely contained. That is, it can be seen that the first hardened layer 102 shown in FIG. 17 was not formed. The oxygen content in the 20 μm depth portion from the surface was 0.01% by weight, showing that the second hardened layer 103 was not formed either.

Although the sample number S8 (treating temperature: 830° C.) had a high Vickers hardness Hv of 1400 at a depth of 1.0 μm from the surface, it had a large average surface roughness Ra of 1.2 μm and a large grain size Rc of 80 to 250 μm, and marked surface roughening was observed. This surface roughening deviates from the tolerance in the use of the substrate as a decorative article.

In contrast, the sample numbers S6 and S7 had a sufficiently high Vickers hardness Hv of 820 to 940 at a depth of 1.0 μm from the surface, an average surface roughness Ra of 0.25 to 0.3 μm and a crystal grain size Rc of 30 to 60 μm, retaining good appearance quality equivalent to that of the untreated pure titanium substrate (sample number Sc).

Figure 20:
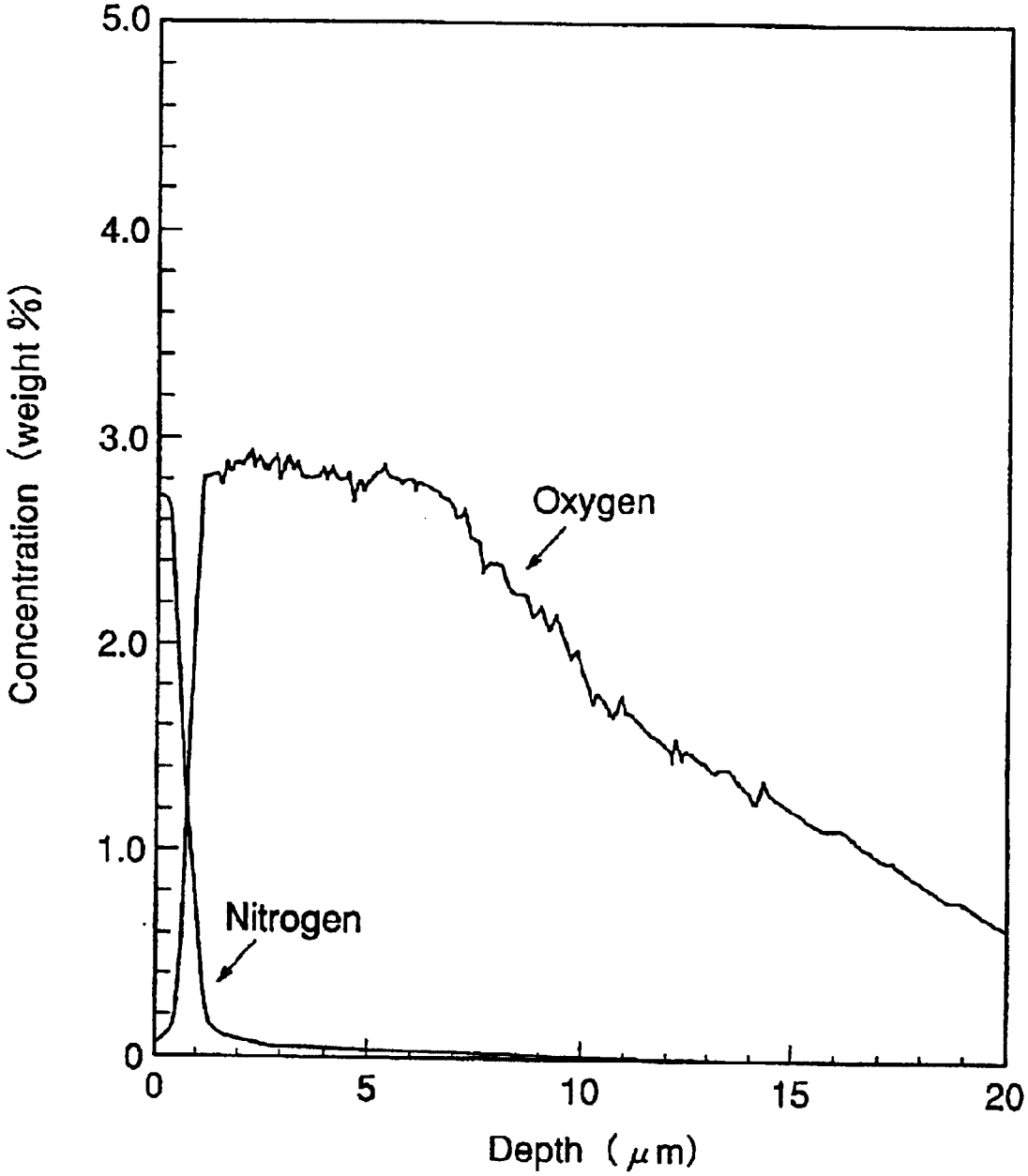
FIG. 20 is a graph showing results of the measurements of a nitrogen content and an oxygen content to a depth from the surface of a substrate in the second embodiment of the substrate having a hard decorative coating film according to the invention and the process for producing the same.

In the sample numbers S6 and S7, the nitrogen content and the oxygen content in the 1.0 μm depth portion from the surface were 0.6 to 8.0% by weight (specifically 0.9 to 1.6% by weight) and 1.0 to 14.0% by weight (specifically 2.0 to 2.5% by weight), respectively, indicating that the first hardened layer 102 shown in FIG. 17 was formed. Further, the oxygen content in the 20 μm depth portion from the surface was 0.5 to 14.0% by weight (specifically 0.8 to 1.2% by weight), indicating that the second hardened layer 103 shown in FIG. 17 was also formed. FIG. 20 is a view showing results of measurements of the nitrogen content and the oxygen content to the depth from the surface. As the measuring object, the substrate of the sample number S6 was used.

As is apparent from this figure, in the substrate of the sample number S6 having been subjected to the surface hardening shown in Table 9, large amounts of nitrogen and oxygen were diffused so as to form a solid solution in the region of a depth up to 1 μm from the surface. In the deeper region, larger amounts of oxygen were diffused so as to form a solid solution.

Then, a mixed gas obtained by adding 2000 ppm (0.2%) of oxygen and 4000 ppm (0.4%) of hydrogen to 99.4% of nitrogen was used as the mixed gas. The results are set forth in Table 10.

TABLE 10

| No. | Treating temperature (° C.) | Hardness at a depth of 1.0 μm from the surface (Hv) | Average surface roughness Ra after treatment (μm) | Crystal grain size Rc after treatment (μm) | Evaluation result |
|---|---|---|---|---|---|
| S 9 | 650 | 370 | 0.2 | 20~50 | fall |
| S 10 | 730 | 810 | 0.25 | 30~60 | pass |
| S 11 | 780 | 920 | 0.3 | 30~60 | pass |
| S 12 | 830 | 1300 | 1.1 | 80~200 | fall |
| S c | untreated | 180 | 0.2 | 20~50 | — |

In Table 10, the sample numbers S9 to S12 are substrates obtained by changing the treating temperature in the heating step and the hardening treatment step.

As shown in Table 10, after the surface treatment, the sample number S9 (treating temperature: 650° C.) had an average surface roughness Ra and a crystal grain size Rc equivalent to those of the untreated pure titanium substrate (sample number Sc) and retained good appearance quality. However, it showed a low Vickers hardness Hv of 370 at a depth of 1.0 μm from the surface. Although the sample number S12 (treating temperature: 830° C.) had a high Vickers hardness Hv of 1300 at a depth of 1.0 μm from the surface, it had a large average surface roughness Ra of 1.1 μm and a large grain size Rc of 80 to 200 μm, and marked surface roughening was observed. This surface roughening deviates from the tolerance in the use of the substrate as a decorative article.

In contrast, the sample numbers S10 and S11 had a sufficiently high Vickers hardness Hv of 810 to 920 at a depth of 1.0 μm from the surface, an average surface roughness Ra of 0.25 to 0.3 μm and a crystal grain size Rc of 30 to 60 μm, retaining good appearance quality equivalent to that of the untreated pure titanium substrate (sample number Sc).

In the sample numbers S11 and S12, the nitrogen content surface were 0.6 to 8.0% by weight and 1.0 to 14.0% by weight, respectively, similarly to the substrates of the sample numbers S2 and S3 in Table 8. Presumably the first hardened layer 102 shown in FIG. 17 has been formed Since the oxygen content in the 20 μm depth portion from the surface was 0.5 to 14.0% by weight, presumably the second hardened layer 103 shown in FIG. 17 has been also formed.

Then, a mixed gas obtained by adding 2500 ppm (0.25%) of water vapor and 500 ppm (0.05%) of carbon dioxide to 99.7% of nitrogen was used as the mixed gas. The results are set forth in Table 11.

TABLE 11

| No. | Treating temperature (° C.) | Hardness at a depth of 1.0 μm (Hv) | Average surface roughness Ra after treatment (μm) | Crystal grain size Rc after treatment (μm) | Evaluation result |
|---|---|---|---|---|---|
| S 13 | 650 | 340 | 0.2 | 20~50 | fall |
| S 14 | 730 | 800 | 0.25 | 30~60 | pass |
| S 15 | 780 | 850 | 0.3 | 30~60 | pass |
| S 16 | 830 | 1240 | 1.0 | 80~200 | fall |
| S c | untreated | 180 | 0.2 | 20~50 | — |

In Table 11, the sample numbers S13 to S16 are substrates obtained by changing the treating temperature in the heating step and the hardening treatment step.

As shown in Table 11, after the surface treatment, the sample number S13 (treating temperature: 650° C.) had an average surface roughness Ra and a crystal grain size Rc equivalent to those of the untreated pure titanium substrate (sample number Sc) and retained good appearance quality. However, it showed a low Vickers hardness Hv of 340 at a depth of 1.0 μm from the surface. Although the sample number S16 (treating temperature: 830° C.) had a high Vickers hardness Hv of 1240 at a depth of 1.0 μm from the surface, it had a large average surface roughness Ra of 1.0 μm and a large grain size Rc of 80 to 200 μm, and marked surface roughening was observed. This surface roughening deviates from the tolerance in the use as the substrate as a decorative article.

In contrast, the sample numbers S14 and S15 had a sufficiently high Vickers hardness Hv of 800 to 850 at a depth of 1.0 μm from the surface, an average surface roughness Ra of 0.25 to 0.3 μm and a crystal grain size Rc of 30 to 60 μm, retaining good appearance quality equivalent to that of the untreated pure titanium substrate (sample number Sc).

In the sample numbers S14 and S15, the nitrogen content and the oxygen content in the 1.0 μm depth portion from the surface were 0.6 to 8.0% by weight and 1.0 to 14.0% by weight, respectively, similarly to the substrates of the sample numbers S2 and S3 in Table. 8. Presumably the first hardened layer 102 shown in FIG. 17 has been formed. Since the oxygen content in the 20 μm depth portion from the surface was 0.5 to 14.0% by weight, presumably the second hardened layer 103 shown in FIG. 17 has been also formed.

Then, a mixed gas obtained by adding 7000 ppm (0.3%) of an ethyl alcohol gas to 99.3% of nitrogen was used as the mixed gas. The results are set forth in Table 12.

TABLE 12

| No. | Treating temperature (° C.) | Hardness at a depth of 1.0 μm from the surface (Hv) | Average surface roughness Ra after treatment (μm) | Crystal grain size Rc after treatment (μm) | Evaluation result |
|---|---|---|---|---|---|
| S 17 | 650 | 330 | 0.2 | 20~50 | fall |
| S 18 | 730 | 780 | 0.25 | 30~55 | pass |
| S 19 | 780 | 830 | 0.3 | 30~60 | pass |
| S 20 | 830 | 1200 | 1.0 | 80~180 | fall |
| S c | untreated | 180 | 0.2 | 20~50 | — |

In Table 12, the sample numbers S17 to S20 are substrates obtained by changing the treating temperature in the heating step and the hardening treatment step.

As shown in Table 12, after the surface treatment, the sample number S17 (treating temperature. 650° C.) had an average surface roughness Ra and a crystal grain size Rc equivalent to those of the untreated pure titanium substrate (sample number Sc) and retained good appearance quality. However, it showed a low Vickers hardness Hv of 330 at a depth of 1.0 μm from the surface.

Although the sample number S20 (treating temperature: 830° C.) had a high Vickers hardness Hv of 1200 at a depth of 1.0 μm from the surface, it had a large average surface roughness Ra of 1.0 μm and a large grain size Rc of 80 to 180 μm, and marked surface roughening was observed. This surface roughening deviates from the tolerance in the use of the substrate as a decorative article.

In contrast, the sample numbers S18 and S19 had a sufficiently high Vickers hardness Hv of 780 to 830 at a depth of 1.0 μm from the surface, an average surface roughness Ra of 0.25 to 0.3 μm and a crystal grain size Rc of 30 to 55 μm, retaining good appearance quality equivalent to that of the untreated pure titanium substrate (sample number Sc).

In the sample numbers S18 and S19, the nitrogen content and the oxygen content in the 1.0 μm depth portion from the surface were 0.6 to 8.0 by weight and 1.0 to 14.0% by weight, respectively, similarly to the substrates of the sample numbers S2 and S3 in Table 8. Presumably the first hardened layer 102 shown in FIG. 17 has been formed. Since the oxygen content in the 20 μm depth portion from the surface was 0.5 to 14.0% by weight, presumably the second hardened layer 103 shown in FIG. 17 has been also formed.

In the heating step of the above embodiment, after the high evacuation, the substrate is heated under vacuum to perform annealing. Since the atmosphere is not necessarily restricted to vacuum, the heating may be done in an atmosphere of an inert gas such as helium or argon to which the substrate is unreactive. Also in this case, however, the interior of the vacuum chamber is preferably under reduced pressure.

In the above embodiment, the cooling step is carried out with evacuating. Since the atmosphere is not necessarily restricted to vacuum, the cooling may be effected in an atmosphere of an inert gas such as helium or argon to which the titanium substrate is unreactive. Also in this case, however, the interior of the vacuum chamber 1 is preferably under reduced pressure.

Second Embodiment to form Internal Hardened Layer

Next, the second embodiment to form the internal hardened layer is described.

The purpose and the basic action of each step in the second embodiment are the same as those in the above-described first embodiment to form the internal hardened layer. The second embodiment is different from the first embodiment in that the heating step and the hardening treatment step are carried out at atmospheric pressure. The second embodiment is further different from the first embodiment in that when the heating step is conducted at atmospheric pressure, an inert gas is introduced into the vacuum chamber to prevent reaction of the substrate with impurity components other than nitrogen and the oxygen component, because the substrate is made of an active metal (titanium or titanium alloy).

In the heating step of the second embodiment, it is preferable that the vacuum chamber is evacuated, then an inert gas is introduced into the vacuum chamber to adjust the pressure to atmospheric pressure, and heating is carried out at atmospheric pressure. However, it is also possible that the vacuum chamber is evacuated and heating is conducted under reduced pressure. When the heating step is performed in such an atmosphere, reaction of the titanium substrate with impurities other than nitrogen and the oxygen component (introduced in the hardening treatment step) can be prevented.

In the hardening treatment step after the heating step, the vacuum chamber is highly evacuated to remove the inert gas, subsequently a mixed gas containing nitrogen as a main component and a slight amount of an oxygen component is introduced into the vacuum chamber, the pressure in the vacuum chamber is adjusted to atmospheric pressure, and the interior of the vacuum chamber 1 is heated at a temperature of 700 to 800° C., whereby nitrogen and oxygen are diffused inside the titanium substrate from the surface so as to form a solid solution.

As the oxygen component contained in a slight amount in the mixed gas for use in the hardening treatment step, various gases containing oxygen are employable. Examples of the oxygen components include an oxygen gas, a hydrogen gas, water vapor, and alcohol gases such as ethyl alcohol and methyl alcohol. Further, a carbon dioxide gas or a carbon monoxide gas may be contained together with water vapor.

After the hardening treatment step, a cooling step to cool the substrate to room temperature is conducted, and it is preferable that the cooling step is not carried out in the same gas atmosphere as in the hardening treatment step, similarly to the first embodiment. That is, in the cooling step, it is preferable that the vacuum chamber is highly evacuated to remove the mixed gas containing nitrogen as a main component and a slight amount of an oxygen component, then an inert gas is introduced into the vacuum chamber to adjust the pressure to atmospheric pressure, and the substrate is cooled to room temperature. The cooling step may be carried out under vacuum.

Specific treating conditions of the process for surface treatment in this embodiment are described below.

First, titanium of the second kind defined by JIS was subjected to hot forging, cold forging or a combination thereof to prepare a titanium substrate of desired shape as the titanium substrate (member to be treated), similarly to the first embodiment.

Subsequently, the substrate 100 was polished with a buff to mirror finish the surface of the substrate.

Then, the titanium substrate 100 was subjected to surface hardening treatment using the surface treatment device shown in FIG. 18.

First, a gas in the vacuum chamber 1 is sucked by a vacuum pump 7 through a gas exhaust pipe 5 to evacuate the vacuum chamber to a pressure of not more than $1\times10^{-2}$ Torr at which the influence of the residual gas atmosphere is eliminated, and then an electromagnetic valve 8 is closed. Subsequently, a gas feed valve 6 is opened to feed an argon gas (inert gas) to the vacuum chamber 1 through a gas feed pipe 4, and a vent valve 10 of an atmosphere release pipe 9 is opened to adjust the pressure in the vacuum chamber 1 to atmospheric pressure. In this atmosphere, the substrate 100 is heated by a heater 13 at a temperature of 650 to 830° C. for 30 minutes to perform annealing (heating step).

Then, the vent valve 10 of the atmosphere release pipe 9 and the gas feed valve 6 of the gas feed pipe 4 are closed, and the electromagnetic valve 8 of the gas exhaust pipe 5 is opened to execute evacuation by the vacuum pump 7. The evacuation is continued until the pressure in the vacuum chamber 1 becomes not more than $1\times10^{-2}$ Torr.

Thereafter, the electromagnetic valve 8 of the gas exhaust pipe 5 is closed, and the gas feed valve 6 of the gas feed pipe 4 is opened to feed a mixed gas obtained by adding 3000 ppm (0.3%) of water vapor to 99.7% of nitrogen to the vacuum chamber 1. At the same time, the vent valve 10 of the atmosphere release pipe 9 is opened to adjust the internal pressure of the vacuum chamber 1 to atmospheric pressure, and the substrate is heated for 5 hours with maintaining almost the same temperature (650 to 830° C.) as in the annealing (hardening treatment step). Through the hardening treatment step, nitrogen 104 and oxygen 105 are adsorbed onto the surface of the titanium substrate 100, diffused inside the substrate 100 from the surface so as to form a solid solution, whereby an internal hardened layer 101 consisting of the first hardened layer 102 and the second hardened layer 103 is formed (see FIG. 17).

After the hardening treatment step, the vent valve 10 of the atmosphere release pipe 9 and the gas feed valve 6 of the gas feed pipe 4 are closed, and the electromagnetic valve 8 of the gas exhaust pipe 5 is opened to evacuate the interior of the vacuum chamber 1 by the vacuum pump 7 to a pressure of not more than $1\times10^{-2}$ Torr and to remove the mixed gas. Then, the electromagnetic valve 8 of the gas exhaust pipe 5 is closed, and the gas feed valve 6 of the gas feed pipe 4 is opened to feed an argon gas. At the same time, the vent valve 10 of the atmospheric release pipe 9 is opened to adjust the internal pressure of the vacuum chamber 1 to atmospheric pressure. In this atmosphere, the substrate is cooled to room temperature (cooling step).

In the second embodiment, a substrate having mirror surface appearance and made of titanium of the second kind defined by JIS was used as the substrate (member to be treated). The heating step and the hardening treatment step were performed with variously changing the treating temperature within the temperature range of 650 to 830° C. Thereafter, hardness, surface roughening, and size of crystal grain in the surface structure were measured and evaluated.

The hardness was measured by a Vickers hardness meter (load of 100 g), and a substrate having a Vickers hardness Hv of not less than 750 at a depth of 1.0 $\mu$m from the surface was taken as pass.

The surface roughening was evaluated by measuring an average surface roughness Ra by a surface roughness meter, and a substrate having an average surface roughness Ra of not more than 0.4 $\mu$m was taken as pass.

The size Rc of a crystal grain was measured by observing crystal structure on the surface, and a substrate having a crystal grain size of 20 to 65 $\mu$m was taken as pass.

The results are set forth in Table 13.

TABLE 13

| No. | Treating temperature (° C.) | Hardness at a depth of 1.0 $\mu$m from the surface (Hv) | Average surface roughness Ra after treatment ($\mu$m) | Crystal grain size Rc after treatment ($\mu$m) | Evaluation result |
|---|---|---|---|---|---|
| S 21 | 650 | 360 | 0.2 | 20~50 | fall |
| S 22 | 730 | 840 | 0.25 | 30~60 | pass |
| S 23 | 780 | 1050 | 0.35 | 30~60 | pass |
| S 24 | 830 | 1410 | 1.3 | 80~250 | fall |
| S c | untreated | 180 | 0.2 | 20~50 | — |

In Table 13, the sample numbers S21 to S24 are substrates obtained by changing the treating temperature in the heating step and the hardening treatment step.

As shown in Table 13, after the surface treatment, the sample number S21 (treating temperature: 650 c) had an average surface roughness Ra and a crystal grain size Rc equivalent to those of the untreated pure titanium substrate (sample number Sc) and retained good appearance quality. However, it showed a low Vickers hardness Hv of 360 at a depth of 1.0 μm from the surface. Although the sample number S24 (treating temperature: 830° C.) had a high Vickers hardness Hv of 1410 at a depth of 1.0 μm from the surface, it had a large average surface roughness Ra of 1.3 μm and a large grain size Rc of 80 to 250 μm, and marked surface roughening was observed. This surface roughening deviates from the tolerance in the use of the substrate as a decorative article.

In contrast, the sample numbers S22 and S23 had a sufficiently high Vickers hardness Hv of 840 to 1050 at a depth of 1.0 μm from the surface, an average surface roughness Ra of 0.25 to 0.35 μm and a crystal grain size Rc of 30 to 60 μm, retaining good appearance quality equivalent to that of the untreated pure titanium substrate (sample number Sc). In the sample numbers SW22 and S23, the nitrogen content and the oxygen content in the 1.0 μm depth portion from the surface were 0.6 to 8.0% by weight and 1.0 to 14.0% by weight, respectively, similar to the titanium substrate of the sample numbers S2 and S3 in Table 8. Presumably, the first hardened layer 102 shown in FIG. 17 has been formed.

Since the oxygen content in the 20 μm depth portion from the surface was 0.5 to 14.0% by weight, presumably the second hardened layer 103 shown in FIG. 17 has been also formed. Thus, a titanium substrate having an internal hardened layer was obtained. The substrates of the sample numbers S22 and S23 retained mirror surface quality equivalent to that of the substrate prior to the surface hardening treatment. Then, as the inert gas to be introduced into the vacuum chamber 1 in the hardening treatment step, a helium gas was used, and equivalent results were obtained. The heating step and the hardening treatment step were carried out by variously changing the treating temperature in the temperature range of 650 to 830° C., similar to the second embodiment. Thereafter, hardness, surface roughening, and size of crystal grain in the surface structure were measured and evaluated. The results obtained when a helium gas was used as the inert gas are set forth in Table 14.

TABLE 14

| No. | Treating temperature (° C.) | Hardness at a depth of 1.0 μm from the surface (Hv) | Average surface roughness Ra after treatment (μm) | Crystal grain size Rc after treatment (μm) | Evaluation result |
|---|---|---|---|---|---|
| S 25 | 650 | 330 | 0.2 | 20~50 | fall |
| S 26 | 730 | 780 | 0.25 | 30~60 | pass |
| S 27 | 780 | 840 | 0.3 | 30~60 | pass |
| S 28 | 830 | 1220 | 1.0 | 80~200 | fall |
| S c | untreated | 180 | 0.2 | 20~50 | — |

In Table 14, the sample numbers S25 to S28 are substrates obtained by changing the treating temperature in the heating step and the hardening treatment step.

As shown in Table 14, after the surface treatment, the sample number S25 (treating temperature: 650° C.) had an average surface roughness Ra and a crystal grain size Rc equivalent to those of the untreated pure titanium substrate (sample number Sc) and retained good appearance quality. However, it showed a low Vickers hardness Hv of 330 at a depth of 1.0 μm from the surface. Although the sample number S28 (treating temperature: 830° C.) had a high Vickers hardness Hv of 1220 at a depth of 1.0 μm from the surface, it had a large average surface roughness Ra of 1.0 μm and a large grain size Rc of 80 to 200 μm, and marked surface roughening was observed. This surface roughening deviates from the tolerance in the use of the substrate as a decorative article.

In contrast, the sample numbers S26 and S27 had a sufficiently high Vickers hardness Hv of 780 to 840 at a depth of 1.0 μm from the surface, an average surface roughness Ra of 0.25 to 0.3 μm and a crystal grain size Rc of 30 to 60 μm, retaining good appearance quality equivalent to that of the untreated pure titanium substrate (sample number Sc). In the sample numbers S26 and S27, the nitrogen content and the oxygen content in the 1.0 μm depth portion from the surface were 0.6 to 8.0% by weight and 1.0 to 14.0% by weight, respectively, similar to the substrates of the sample numbers S2 and S3 in Table 8. Presumably, the first hardened layer 102 shown in FIG. 17 has been formed.

Since the oxygen content in the 20 μm depth portion from the surface was 0.5 to 14.0% by weight, presumably the second hardened layer 103 shown in FIG. 17 has been also formed.

In this embodiment, the heating step was achieved in an argon atmosphere at atmospheric pressure or in a helium atmosphere at atmospheric pressure, but the atmosphere is not necessarily restricted to these, and the heating step may be carried out under vacuum.

In this embodiment, the cooling step was carried out in an argon atmosphere at atmospheric pressure or in a helium atmosphere at atmospheric pressure, but the atmosphere is not necessarily restricted to these, and the cooling step may be carried out under vacuum.

The present invention is not restricted to the embodiments described above. In each of the above embodiments, the titanium substrate was heated using the heater 3 to diffuse nitrogen and oxygen so as to form a solid solution. However, plasma may be used to diffuse nitrogen and oxygen in the titanium substrate so as to form a solid solution.

The mixed gas containing nitrogen as a main component and a slight amount of an oxygen component, that is fed to the vacuum chamber 1 in the hardening treatment step, is not restricted to the mixed gas used in the above-mentioned each embodiment. A mixed gas obtained by adding various gases containing an oxygen component such as nitrogen monoxide, nitrogen dioxide, carbon monoxide or carbon dioxide to a nitrogen gas is also employable. To the mixed gas, a slight amount of an inert gas such as helium, neon or argon or a gas containing a hydrogen component, a boron component or a carbon component may be further added.

In the above-mentioned each embodiment, the treating time of the heating step was 30 minutes, but the treating time is not restricted thereto, and it may be arbitrarily determined in the range of 30 minutes to 2 hours.

In the above-mentioned each embodiment, further, the treating time of the hardening treatment step was 5 hours, but the treating time is not restricted thereto, and it may be arbitrarily determined. However, if the treating time of the hardening treatment step is shorter than 1 hour, diffusion of nitrogen and oxygen so as to form a solid solution does not proceed sufficiently, and there is a fear that necessary hardness is not obtained. On the other hand, if the treating time of the hardening step is longer than 10 hours, surface roughening is liable to occur on the titanium tableware. Therefore, the treating time of the hardening treatment step is preferably in the range of 1 to 10 hours.

EXAMPLE

Example 1

Figure 21:
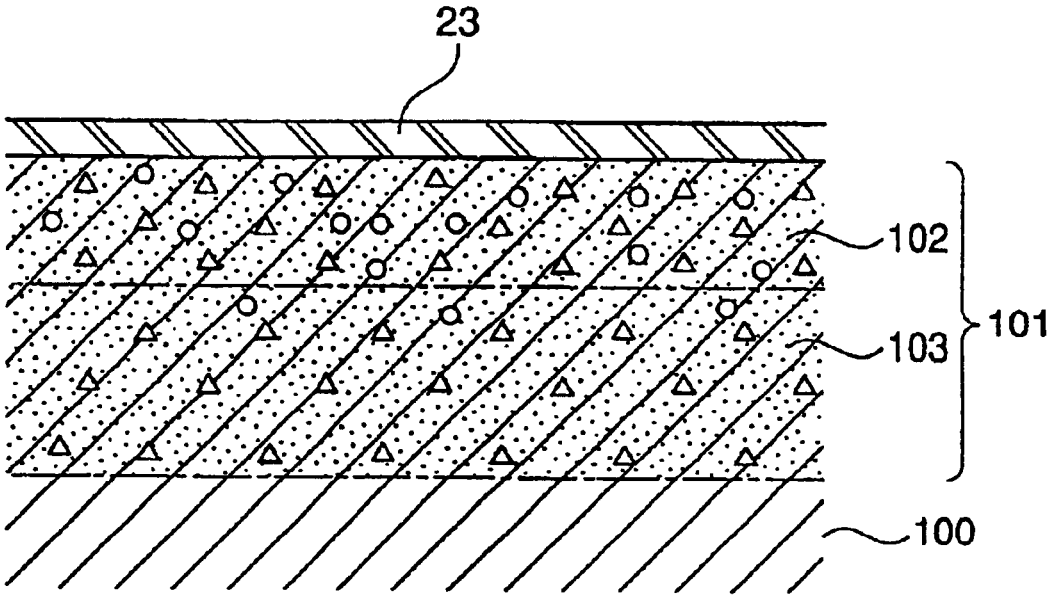
FIG. 21 is a schematic view showing a structure of a camera body in Example 1 of the substrate having a hard decorative coating film according to the invention and the process for producing the same.

A titanium substrate having an internal hardened layer formed as described above is coated with a hard decorative coating film of a gold color tone. This operation is described below with reference to FIG. 21.

As shown in the figure, on the internal hardened layer 101 formed on the surface of a camera body (substrate 100), a TiN coating film 23 made of titanium nitride is formed as a hard decorative coating film of a gold color by ion plating that is a dry plating method.

The process to form the TiN coating film 23 is described below.

First, the camera body having the internal hardened layer 101 formed thereon was washed with an organic solvent such as isopropyl alcohol and placed in an ion plating device (not shown). The ion plating device may be a device generally used, so that description of the device is omitted herein.

Then, the device was evacuated to a pressure of $1.0\times10^{-5}$ Torr, and an argon gas (inert gas) was introduced into the device until the pressure became $3.0\times10^{-3}$ Torr.

Subsequently, a thermionic filament and a plasma electrode equipped in the device were driven to generate plasma of argon. At the same time, an electric potential of −50 V was applied to the camera body 100 to perform bombard cleaning for 10 minutes.

Then, introduction of the argon gas was stopped, and a nitrogen gas was introduced into the device until the pressure became $2.0\times10^{-3}$ Torr.

After plasma was generated by a plasma gun equipped in the device, titanium was vaporized for 10 minutes to form a TiN coating film 23 of 0.5 $\mu$m thickness on the internal hardened layer 101 of the camera body.

The camera body thus obtained showed a uniform gold color tone because the TiN coating film 23 had optical properties similar to those of gold. Owing to this, the decorative value of the camera body could be further enhanced.

The surface hardness (Hv) of the camera body coated with the TiN coating film 23 went up to 800 under a load of 100 g. The camera body coated with the TiN coating film 23 had excellent abrasion resistance, corrosion resistance and mar resistance. Moreover, even when a strong force was applied to the coating film surface, irregularities were rarely formed on the substrate surface and separation of the coating film did not occur.

As described above, by formation of the TiN coating film 23 harder than the internal hardened layer 101, the camera body having been subjected to surface hardening treatment could not get marred easily.

The dry plating method is not restricted to the above-mentioned ion plating, and various means publicly known such as sputtering and vacuum deposition are employable.

As the hard coating film of a gold color to be formed by the dry plating method, adoptable is a hard coating film made of a nitride, a carbide, an oxide, a nitrido-carbide or a nitrido-carbido-oxide of a 4a, 5a or 6a Group element (Ti, Zr, Hf, V, Nb, Ta, Cr, Mo, W) of the periodic table.

When the 4a, 5a or 6a Group element of the periodic table is represented by M and a nitride of the element M is represented by MNx, the coating film of the nitride MNx of the element M comes closer to a light yellow color from a gold color as the x value which indicates the degree of nitriding becomes smaller than 1. As the x value indicating the degree of nitriding becomes larger than 1, the gold color of the coating film is more tinted with red. When the x value is in the range of 0.9 to 1.1, a coating film of the nitride MNx showing a gold color close to the color of gold or a gold alloy can be formed. Especially when the x value indicating the degree of nitriding is 1, the coating film of the nitride MNx of the element M is a hard decorative coating film not only having a sufficient hardness but also showing a gold color closest to the color of gold or a gold alloy.

Similarly to the above, by controlling the degree of carbonization, oxidation or nitriding of the nitride, carbide, oxide, nitrido-carbide or nitrido-carbido-oxide of a 4a, 5a or 6a Group element of the periodic table in the given range, the coating film thereof can be imparted with a gold color closest to the color of gold or a gold alloy. Particularly, a TiN coating film and a ZrN coating film are preferable because each of them is a hard decorative coating film not only having a sufficient hardness but also showing a gold color closest to the color of gold or a gold alloy.

When the thickness of the film of the nitride MNx of the element M is too small, the coating film cannot have effective abrasion resistance, corrosion resistance and mar resistance. On the other hand, when the thickness of the coating film is too large, the time for film formation is long, and the cost of the coating film becomes high. Therefore, the thickness of the coating film of the nitride MNx of the element M is controlled to be in the range of preferably 0.1 to 10 $\mu$m, more preferably 0.2 to 5 $\mu$m.

Example 2

Figure 22:
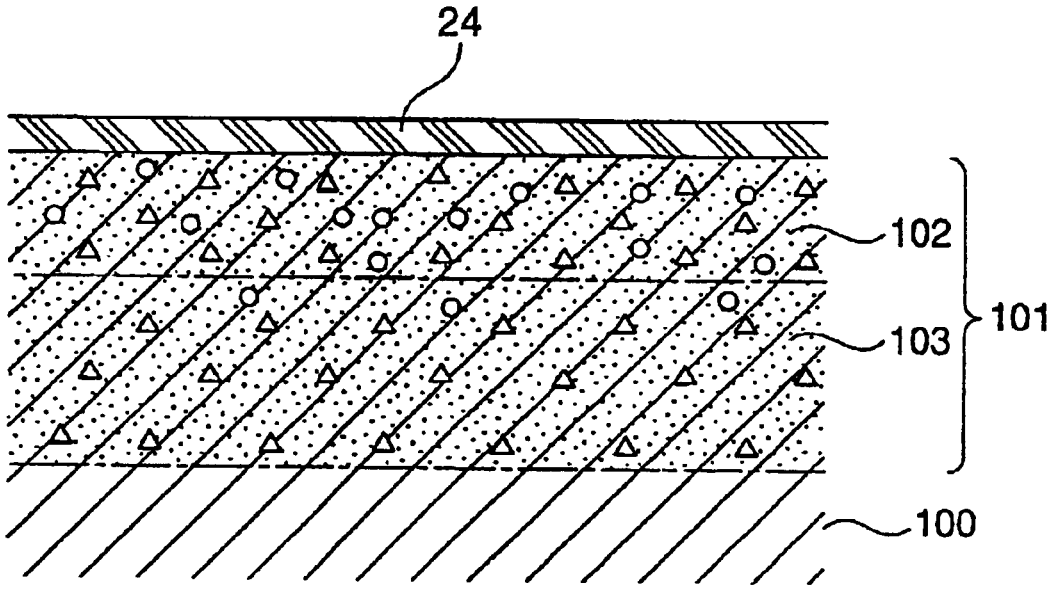
FIG. 22 is a schematic view showing a structure of a cellular telephone body in Example 2 of the substrate having a hard decorative coating film according to the invention and the process for producing the same.

A cellular telephone body (titanium substrate 100) having an internal hardened layer formed in the same manner as in Example 1 is coated with a hard decorative coating film of a color tone different from that of Example 1. This operation is described below with reference to FIG. 22.

As shown in the figure, on the internal hardened layer 101 formed on the surface of the cellular telephone body, a TiC coating film 24 made of titanium carbide is formed as a hard decorative coating film of a white color tone by a dry plating method. That is, using an ion plating method that is a dry plating method, titanium was vaporized in an ethylene gas atmosphere to coat the surface of the cellular telephone body with a TiC coating film 24. Other coating conditions were the same as those used in Example 1.

The cellular telephone body thus obtained showed a uniform white color tone because it was coated with the TiC coating film 24. Owing to this, the decorative value of the cellular telephone body could be further increased. The surface hardness (Hv) of the cellular telephone body coated with the TiC coating film 24 went up to 800 under a load of 100 g. The cellular telephone body coated with the TiC coating film 24 had excellent abrasion resistance, corrosion resistance and mar resistance.

As described above, by forming the TiC coating film 24 harder than the internal hardened layer 101, the cellular telephone body having been subjected to surface hardening could not get marred easily.

Example 3

Figure 23:
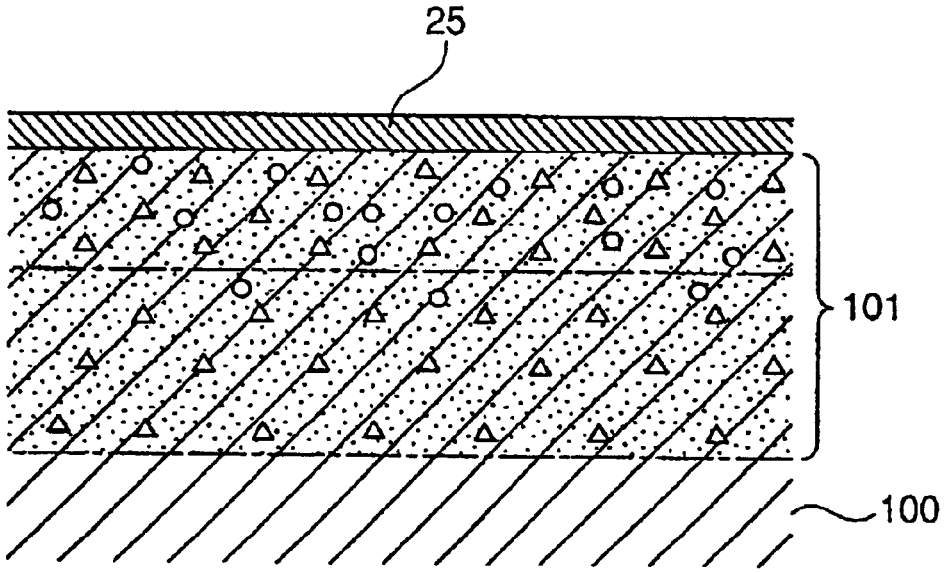
FIG. 23 is a schematic view showing a structure of a portable radio body in Example 3 of the substrate having a hard decorative coating film according to the invention and the process for producing the same.
Figure 24:
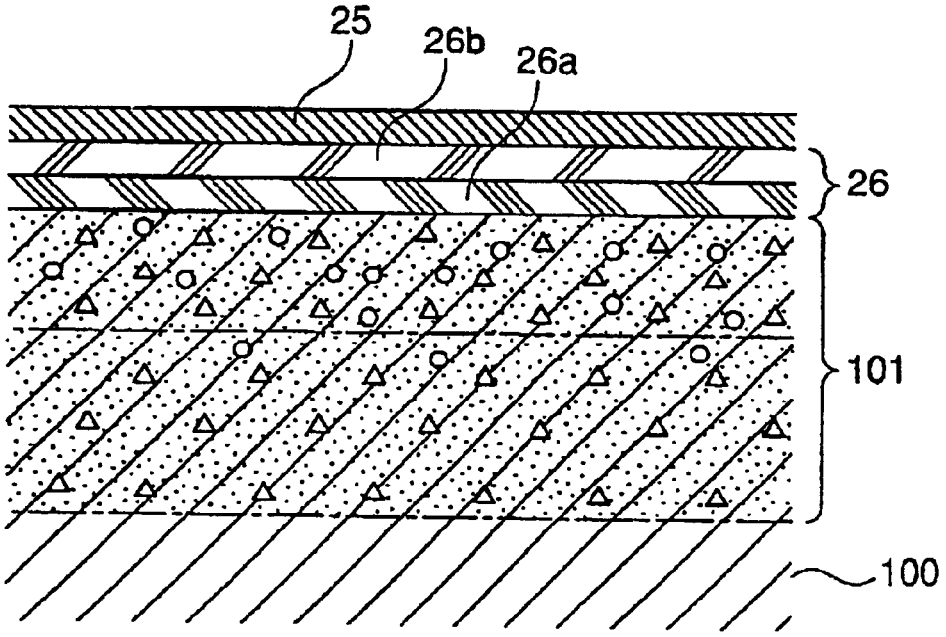
FIG. 24 is a schematic view showing a structure of a portable radio body in Example 3 of the substrate having a hard decorative coating film according to the invention and the process for producing the same.

On a portable radio body (titanium substrate 100) having an internal hardened layer formed in the same manner as in Example 1, a hard carbon coating film is formed as a hard decorative coating film of a black color tone. Since the hard carbon coating film has excellent properties similar to those of diamond, the film is widely known as diamond-like carbon (DLC). This operation is described below with reference to FIG. 23.

As shown in the figure, on the internal hardened layer 101 formed on the surface of the portable radio body, a hard carbon coating film 25 of a black color is formed by a dry plating method.

The process to form the hard carbon coating film 25 is, for example, as follows.

First, the portable radio body having the internal hardened layer 101 was washed with an organic solvent such as isopropyl alcohol and placed in a vacuum device. Using a high-frequency plasma CVD method, a hard carbon coating film (carbon hard decorative coating film) 25 of 2 μm thickness was formed on the internal hardened layer 101 under the following conditions.

Conditions of Hard Carbon Coating Film Formation

Type of gas: methane gas

Film-forming pressure: 0.1 Torr

High-frequency power: 300 W

Film-forming rate: 0.1 μm/min

Through the above operation, a hard carbon coating film 25 was formed on the internal hardened layer 101 with high bond strength.

The portable radio body thus obtained showed a uniform black color tone because it was coated with the hard carbon coating film 25. Owing to this, the decorative value of the portable radio body could be further increased.

The surface hardness (Hv) of the portable radio body coated with the hard carbon coating film 25 went up to 3000 to 5000. By forming the coating film 25 harder than the internal hardened layer 101, the portable radio body having been subjected to surface hardening could not get marred easily.

The thickness of the hard carbon coating film 25 is controlled to be in the range of preferably 0.1 to 3.0 μm, more preferably 0.5 to 2.5 μm.

To form the hard carbon coating film 25, not only the RFP-CVD method but also other various gas phase film forming methods such as DC plasma CVD method and ECR method are also employable. Further, physical deposition methods such as ion beam method, sputtering and ion plating are also adoptable.

It is preferable to form an intermediate layer coating film 26 between the internal hardened layer 101 and the hard carbon coating film 25, because the hard carbon coating film 25 can be more strongly bonded to the surface of the substrate.

The process to form the intermediate layer 26 is, for example, as follows.

On the internal hardened layer 101, a Ti coating film 26*a* of 0.1 μm thickness mainly made of titanium was formed as a lower layer by a dry plating method such as sputtering. Then, on the Ti coating film 26*a*, a Si coating film 26*b* of 0.3 μm thickness mainly made of silicon was formed as an upper layer by sputtering.

Thereafter, on the Si coating film 26*b*, the hard carbon coating film 25 of 2 μm thickness is formed under the aforesaid conditions by, for example, a high-frequency plasma CVD method.

The Ti coating film 26*a* can be replaced with a chromium (Cr) coating film. The Si coating film 26*b* can be replaced with a germanium (Ge) coating film.

Further, an upper layer mainly made of any one of tungsten, tungsten carbide, silicon carbide and titanium carbide can be adopted instead of the Si coating film 26*b* (upper layer) mainly made of silicon.

Instead of such a laminated coating film, a single layer made of a carbide of a IVa or Va Group metal may be formed as the intermediate layer. A titanium carbide coating film containing excess carbon is particularly preferable because it has high bond strength to the carbon hard decorative coating film.

Example 4

A part of the surface of a video camera body (titanium substrate 100) having an internal hardened layer formed in the same manner as in Example 1 is coated with a hard decorative coating film of a gold color tone. This operation is described below with reference to FIG. 25 to FIG. 27.

Figure 26:
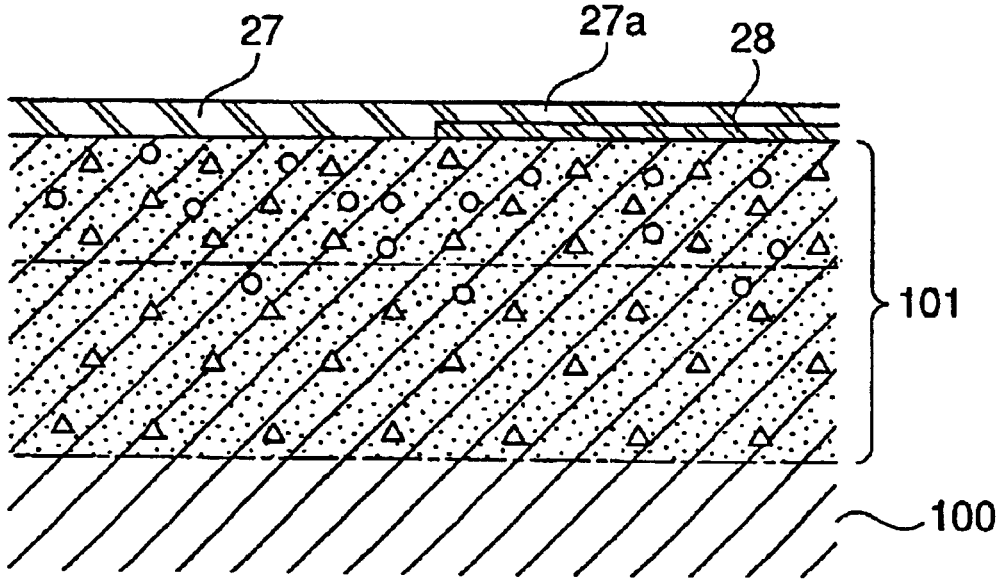
FIG. 26 is a schematic view showing a process for surface treatment of a video camera body in Example 4 of the substrate having a hard decorative coating film according to the invention and the process for producing the same.
Figure 27:
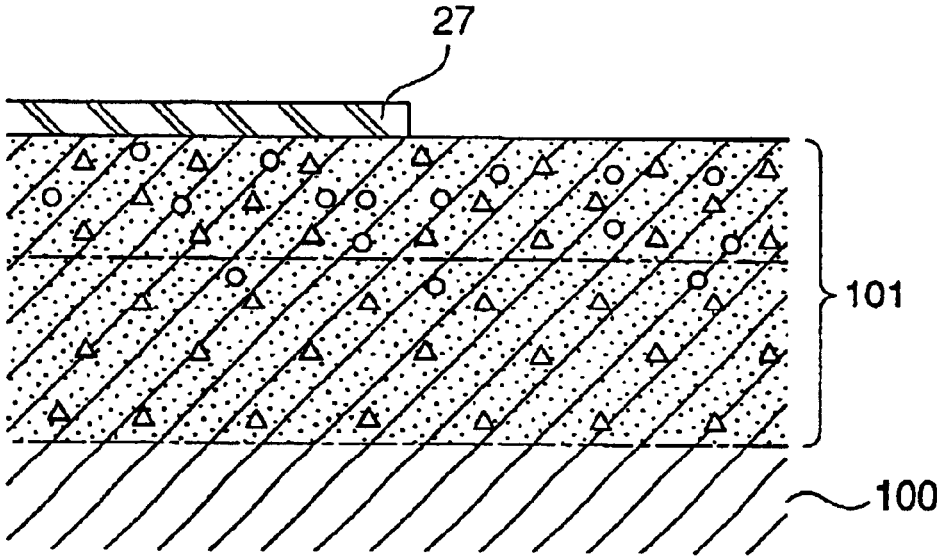
FIG. 27 is a schematic view showing a structure of a video camera body in Example 4 of the substrate having a hard decorative coating film according to the invention and the process for producing the same.

As shown in FIG. 26, on a part of the surface of the video camera body, a TiN coating film 27 made of titanium nitride is formed as a hard decorative coating film of a gold color tone by ion plating that is a dry plating method.

The process to partially form the TiN coating film 27 of a gold color is described below.

Figure 25:
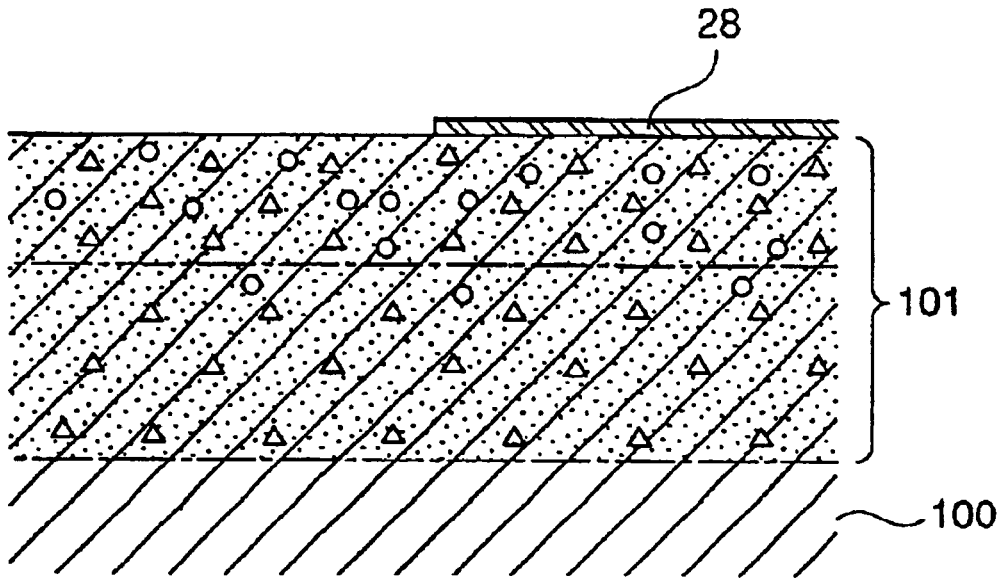
FIG. 25 is a schematic view showing a process for surface treatment of a video camera body in Example 4 of the substrate having a hard decorative coating film according to the invention and the process for producing the same.

First, on the desired surface area of the video camera body having the internal hardened layer 101 formed thereon, an organic maskant comprising an epoxy resin or a masking ink was printed to form a masking layer 28, as shown in FIG. 25.

Then, the video camera body having the masking layer 28 formed thereon was washed with an organic solvent such as isopropyl alcohol and placed in an ion plating device.

The ion plating device may be a device generally used, so that description of the device is omitted herein.

Subsequently, the device was evacuated to a pressure of $1.0\times10^{-5}$ Torr, and an argon gas (inert gas) was introduced into the device until the pressure became $3.0\times10^{-3}$ Torr.

Then, a thermionic filament and a plasma electrode equipped in the device were driven to generate plasma of argon. At the same time, an electric potential of −50 V was applied to the video camera body to perform bombard cleaning for 10 minutes.

Then, introduction of the argon gas was stopped, and a nitrogen gas was introduced into the device until the pressure became $2.0\times10^{-3}$ Torr. After plasma was generated by a plasma gun equipped in the device, titanium was vaporized for 10 minutes. Through the above operation, a TiN coating film 27 of 0.5 μm thickness was formed on the surface of the hardened layer 101 of the video camera body and a TiN coating film 27*a* of 0.5 μm thickness was formed on the surface of the masking layer 28 of the video camera body, as shown in FIG. 26.

Then, the masking layer 28 was swollen with ethyl methyl ketone (EMK) or a release solution obtained by adding formic acid and hydrogen peroxide to ethyl methyl ketone (EMK), and the masking layer 28 and the TiN coating film 27*a* laminated thereon were removed by a lift off method.

By the removal operation, a video camera body having a portion coated with the TiN coating film 27 showing a gold color tone and a portion coated with no TiN coating film showing a silver color tone was obtained. Owing to this, the decorative value of the video camera body could be increased.

As the masking means, not only the chemical masking layer described above in this example but also a mechanical masking means may be used. That is, prior to the formation of the titanium nitride coating film, the desired portion of the video camera body is covered with a cap. Then, the titanium nitride coating film is formed, followed by removing the cap. As a result, the portion of the video camera body having been covered with the cap is not coated with a titanium nitride coating film, while the portion having been covered with no cap is coated with a titanium nitride coating film.

In this example, a titanium nitride coating film is used as the hard decorative coating film to be formed on a part of the surface of the video camera body. As described in Example 1, however, a coating film made of a nitride, a carbide, an oxide, a nitrido-carbide or a nitrido-carbido-oxide of a 4a, Sa or 6a Group element of the periodic table is adoptable as the hard decorative coating film of a gold color formed by the dry plating method.

In particular, the surface of the video camera body may be partially coated with the titanium carbide coating film used in Example 2. In this case, obtainable is a video camera body having a portion coated with titanium carbide coating film and showing a white color tone and a portion coated with no titanium carbide coating film and showing a silver color tone of titanium or titanium alloy.

The hard carbon coating film used in Example 3 may be used as a hard decorative coating film to be formed on a part of the surface. In this case, obtainable is a video camera body having a portion coated with the hard carbon coating film and showing a black color tone and a portion coated with no hard carbon coating film and showing a silver color tone of titanium or a titanium alloy.

Example 5

Figure 28:
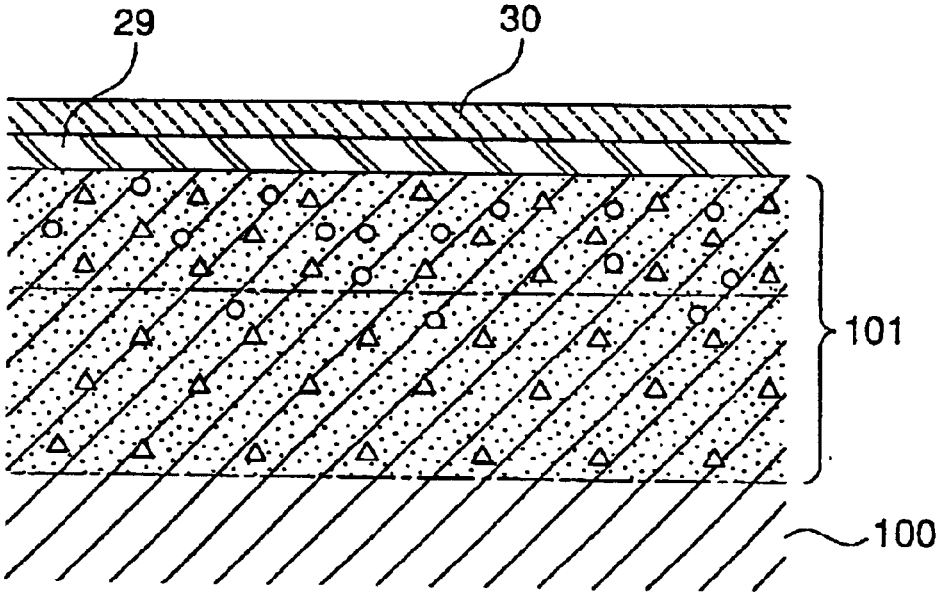
FIG. 28 is a schematic view showing a structure of a lighter body in Example 5 of the substrate having a hard decorative coating film according to the invention and the process for producing the same.

On the surface of a lighter body (titanium or titanium alloy steel substrate 100) having an internal hardened layer formed in the same manner as in Example 1, a hard decorative coating film of a gold color tone is formed On the hard decorative coating film of a gold color, a gold alloy coating film is further formed. This operation is described below with reference to FIG. 28.

As shown in the figure, on the surface of the lighter body having the internal hardened layer 101, a TiN coating film 29 made of titanium nitride is formed as a hard decorative coating film of a gold color by ion plating that is a dry plating method. Then, on the TiN coating film 29, a gold-titanium alloy coating film 30 is formed as a gold alloy coating film.

The process to form the TiN coating film 29 and the gold-titanium alloy coating film 30 in this example is described below.

First, the lighter body having the internal hardened layer 101 formed thereon was washed with an organic solvent such as isopropyl alcohol and placed in an ion plating device. The ion plating device may be a device generally used, so that description of the device is omitted herein.

Subsequently, the device was evacuated to a pressure of $1.0\times10^{-5}$ Torr, and an argon gas (inert gas) was introduced into the device until the pressure became $3.0\times10^{-3}$ Torr.

Then, a thermionic filament and a plasma electrode equipped in the device were driven to generate plasma of argon. At the same time, an electric potential of −50 V was applied to the lighter body to perform bombard cleaning for 10 minutes.

After plasma was generated by a plasma gun equipped in the device, titanium was vaporized for 10 minutes to form a TiN coating film 29 of 0.5 $\mu$m thickness on the whole surface of the lighter body.

Then, vaporization of titanium and introduction of the argon gas were stopped, and the device was evacuated to a pressure of $1.0\times10^{-5}$ Torr.

Then, an argon gas was introduced into the device until the pressure became $1.0\times10^{-3}$ Torr to generate plasma, and a gold-titanium mixture composed of gold of 50% by atom and titanium of 50% by atom was vaporized to form a gold-titanium alloy coating film 30. When the thickness of the gold-titanium alloy coating film 30 became 0.3 $\mu$m, vaporization of the gold-titanium mixture was stopped.

The lighter body thus obtained had a uniform gold color tone. Owing to this, the decorative value of the lighter body could be enhanced. By forming the gold-titanium alloy coating film 30 as the outermost layer, a lighter body showing a gold color tone, that is a warmer gold color than that of the TiN coating film 29 was obtained. Owing to this, the appearance of the lighter body could be further improved.

In general, the gold alloy coating film itself cannot have effective abrasion resistance, corrosion resistance and mar resistance, unless the thickness thereof is a large one exceeding 10 $\mu$m. Gold is an extremely expensive metal. Therefore, formation of a gold alloy coating film having a large thickness greatly increases the cost of the coating film. In this example, however, a hard TiN coating film was formed under the gold alloy coating film that is an outermost layer. Since the TiN coating film has excellent abrasion resistance, corrosion resistance and mar resistance, the gold alloy coating film as the outermost layer may be thin. Owing to this, the amount of expensive gold used can be decreased, and thereby the cost of the coating film can be cut down.

There is a possibility that the outermost layer of the thin gold alloy coating film is partially abraded to expose the TiN coating film outside, but any abrasion locally made on the outermost layer is not conspicuous because the TiN coating film has optical properties similar to those of gold and shows a gold color tone. Beneath the abraded portion of the outermost layer of the gold alloy coating film showing a gold color tone, the TiN coating film showing the same gold color tone appears. Accordingly, even if the outermost layer of the gold alloy coating film is made thin, its abrasion is not visually observed, and the beautiful appearance and the decorative value can be maintained.

In this example, a titanium nitride coating film was used as the hard decorative coating film. However, a coating film made of a nitride, a carbide, an oxide, a nitrido-carbide or a nitrido-carbido-oxide of a 4a, 5a or 6a Group element of the periodic table is employable as the hard decorative coating film of a gold color formed by the dry plating method.

Other than the gold-titanium alloy coating film, a coating film made of an alloy of gold and at least one metal selected from the group of consisting from Al, Si, V, Cr, Fe, Co, Ni, Cu, Zn, Ge, Y, Zr, Nb, Mo, Ru, Rh, Pd, Ag, Cd, In, Sn, Hf, Ta, W, Ir and Pt can be formed as the gold alloy coating film.

However, if a lighter body coated with a coating film of a gold alloy selected from some combinations of the above metals is brought into contact with the skin, elution of a metallic ion is caused by an electrolyte liquid such as sweat, and as a result, the skin in contact with the lighter body may suffer metallic allergy. Particularly, a nickel ion eluted is known as a metallic ion causing the most cases of metallic allergies. In contrast, iron is a metal causing extremely ascribable to a titanium metal has not been reported yet. From the viewpoint of the metallic allergy, therefore, a gold-iron alloy coating film or a gold-titanium coating film is preferable as the gold alloy coating film used as the outermost layer coating film.

Example 6

Figure 29:
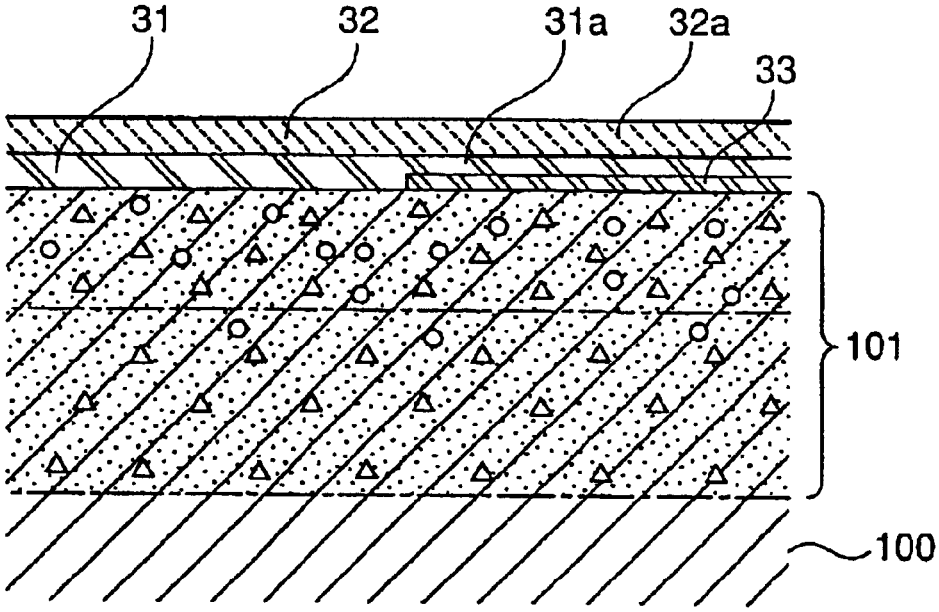
FIG. 29 is a schematic view showing a process for surface treatment of a personal computer main body in Example 6 of the substrate having a hard decorative coating film according to the invention and the process for producing the same.
Figure 30:
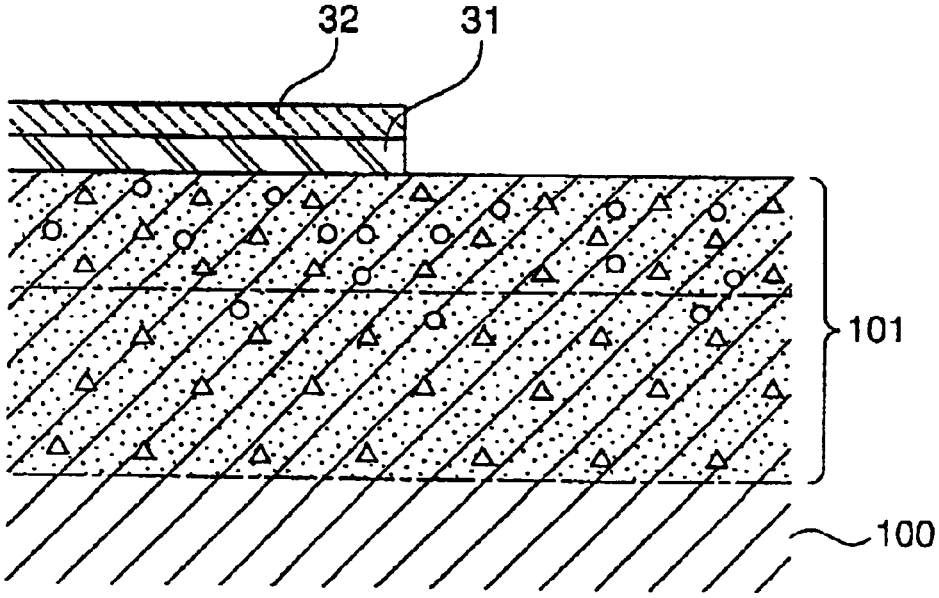
FIG. 30 is a schematic view showing a structure of a personal computer main body in Example 6 of the substrate having a hard decorative coating film according to the invention and the process for producing the same.

On only the hard decorative coating film of a gold color tone described in Example 4, which is formed on a part of the surface of the substrate, the gold alloy coating film described in Example 5 may be formed. This example is shown in FIG. 29 and FIG. 30.

The process to partially form a TiN coating film 31 made of titanium nitride as the hard decorative coating film of a gold color tone and to form a gold-titanium alloy coating film 32 as the gold alloy coating film is briefly described below.

First, on the desired surface area of a personal computer main body (titanium substrate 100) having an internal hardened layer 101, an organic maskant comprising an epoxy resin or a masking Ink was printed to form a masking layer 33.

Then, the personal computer main body having the masking layer 33 formed thereon was washed with an organic solvent such as isopropyl alcohol and placed in an ion plating device.

Using an ion plating method that is a dry plating method, a TiN coating film 31, 31*a* of 0.5 μm thickness was formed on the surface of the internal hardened layer 101 and the surface of the masking layer 33 of the personal computer main body.

Subsequently, on the TiN coating film 31, 31*a*, a gold-titanium alloy coating film 32, 32*a* of 0.3 μm thickness was formed.

Then, the personal computer main body was immersed in ethyl methyl ketone (EMK) or a release solution obtained by adding formic acid and hydrogen peroxide to ethyl methyl ketone (EMK) to wet the masking layer 33, and the masking layer 33, the TiN coating film 31*a* laminated thereon and the gold-titanium alloy coating film 32*a* were removed by a lift off method.

By the removal operation, a personal computer main body having a portion coated with the TiN coating film 31 and the gold-titanium alloy coating film 32 and showing a gold color tone and a portion coated with no TiN coating film and no gold-titanium alloy coating film and showing a silver color tone of titanium or a titanium alloy steel was obtained.

Also in this example, various hard decorative coating films other than the titanium nitride coating film are employable, as described in Example 5. Further, various gold alloy coating films other than the gold-titanium alloy coating film are also employable.

Example 7

On the surface of a substrate having an internal hardened layer formed in the same manner as in Example 1, a first hard decorative coating film is formed. On a part of the surface of the first hard decorative coating film, a second hard decorative coating film showing a color different from that of the first decorative coating film is further formed. This operation is described below with reference to FIG. 31 to FIG. 33.

Figure 31:
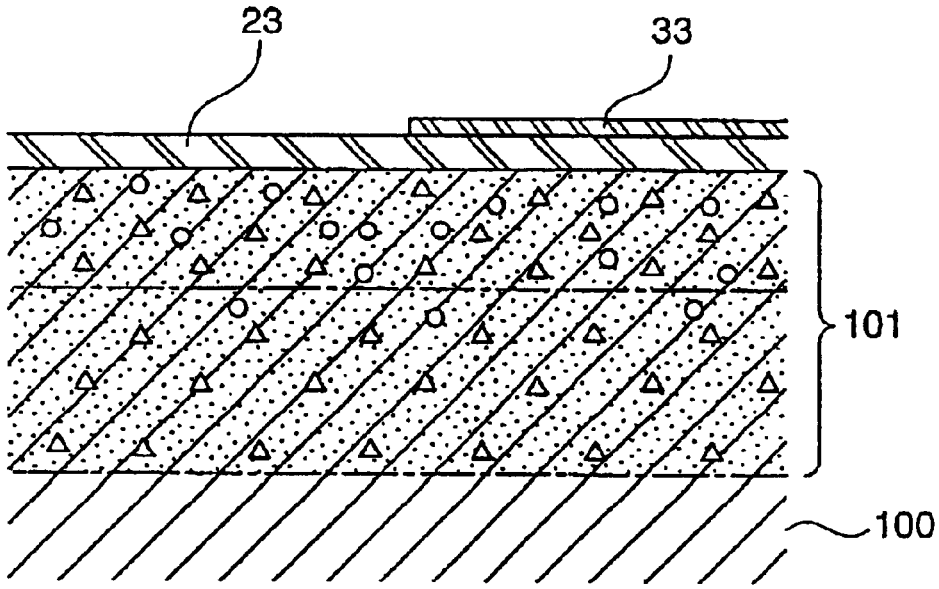
FIG. 31 is a schematic view showing a process for surface treatment of a watch case in Example 7 of the substrate having a hard decorative coating film according to the invention and the process for producing the same.

As shown in FIG. 31, on the surface of a watch case (substrate 100) having an internal hardened layer 101, a TiN coating film 23 of a gold color tone made of titanium nitride was formed as a first hard decorative coating film in the same manner as in Example 1. On the desired area of the surface of the TiN coating film 23, an organic maskant comprising an epoxy resin or a masking ink was printed to form a masking layer 33.

Figure 32:
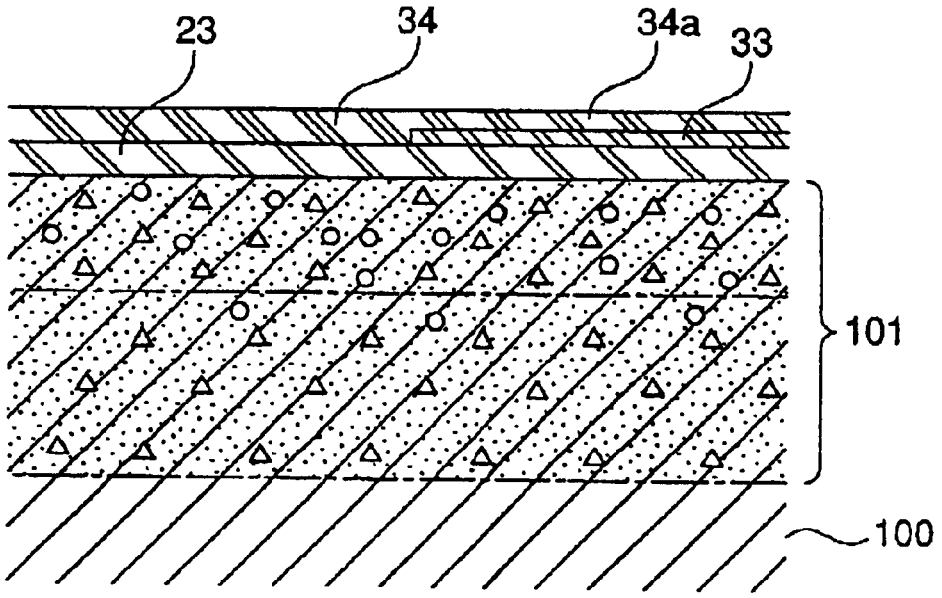
FIG. 32 is a schematic view showing a process for surface treatment of a watch case in Example 7 of the substrate having a hard decorative coating film according to the invention and the process for producing the same.

Then, as shown in FIG. 32, a TiC coating film 34 of a white color tone made of titanium carbide was formed as the second hard decorative coating film on the surface of the TiN coating film 23 in the same manner as in Example 2, and a TiC coating film 34*a* was formed on the surface of the masking layer 33 in the similar manner.

Subsequently, the substrate 100 was immersed in a release solution to wet the masking layer 33, and the masking layer 33 and the TiC coating film 34*a* laminated thereon were removed by a lift off method.

Figure 33:
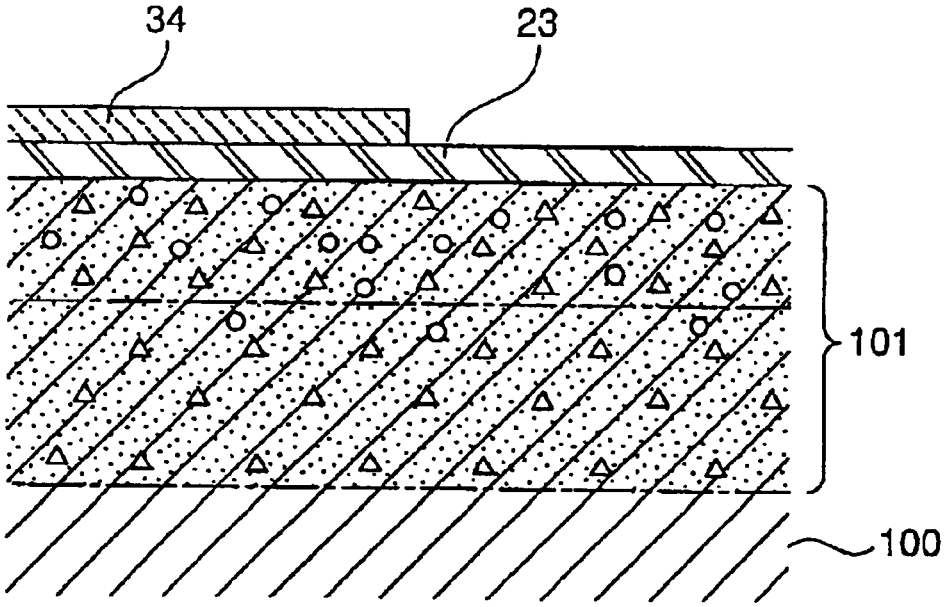
FIG. 33 is a schematic view showing a structure of a watch case in Example 7 of the substrate having a hard decorative coating film according to the invention and the process for producing the same.

By the removal operation, as shown in FIG. 33, the TiC coating film 34 of a white color was laminated on a part of the surface of the TiN coating film 23 of a gold color. Thus, a watch case having a portion coated with the TiN coating film 23 and showing a gold color tone and a portion coated with the TiC coating film 34 and showing a white color tone was obtained.

Owing to this, the decorative value of the watch case could be further increased. By forming the TiN coating film 23 and the TiC coating film 34 which were harder than the internal hardened layer 101, the watch case having been subjected to surface hardening treatment could not get marred easily.

As the hard decorative coating film in this example, various hard decorative coating films other than the titanium nitride and titanium carbide coating films are adoptable, as described in Example 5. Further, any one of the first hard decorative coating film and the second hard decorative coating film can be replaced with the carbon hard decorative coating film described in Example 3. The type of the masking layer 13 and the type of the release solution can be appropriately selected according to the types of the coating films used.

When the 4a, 5a or 6a Group element of the periodic table is represented by M and a nitride of M is represented by MNx, the first hard decorative coating film and the second hard decorative coating film can be each made to be a MNx coating film. In this case, if these coating films are so formed that the x value indicating the degree of nitriding in the first hard decorative coating film is different from the x value indicating the degree of nitriding in the second hard decorative coating film, the color tones of the first hard decorative coating film and the second hard decorative coating film can be made different from each other. The same shall apply to the carbide, the oxide, the nitrido-carbide and the nitrido-carbido-oxide.

Example 8

On a part of the surface of a substrate having an internal hardened layer formed in the same manner as in Example 1, a first hard decorative coating film is formed. On a different part of the surface of substrate, a second hard decorative coating film showing a color different from that of the first decorative coating film is further formed. This operation is described below with reference to FIG. 34 to FIG. 36.

Figure 34:
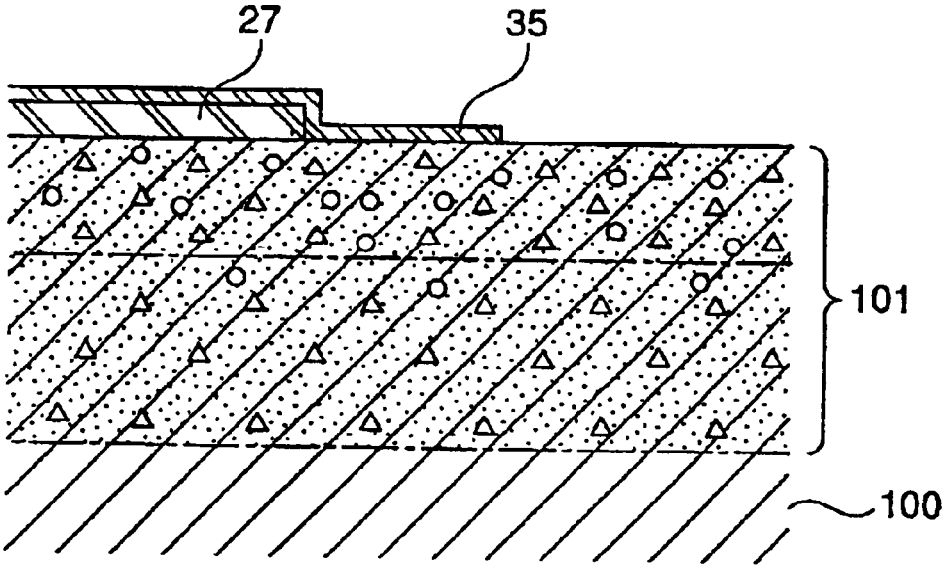
FIG. 34 is a schematic view showing a process for surface treatment of links of a watch band in Example 7 of the substrate having a hard decorative coating film according to the invention and the process for producing the same.

As shown in FIG. 34, a part of the surface of a watch band link (substrate 100) having an internal hardened layer 101 was coated with a TiN coating film 27 of a gold color tone made of titanium nitride as a first hard decorative coating film in the same manner as in Example 4. On the surface of the TiN coating film 27 and its continuous and desired area of the link surface, a masking layer 35 was formed.

Figure 35:
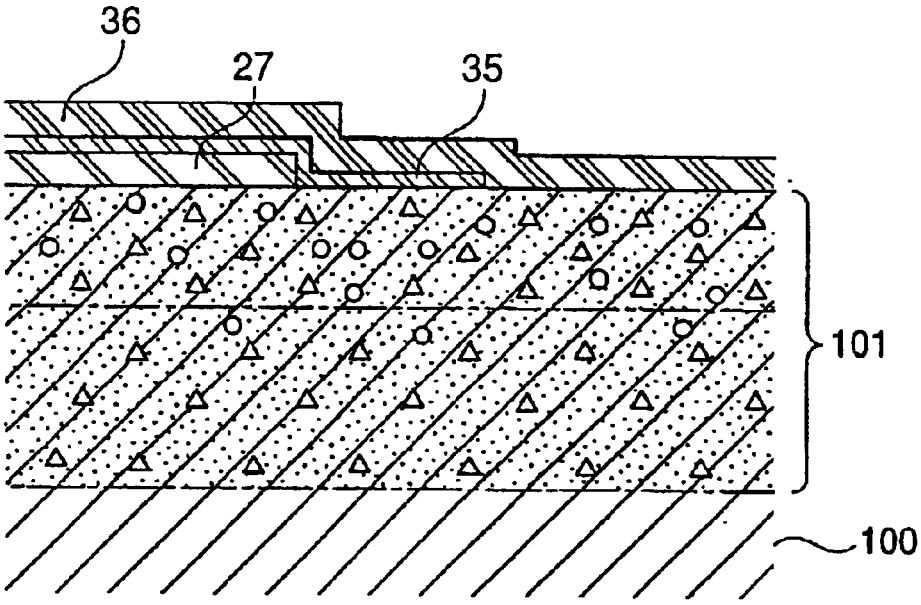
FIG. 35 is a schematic view showing a process for surface treatment of links of a watch case band in Example 8 of the substrate having a hard decorative coating film according to the invention and the process for producing the same.

Then, as shown in FIG. 35, a TiC coating film 36 of a white color tone made of titanium carbide was formed as a second hard decorative coating film on the surface of the TiN coating film 27, the masking layer 35 and the residual area of the link in the same manner as in Example 2.

Subsequently, the substrate 100 was immersed in a release solution to wet the masking layer 35, and the masking layer 35 and the TiC coating film 36 laminated thereon were removed by a lift off method.

Figure 36:
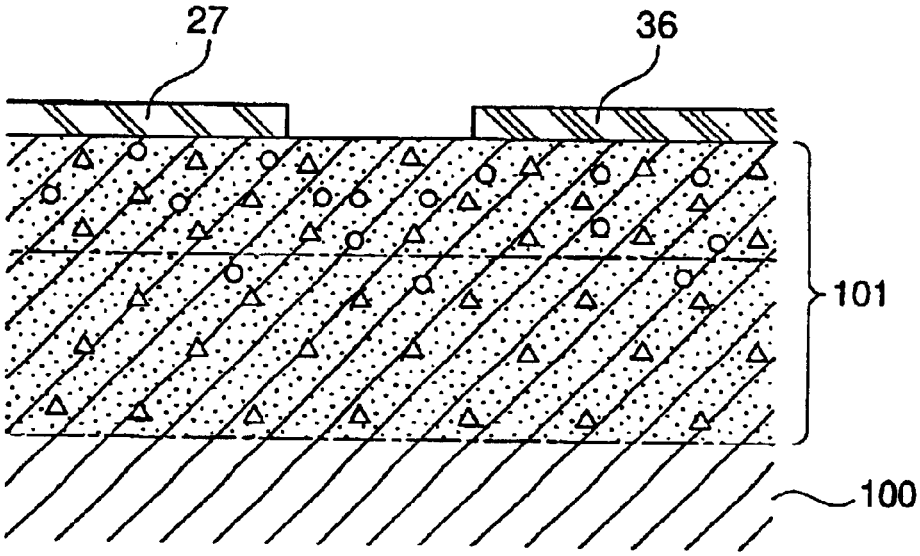
FIG. 36 is a schematic view showing a structure of links of a watch case band in Example 8 of the substrate having a hard decorative coating film according to the invention and the process for producing the same.

By the removal operation, a three-color band having a portion coated with the TiN coating film 27 and showing a gold color tone, a portion coated with the TIC coating film 36 and showing a white color tone and a portion where the surface of the 1 was exposed outside was obtained, as shown in FIG. 36. Owing to this, the decorative value of the band could be further enhanced.

Choices of the first hard decorative coating film and the second hard decorative coating film or choices of the release solution and the masking layer are in accordance with the description of Example 7. The gold alloy coating film described in Example 5 may be formed on any one or both of the first hard decorative coating film and the second hard decorative coating film.

In Examples 2, 4 to 8, ion plating was used as the dry plating method, but other film-forming means publicly known such as sputtering and vacuum deposition are employable.

With respect to the substrates each having a hard decorative coating film which were obtained in Examples 2 to 8, irregularities were rarely formed on the substrate surface and separation of the coating film from the substrate did not occur, even when a strong force was applied to the coating film surface, similarly to the substrate having a hard decorative coating film which was obtained in Example 1.

Cutlery

Next, the cutlery according to the invention is described with reference to the drawings.

Figure 37:
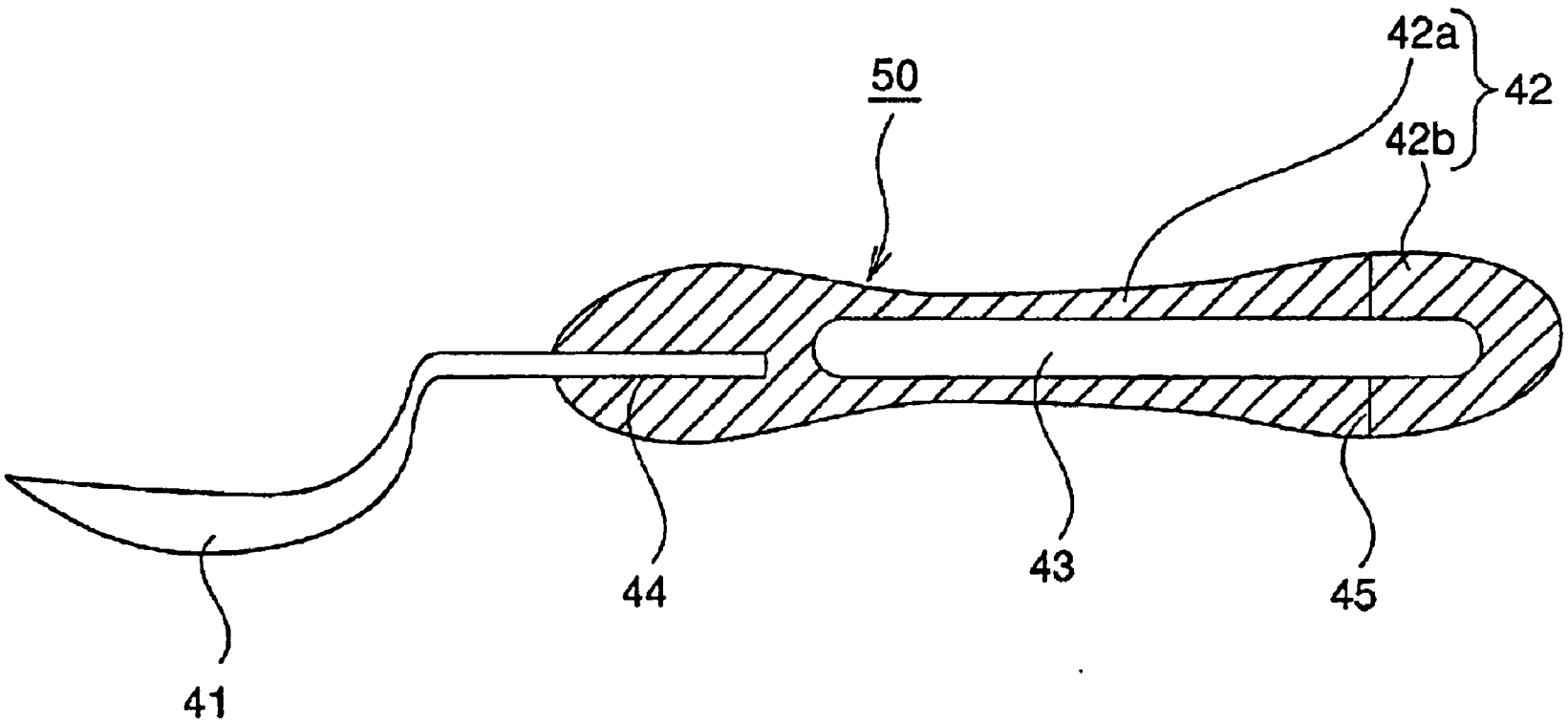
FIG. 37 is a sectional front view of a spoon that is an embodiment of the cutlery of the invention.
Figure 38:
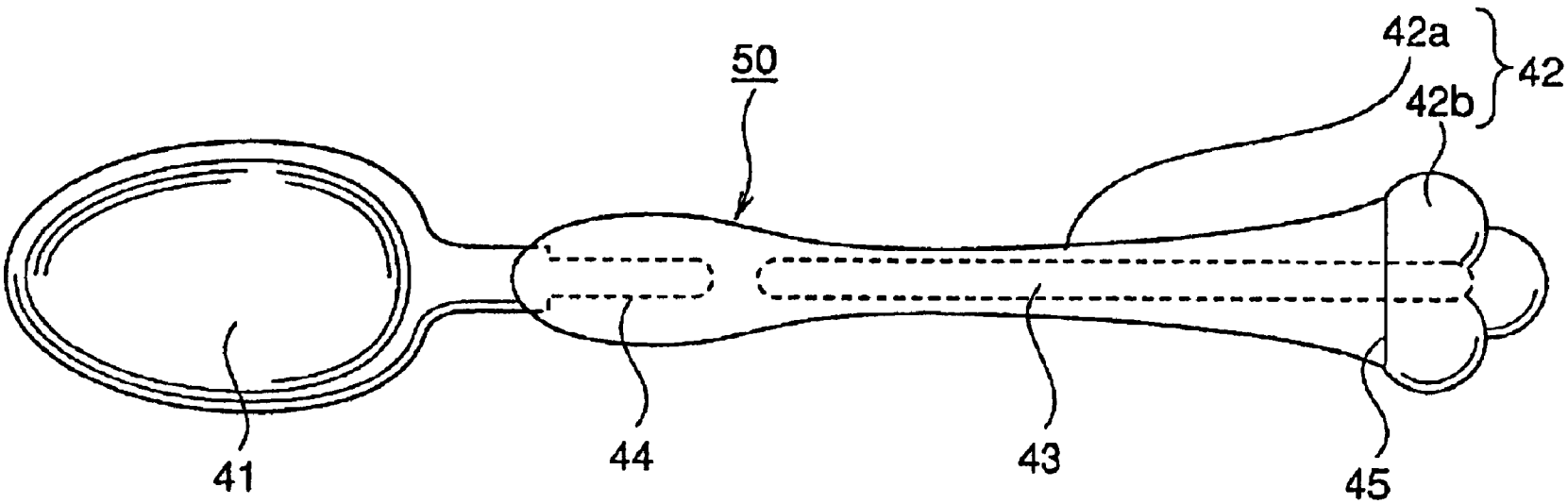
FIG. 38 is a plan view of the spoon of FIG. 37.
Figure 39:
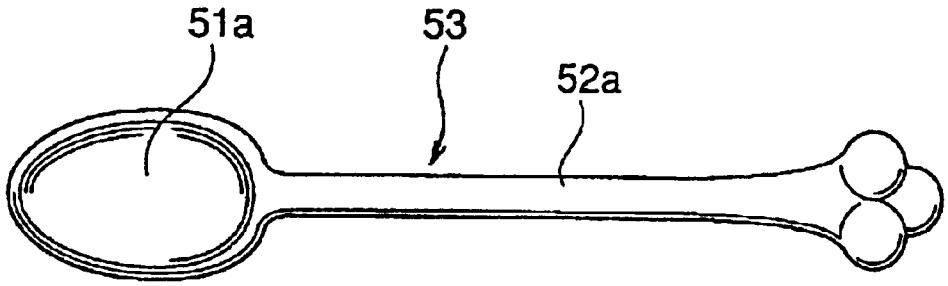
FIG. 39 is a plan view of a conventional spoon.
Figure 40:
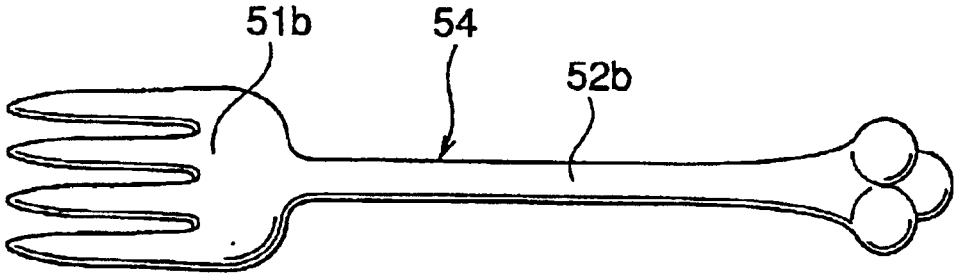
FIG. 40 is a plan view of a conventional fork.
Figure 41:
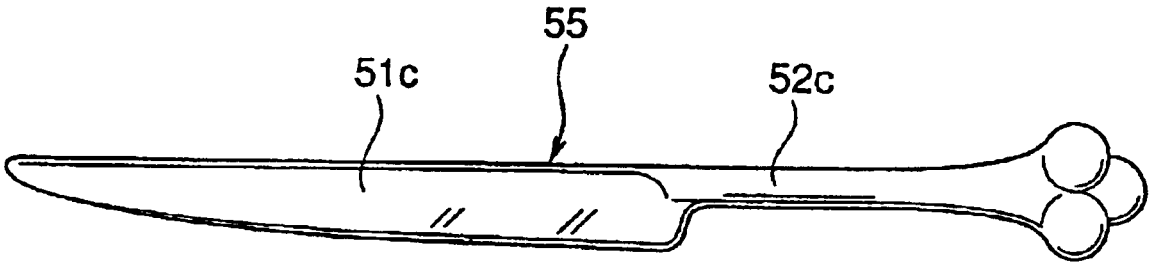
FIG. 41 is a plan view of a conventional knife.

FIG. 37 and FIG. 38 relate to an embodiment of the invention. FIG. 37 is a sectional front view of a spoon, and FIG. 38 is a plan view of the spoon of FIG. 37.

Referring to FIG. 37 and FIG. 38, numeral 41 is a spoon working part (cutlery body) with which food is spooned up to eat. The working part 41 is made of a relatively light metallic member such as a titanium material and has a hardened layer formed in a desired depth from the surface. (The hardened layer is a layer in which nitrogen and oxygen are diffused so as to form a solid solution.) Numeral 42 is a grip comprising, for example, an elastomer resin, "olefin-based special copolymer soft resin", manufactured by Mitsubishi Chemical Corp. The grip 42 consists of a grip main body 42*a* and a grip end 42*b*, and they are joined with each other at a bonded joint 45 by means of an adhesive, welding (ultrasonic welding etc.) or the like. The grip 42 includes a hollow part 43 formed in its grip region and thereby has a floating function. The spoon working part 41 (cutlery body) and the grip main body 42*a* are connected to each other at a joint 44 by means of insert molding of the thermoplastic resin to constitute a spoon 50.

After the insert molding, the grip main body 42*a* and the grip end 42*b* are united by a bonding means such as an adhesive or welding.

The elastomer resin has a low specific gravity, is capable of producing a lightweight article and has heat resistance and flexibility, so that it is widely used in the fields of medical containers, foods, daily use miscellaneous goods and the like. Accordingly, when the elastomer resin is used as a grip of a spoon, the grip exhibits many advantages. For example, it is lightweight, is easy in handling and is not slippery.

In addition, the decorative quality of the grip 42 can be enhanced by coloring the elastomer resin with a desired color or making marks or various decorative patterns in the resin molding, and it becomes pleasant to use such spoon.

The actions and effects of the above-mentioned constitution are described below.

In the embodiment of the invention, by providing a hollow part as a floating means in the grip, the grip portion functions as a float when the spoon is put in water, and the spoon does not sink into water. Further, the grip is formed by insert molding of a resin and is surely united. Furthermore, the spoon is lightweight, easy in handling and unslippery, so that such spoon can be easily used even for the infants and elderly people. Moreover, by coloring the resin or making marks or decorative patterns on the resin, the decorative quality can be increased, and the pleasure given when the infants and the children use such spoons for the school meals is doubled. In addition, it becomes feasible to produce such spoons at low cost.

As the floating means of the grip, a hollow part is formed in the grip portion, but the floating means is not restricted to the hollow part. As a matter of course, the hollow part may be filled with a member having a specific gravity lower than that of water, for example, a foamed product.

The present embodiment is described above with reference to a spoon, but by replacing its cutlery body (working part) with a forked portion, a knife portion or the like, the applicable range can be widened to all the cutlery.

As a material of the working part of the spoon, titanium is described above as the optimum embodiment, but the material is not restricted to titanium, and other metals such as a titanium alloy, SUS, silver and a silver alloy may be used. In the above embodiment, a hardened layer is provided inside the titanium material of the spoon working part, but on the surface of the titanium material may be provided a hard thin film of TiN, TiC or the like, or the titanium material may be left as it is without providing a hardened layer.

Since the cutlery of the above embodiment floats up in water in the washing tub, it becomes feasible to perform hygienic and labor-saving washing and drying such as automatic washing and automatic drying by passing the cutlery through the devices stepwise equipped. For example, the cutlery runs in a water stream, then in the first washing tub, the cutlery is washed (prewashing) by means of ultrasonic wave or air bubbles given from the bottom surface of the tub. At the other end of the first washing tub, the roller is rotated. Then the cutlery is placed on the roller and conveyed to the next tub (second washing tub). In the second washing tub, the cutlery is washed (finish washing), and is then conveyed to the drying tub.

According to the invention, titanium or titanium alloy tableware having excellent appearance quality, which is not marred easily and is capable of maintaining its beautiful mirror surface even if it is used for a long period of time, can be obtained by forming a hardened layer reaching a depth region from the surface. Especially when the invention is applied to a knife, the knife edge does not become dull, and hence the cutting quality is not deteriorated.

According to the invention, further, it becomes feasible to obtain not only titanium tableware having excellent long-term mar resistance and appearance quality but also two-tone titanium tableware having a portion coated with a TiN coating film and showing a gold color tone and a portion coated with no TiN coating film and showing a silver color tone. Hence, the appearance of the titanium tableware can further be improved and the decorative value can be increased.

According to the invention, furthermore, a process for surface treatment to obtain the titanium tableware having excellent appearance quality and mar resistance with high productivity can be provided.

According to the invention, there can be provided a substrate having a hard decorative coating film, which is free from occurrence of marring on the decorative coating film and formation of irregularities on the substrate surface even if a strong force is applied to the coating film surface and in which separation of the coating film from the substrate can be minimized, that is, a substrate having a hard decorative coating film of excellent mar resistance and high surface hardness, and a process for producing the substrate. Further, there can be provided a titanium or titanium alloy substrate coated with a hard decorative coating film having excellent appearance quality and capable of maintaining beautiful surface even if the substrate is used for a long period of time, and a process for producing the substrate.

Since the cutlery of the invention has a feature of floating in water, contact of the cutlery with one another rarely takes place, and hence the cutlery is hardly marred. Especially in the places where a great number of cutlery are used, such as a kitchen for school meals, a dining room of a company, and a restaurant, working efficiency of cutlery washing can be increased.

The cutlery of the invention is lightweight and easy in handling. In addition, due to its resin grip, the cutlery is unslippery and easy to hold, and hence it gives pleasure for the infants and elderly people to use it. Moreover, the cutlery can be produced at a low cost.

By coloring the grip of the cutlery of the invention or making marks or decorative patterns on the grip, the decorative quality of the cutlery (tableware) can be enhanced and the pleasure of use thereof can be increased.

Since the cutlery of the invention does not sink to the bottom of the washing tub, it is hygienic.

The cutlery of the invention has other various effects, for example, there is no fear of losing the cutlery when it is used at the waterside outdoors and carelessly dropped under water.

What is claimed is:

1. Titanium or titanium alloy tableware having a surface hardened layer formed in an arbitrary depth from the surface, wherein the surface hardened layer comprises a first hardened layer which is formed in the region of an arbitrary depth from the surface and in which nitrogen and oxygen are diffused so as to form a solid solution and a second hardened layer which is formed in an arbitrary region deeper than the first hardened layer.

2. The tableware as claimed in claim 1, wherein 0.6 to 8.0% by weight of nitrogen and 1.0 to 14.0% by weight of oxygen are diffused so as to form a solid solution in the first hardened layer and 0.5 to 14.0% by weight of oxygen is diffused so as to form a solid solution in the second hardened layer.

3. The tableware as claimed in claim 1, wherein the first hardened layer is formed in the region of a given depth from the surface and the second hardened layer is formed in the region deeper than the first hardened layer and of an arbitrary depth from the surface.

4. A process for surface treatment of tableware, comprising:

heating titanium or titanium alloy tableware in a vacuum chamber to anneal the tableware, hardening the tableware by introducing a mixed gas containing nitrogen as a main component and an oxygen component into the vacuum chamber after the heating to anneal step, and further heating the vacuum chamber at a temperature of 700 to 800° C. for a given period of time under a given reduced pressure to diffuse nitrogen and oxygen inside the titanium or titanium alloy tableware from the surface so as to form a solid solution, cooling the titanium or titanium alloy tableware to room temperature after the hardening treatment step, and polishing the tableware after the cooling step.

5. The process for surface treatment as claimed in claim 4, wherein in the heating step, the vacuum chamber is evacuated and heating is carried out under reduced pressure.

6. The process for surface treatment as claimed in claim 4, wherein in the heating step, the vacuum chamber is evacuated, then an inert gas is introduced into the vacuum chamber, and heating is carried out under reduced pressure.

7. The process for surface treatment as claimed in claim 4, wherein in the cooling step, the vacuum chamber is highly evacuated to remove the mixed gas containing nitrogen as a main component and an oxygen component, and cooling is carried out under vacuum.

8. The process for surface treatment as claimed in claim 4, wherein in the cooling step, the vacuum chamber is highly evacuated to remove the mixed gas containing nitrogen as a main component and an oxygen component, then an inert gas is introduced into the vacuum chamber, and cooling is carried out under reduced pressure.

9. The process for surface treatment as claimed in claim 8, wherein the mixed gas containing nitrogen as a main component and an oxygen component is a mixed gas comprising a nitrogen gas containing an oxygen gas.

10. The process for surface treatment as claimed in claim 9, wherein the mixed gas containing nitrogen as a main component and an oxygen component is a mixed gas comprising a nitrogen gas containing a hydrogen gas.

11. The process for surface treatment as claimed in claim 4, wherein the mixed gas containing nitrogen as a main component and an oxygen component is a mixed gas comprising a nitrogen gas containing water vapor.

12. The process for surface treatment as claimed in claim 11, wherein the mixed gas containing nitrogen as a main component and an oxygen component is a mixed gas comprising a nitrogen gas containing a carbon dioxide gas or a carbon monoxide gas.

13. The process for surface treatment as claimed in claim 4, wherein the mixed gas containing nitrogen as a main component and an oxygen component is a mixed gas comprising a nitrogen gas containing an alcohol gas.

14. A process for surface treatment of tableware, comprising:

placing titanium or titanium alloy tableware in a vacuum chamber, evacuating the vacuum chamber, then introducing an inert gas into the vacuum chamber, and heating the tableware under reduced pressure to anneal the tableware, hardening the tableware by evacuating the vacuum chamber to remove the inert gas after the heating to anneal step, then introducing a mixed gas containing nitrogen as a main component and an oxygen component into the vacuum chamber, adjusting the pressure in the vacuum chamber to atmospheric pressure, and further heating the vacuum chamber to a temperature of 700 to 800° C. for a given period of time to diffuse nitrogen and oxygen inside the titanium or titanium alloy tableware from the surface so as to form a solid solution, cooling the titanium or titanium alloy tableware to room temperature after the hardening treatment step, and polishing the tableware after the cooling step.

15. The process for surface treatment as claimed in claim and heating is carried out under reduced pressure.

16. The process for surface treatment as claimed in claim 14, wherein in the heating step, the vacuum chamber is evacuated, then an inert gas is introduced into the vacuum chamber to adjust the pressure to atmospheric pressure, and heating is carried out at atmospheric pressure.

17. The process for surface treatment as claimed in claim 14, wherein in the cooling step, the vacuum chamber is highly evacuated to remove the mixed gas containing nitrogen as a main component and an oxygen component, and cooling is carried out under vacuum.

18. The process for surface treatment as claimed in claim 14, wherein in the cooling step, the vacuum chamber is highly evacuated to remove the mixed gas containing nitrogen as a main component and an oxygen component, then an inert gas is introduced into the vacuum chamber to adjust the pressure to atmospheric pressure, and cooling is carried out at atmospheric pressure.

19. The process for surface treatment as claimed in claim 14, wherein the mixed gas containing nitrogen as a main component and an oxygen component is a mixed gas comprising a nitrogen gas containing an oxygen gas.

20. The process for surface treatment as claimed in claim 14, wherein the mixed gas containing nitrogen as a main component and an oxygen component is a mixed gas comprising a nitrogen gas containing water vapor.

21. The tableware as claimed in claim 1, wherein the first hardened layer is coated with a hard coating film.

22. The tableware as claimed in claim 21, wherein the hard coating film is a nitride, a carbide, an oxide, a nitrido-carbide or a nitrido-carbido-oxide of a 4a, 5a or 6a Group element of the periodic table.

23. The tableware as claimed in claim 21, wherein the hard coating film shows a gold color tone.

24. The tableware as claimed in claim 23, wherein the hard coating film is coated with a gold alloy coating film.

25. The tableware as claimed in claim 24, wherein the gold alloy coating film is made of an alloy of gold and at least one metal selected from Al, Si, V, Cr, Ti, Fe, Co, Ni, Cu, Zn, Ge, Y, Zr, Nb, Mo, Ru, Rh, Pd, Ag, Cd, In, Sn, Hf, Ta, W, Ir and Pt.

26. The tableware as claimed in claim 1, wherein the surface of the first hardened layer has been polished.

27. A substrate having a hard decorative coating film on the surface, which comprises titanium or a titanium alloy and has an internal hardened layer comprising a first hardened layer that is formed in an arbitrary depth toward the inside from the surface, in said first hardened layer nitrogen and oxygen being diffused so as to form a solid solution, and a second hardened layer that is formed in an arbitrary depth toward the inside from the first hardened layer, wherein the hard decorative coating film is formed on the surface of the internal hardened layer.

28. The substrate having a hard decorative coating film as claimed in claim 27, wherein in the internal hardened layer, 0.6 to 8.0% by weight of nitrogen and 1.0 to 14.0% by weight of oxygen are diffused so as to form a solid solution in the first hardened layer and 0.5 to 14.0% by weight of oxygen is diffused so as to form a solid solution in the seconded hardened layer.

29. The substrate having a hard decorative coating film as claimed in claim 27, wherein in the internal hardened layer formed in the substrate, the first hardened layer is formed in the region of 1.4 $\mu$m toward the inside from the surface and the second hardened layer is formed in the region deeper than the first hardened layer and of 20.4 $\mu$m toward the inside from the surface.

30. The substrate having a hard decorative coating film as claimed in claim 27, wherein the hard decorative coating film is made of a nitride, a carbide, an oxide, a nitrido-carbide or a nitrido-carbido-oxide of a 4a, 5a or 6a Group element of the periodic table.

31. The substrate having a hard decorative coating film as claimed in claim 27, wherein the hard decorative coating film is a hard carbon coating film.

32. The substrate having a hard decorative coating film as claimed in claim 31, which has, between the internal hardened layer and the hard decorative coating film, an intermediate layer of a two-layer structure consisting of a lower layer mainly made of chromium or titanium and an upper layer mainly made of silicon or germanium.

33. The substrate having a hard decorative coating film as claimed in claim 31, which has, between the internal hardened layer and the hard decorative coating film, an intermediate layer of a two-layer structure consisting of a lower layer mainly made of titanium and an upper layer mainly made of any one of tungsten, tungsten carbide, silicon carbide and titanium carbide.

34. The substrate having a hard decorative coating film as claimed in claim 27, wherein the thickness of the hard decorative coating film is in the range of 0.1 to 3.0 $\mu$m.

35. The substrate having a hard decorative coating film as claimed in claim 27, wherein the surface of the hard decorative coating film shows a gold color tone.

36. The substrate having a hard decorative coating film as claimed in claim 35, wherein a coating film comprising gold or a gold alloy is formed on the surface of the hard decorative coating film.

37. The substrate having a hard decorative coating film as claimed in claim 27, which is a camera body, a cellular telephone body, a portable radio body, a video camera body, a lighter body or a personal computer main body.

38. A process for producing a substrate having a hard decorative coating film, comprising:

heating a substrate comprising titanium or a titanium alloy in a vacuum chamber to anneal the substrate, hardening the substrate by introducing a mixed gas containing nitrogen as a main component and an oxygen component into the vacuum chamber, and further heating the vacuum chamber to a temperature of 700 to 800° C. for a given period of time under given reduced pressure to diffuse nitrogen and oxygen inside the titanium or titanium alloy substrate from the surface so as to form a solid solution, cooling the titanium or titanium alloy substrate to room temperature, polishing the substrate surface, washing the substrate, placing the substrate in a vacuum chamber and evacuating the vacuum chamber, introducing argon into the vacuum chamber, ionizing the argon and ion bombarding the substrate surface, forming by sputtering an intermediate layer comprising a metal or a metallic carbide on the substrate surface, exhausting the argon the vacuum chamber and introducing a gas containing carbon into the vacuum chamber, and generating a plasma in the vacuum chamber and forming by plasma CVD treatment a diamond-like carbon coating film on the surface of the intermediate layer.

39. The process for producing a substrate having a hard decorative coating film as claimed in claim 38, wherein in the step of forming an intermediate layer, argon is introduced into the vacuum chamber and ionized, and any one of silicon, tungsten, titanium carbide, silicon carbide and chromium carbide is targeted to form an intermediate layer mainly made of any one of silicon, tungsten, titanium carbide, silicon carbide and chromium carbide.

40. The process for producing a substrate having a hard decorative coating film as claimed in claim 38, wherein the step of forming an intermediate layer consists of:

a first intermediate layer forming step wherein argon is introduced into the vacuum chamber and ionized, and chromium or titanium is targeted to form a lower layer mainly made of chromium or titanium, and a second intermediate layer forming step wherein silicon or germanium is targeted to form an upper layer mainly made of silicon or germanium.

41. The process for producing a substrate having a hard decorative coating film as claimed in claim 38, wherein the step of forming an intermediate layer consists of:

a first intermediate layer forming step wherein argon is introduced into the vacuum chamber and ionized, and titanium is targeted to form a lower layer mainly made of titanium, and a second intermediate layer forming step wherein tungsten is targeted to form an upper layer mainly made of tungsten.

42. The process for producing a substrate having a hard decorative coating film as claimed in claim 38, wherein the step of forming an intermediate layer consists of:

a first intermediate layer forming step wherein argon is introduced into the vacuum chamber and ionized, and titanium is targeted to form a lower layer mainly made of titanium, and a second intermediate layer forming step wherein a gas containing carbon is introduced into the vacuum chamber, and tungsten or silicon is targeted to form an upper layer mainly made of tungsten carbide or silicon carbide.

43. A process for producing a substrate having a hard decorative coating film, comprising:

heating a substrate comprising titanium or a titanium alloy in a vacuum chamberto anneal the substrate, hardening the substrate by introducing a mixed gas containing nitrogen as a main component and an oxygen component into the vacuum chamber, and heating the vacuum chamber to a temperature of 700 to 800° C. for a given period of time under given reduced pressure to diffuse nitrogen and oxygen inside the titanium or titanium alloy substrate from the surface so as to form a solid solution, cooling the titanium or titanium alloy substrate to room temperature, polishing a surface of the substrate, washing the substrate, placing the substrate in a vacuum chamber and evacuating the vacuum chamber, introducing argon into the vacuum chamber, ionizing the argon and ion bombarding the substrate surface, and forming a hard decorative coating film comprising a nitride, a carbide, an oxide, a nitrido-carbide or a nitrido-carbido-oxide of a 4a, 5a or 6a Group element of the periodic table on the substrate surface by ion plating or sputtering.

44. The process for producing a substrate having a hard decorative coating film as claimed in claim 43, wherein the step of forming a hard decorative coating film is followed by a step wherein a gold or gold alloy coating film is formed on the surface of the hard decorative coating film by ion plating or sputtering.

* * * * *

UNITED STATES PATENT AND TRADEMARK OFFICE

CERTIFICATE OF CORRECTION

PATENT NO. : 6,855,215 B2
DATED : February 15, 2005
INVENTOR(S) : Kushida et al.

It is certified that error appears in the above-identified patent and that said Letters Patent is hereby corrected as shown below:

Title page,
Item [22], PCT Filed, "Jul. 3, 2001" should read -- March 7, 2001 --.

Column 56,
Lines 61-62, "claim and" should read -- claim 14, wherein in the heating step, the vacuum chamber is evacuated --.

Column 60,
Line 4, "chamberto" should read -- chamber to --.

Signed and Sealed this

Sixth Day of September, 2005

JON W. DUDAS
*Director of the United States Patent and Trademark Office*